US006280322B1

(12) United States Patent
Linden et al.

(10) Patent No.: US 6,280,322 B1
(45) Date of Patent: Aug. 28, 2001

(54) SINGLE SHEET OF PAPER FOR DUPLICATING INFORMATION ENTERED ON BOTH SURFACES THEREOF

(76) Inventors: Gerald E. Linden, 2008 Cotswold Dr., Orlando, FL (US) 32825; Keith E. Schubert, 4 Timothy Rd., W. Norwalk, CT (US) 06850

( * ) Notice: Subject to any disclaimer, the term of this patent is extended or adjusted under 35 U.S.C. 154(b) by 0 days.

(21) Appl. No.: 08/395,509

(22) Filed: Feb. 27, 1995

Related U.S. Application Data

(63) Continuation-in-part of application No. 08/126,538, filed on Sep. 24, 1993, now Pat. No. 5,395,288, and a continuation-in-part of application No. 08/077,290, filed on Jun. 15, 1993, now Pat. No. 5,393,265, which is a division of application No. 07/908,540, filed on Jun. 29, 1992, now Pat. No. 5,224,897, which is a division of application No. 08/808,847, filed on Dec. 16, 1991, now Pat. No. 5,248,279, which is a continuation of application No. 07/591,781, filed on Oct. 2, 1990, now abandoned, said application No. 08/126,538, is a division of application No. 08/077,290, and a division of application No. 08/126,538, said application No. 07/591,781, is a continuation-in-part of application No. 07/497,219, filed on Mar. 22, 1990, now Pat. No. 5,154,668, which is a continuation-in-part of application No. 07/494,565, filed on Mar. 16, 1990, now Pat. No. 5,137,494, which is a continuation-in-part of application No. 07/436,189, filed on Nov. 13, 1989, now Pat. No. 5,197,922, which is a continuation-in-part of application No. 07/334,183, said application No. 08/808,847, is a continuation-in-part of application No. 07/723,690, filed on Jun. 24, 1991, now Pat. No. 5,135,437, which is a continuation of application No. 07/484,686, filed on Feb. 23, 1990, now abandoned, which is a continuation-in-part of application No. 07/436,189.

(51) Int. Cl.[7] ..... B41L 1/20

(52) U.S. Cl. ..... 462/18; 462/22; 462/28

(58) Field of Search ..... 462/8, 18, 22, 462/24, 39, 2; 503/205, 227, 222

(56) References Cited

U.S. PATENT DOCUMENTS

Re. 30,041 7/1979 Maalouf ..... 282/27.5

(List continued on next page.)

FOREIGN PATENT DOCUMENTS

| | | | |
|---|---|---|---|
| 549442 | 4/1932 | (DE) . | |
| 613658 | 3/1926 | (FR) . | |
| 1347807 | 2/1974 | (GB) . | |
| 2085359 | 4/1982 | (GB) . | |
| 083-104008 | 8/1983 | (JP) | 462/39 |
| 128558 | 2/1962 | (NZ) . | |
| 128915 | 3/1964 | (NZ) . | |
| 185282 | 11/1980 | (NZ) . | |

OTHER PUBLICATIONS

Black Clawson Brochure.

(List continued on next page.)

*Primary Examiner*—Willmon Fridie, Jr.
(74) *Attorney, Agent, or Firm*—Gerald E. Linden

(57) ABSTRACT

Improvements to self-replicating duplex forms are disclosed. Generally, a single sheet of paper is divided into original and copy panels by fold line, and carbonless coatings are applied to the panels so that information entered on the two, front and back surfaces of the original panel are reproduced on the two surfaces of the copy panel. An endorsable carbonless CB coating is applied to the original panel, either at the mill or on-press. A carbonless CF coating is applied to the copy panel so that the coated copy panel is substantially the same thickness as the coated original panel. Specific areas for filling out information on the original panel are offset, from front-to-back, and methods of checking this offset are disclosed.

14 Claims, 29 Drawing Sheets

U.S. PATENT DOCUMENTS

| | | | |
|---|---|---|---|
| Re. 30,116 | 10/1979 | Maalouf | 282/27.5 |
| Re. 31,695 | 10/1984 | Zink | 427/211 |
| 371,126 | 10/1887 | Currie . | |
| 396,560 | 1/1889 | Harrison . | |
| 418,455 | 12/1889 | Gray . | |
| 419,359 | 1/1890 | Rogers . | |
| 445,368 | 1/1891 | Campbell . | |
| 664,384 | 12/1900 | Cooke . | |
| 683,782 | 10/1901 | Morland . | |
| 756,258 | 4/1904 | Mallin . | |
| 765,408 | 7/1904 | Wildey . | |
| 797,302 | 8/1905 | Meacham . | |
| 897,783 | 9/1908 | Reynolds . | |
| 971,283 | 9/1910 | Krueger . | |
| 972,549 | 10/1910 | Lewis . | |
| 1,101,262 | 6/1914 | Edmonds . | |
| 1,187,682 | 6/1916 | Trueman | 282/12 |
| 1,301,834 | 4/1919 | Gilman . | |
| 1,392,748 | 10/1921 | Davidson . | |
| 1,468,094 | 9/1923 | Wherry . | |
| 1,873,997 | 8/1932 | Davis . | |
| 1,980,318 | 11/1934 | Caton . | |
| 1,980,319 | 11/1934 | Caton . | |
| 2,006,034 | 6/1935 | Stevens . | |
| 2,035,768 | 3/1936 | Sherman et al. | 91/68 |
| 2,084,221 | 6/1937 | Schutz | 282/28 |
| 2,093,086 | 9/1937 | Luzzatto | 282/27 |
| 2,098,706 | 11/1937 | Lawson et al. | 282/12 |
| 2,118,888 | 5/1938 | Lewis et al. | 101/131 |
| 2,131,381 | 9/1938 | Linderman | 282/28 |
| 2,148,886 | 2/1939 | Wanser | 229/69 |
| 2,168,098 | 8/1939 | Groák | 282/26 |
| 2,194,670 | 3/1940 | Neu | 282/27 |
| 2,211,532 | 8/1940 | Biggs | 282/12 |
| 2,220,842 | 11/1940 | Hano | 282/12 |
| 2,226,722 | 12/1940 | Jones | 282/22 |
| 2,257,766 | 10/1941 | Sherman | 282/3 |
| 2,262,347 | 11/1941 | Sturc | 282/26 |
| 2,264,119 | 11/1941 | Lichter | 283/1 |
| 2,327,215 | 8/1943 | Potter | 282/12 |
| 2,458,729 | 1/1949 | Politzer | 40/102 |
| 2,470,586 | 5/1949 | Tathwell | 282/9 |
| 2,503,680 | 4/1950 | Newman | 282/19 |
| 2,548,366 | 4/1951 | Green et al. | 282/28 |
| 2,550,466 | 4/1951 | Green et al. | 282/28 |
| 2,550,468 | 4/1951 | Green et al. | 282/28 |
| 2,550,469 | 4/1951 | Green et al. | 282/28 |
| 2,606,775 | 8/1952 | Newman | 282/28 |
| 2,618,573 | 11/1952 | Green | 117/36 |
| 2,637,571 | 5/1953 | Tilly | 281/5 |
| 2,694,429 | 11/1954 | Berger | 150/39 |
| 2,712,507 | 7/1955 | Green | 117/36 |
| 2,802,678 | 8/1957 | Bright | 282/22 |
| 2,869,898 | 1/1959 | Martin . | |
| 2,870,040 | 1/1959 | Gill | 117/36 |
| 2,907,585 | 10/1959 | Sornberger | 282/22 |
| 2,980,447 | 4/1961 | Weger | 282/22 |
| 3,016,308 | 1/1962 | Macaulay | 117/36.7 |
| 3,104,799 | 9/1963 | Steidinger | 229/69 |
| 3,163,447 | 12/1964 | Seekins | 282/12 |
| 3,364,052 | 1/1968 | Martino | 117/15 |
| 3,376,154 | 4/1968 | Campbell et al. | 117/364 |
| 3,429,827 | 2/1969 | Ruus | 252/316 |
| 3,481,759 | 12/1969 | Ostlie | 117/36.2 |
| 3,539,375 | 11/1970 | Baum | 117/36.2 |
| 3,625,547 | 12/1971 | Burke | 282/23 |
| 3,682,681 | 8/1972 | Kunkel | 117/36.2 |
| 3,769,057 | 10/1973 | Lin | 117/36.2 |
| 3,769,062 | 10/1973 | Ishige et al. | 117/36.2 |
| 3,825,467 | 7/1974 | Phillips, Jr. | 161/159 |
| 3,854,654 | 12/1974 | Van Malderghem | 229/69 |
| 3,902,655 | 9/1975 | Huffman | 229/69 |
| 3,908,063 | 9/1975 | Rosendale et al. | 428/320 |
| 3,945,870 | 3/1976 | Johnsen | 156/201 |
| 3,955,750 | 5/1976 | Huffman | 229/69 |
| 3,963,853 | 6/1976 | Hughes et al. | 428/326 |
| 3,968,299 | 7/1976 | Angleman | 428/307 |
| 3,981,523 | 9/1976 | Maalouf | 282/27.5 |
| 3,988,971 | 11/1976 | Steidinger | 93/63 M |
| 3,996,406 | 12/1976 | Alsop | 428/307 |
| 4,000,916 | 1/1977 | Lacas | 282/11.5 |
| 4,036,511 | 7/1977 | Maalouf | 282/27.5 |
| 4,039,046 | 8/1977 | D'Luhy | 282/22 R |
| 4,045,053 | 8/1977 | Carriere | 282/22 R |
| 4,046,404 | 9/1977 | Treier | 282/27.5 |
| 4,056,191 | 11/1977 | Weisenfluh | 206/629 |
| 4,062,567 | 12/1977 | Macaulay | 282/27.5 |
| 4,063,754 | 12/1977 | Shackle et al. | 282/27.5 |
| 4,081,127 | 3/1978 | Steidinger | 229/69 |
| 4,081,188 | 3/1978 | Westcott | 282/27.5 |
| 4,091,122 | 5/1978 | Davis et al. | 427/44 |
| 4,095,695 | 6/1978 | Steidinger | 206/620 |
| 4,097,619 | 6/1978 | Davis et al. | 427/44 |
| 4,111,461 | 9/1978 | Levensalor | 282/27.5 |
| 4,112,138 | 9/1978 | Davis et al. | 427/54 |
| 4,113,281 | 9/1978 | Halse | 282/11.5 A |
| 4,121,857 | 10/1978 | Halse | 282/11.5 A |
| 4,126,334 | 11/1978 | Van Malderghem | 282/22 R |
| 4,137,343 | 1/1979 | Davis et al. | 427/150 |
| 4,138,302 | 2/1979 | D'Luhy | 156/216 |
| 4,139,218 | 2/1979 | Davis et al. | 282/27.5 |
| 4,139,392 | 2/1979 | Davis et al. | 106/14.5 |
| 4,143,890 | 3/1979 | Davis et al. | 282/27.5 |
| 4,143,891 | 3/1979 | Neubauer | 282/27.5 |
| 4,165,101 | 8/1979 | Sternberg | 282/27.5 |
| 4,168,851 | 9/1979 | Halse | 282/11.5 A |
| 4,172,605 | 10/1979 | Welsch et al. | 282/27.5 |
| 4,178,018 | 12/1979 | Halse | 282/11.5 A |
| 4,198,446 | 4/1980 | Goetz | 427/150 |
| 4,199,174 | 4/1980 | Sornberger | 282/27.5 |
| 4,203,619 | 5/1980 | Sanders | 282/27.5 |
| 4,208,460 | 6/1980 | Knechtle et al. | 428/195 |
| 4,217,162 | 8/1980 | Glanz | 156/305 |
| 4,282,275 | 8/1981 | Werner | 427/428 |
| 4,336,067 | 6/1982 | Shackle et al. | 106/21 |
| 4,343,494 | 8/1982 | Ehrhardt et al. | 282/27.5 |
| 4,352,855 | 10/1982 | Hiraishi et al. | 428/320.4 |
| 4,354,449 | 10/1982 | Zink | 118/126 |
| 4,361,108 | 11/1982 | Robillard et al. | 118/265 |
| 4,381,120 | 4/1983 | Golden | 282/27.5 |
| 4,397,483 | 8/1983 | Hiraishi et al. | 282/27.5 |
| 4,407,524 | 10/1983 | Trautlein | 282/9 R |
| 4,425,386 | 1/1984 | Chang | 427/256 |
| 4,448,445 | 5/1984 | Chang et al. | 346/206 |
| 4,455,327 | 6/1984 | Yoshida et al. | 427/131 |
| 4,501,559 | 2/1985 | Griswold et al. | 434/154 |
| 4,512,595 | 4/1985 | Breen | 283/70 |
| 4,533,160 | 8/1985 | Malone | 282/23 R |
| 4,556,390 | 12/1985 | Rahn et al. | 434/433 |
| 4,566,720 | 1/1986 | Goldman et al. | 281/15 R |
| 4,576,399 | 3/1986 | White et al. | 282/8 R |
| 4,583,765 | 4/1986 | Messinger | 282/9 R |
| 4,593,935 | 6/1986 | Kearns | 282/28 R |
| 4,597,993 | 7/1986 | Okada et al. | 427/150 |
| 4,614,362 | 9/1986 | Breen et al. | 282/9 R |
| 4,614,363 | 9/1986 | Breen | 282/22 R |
| 4,636,818 | 1/1987 | Jerabek | 346/213 |
| 4,642,662 | 2/1987 | Torii et al. | 346/215 |
| 4,657,783 | 4/1987 | Tatt et al. | 427/211 |
| 4,690,433 | 9/1987 | Showers et al. | 283/1 |
| 4,715,620 | 12/1987 | Thompson | 282/9 R |

| | | | | |
|---|---|---|---|---|
| 4,722,553 | | 2/1988 | Evans | 282/9 R |
| 4,740,015 | | 4/1988 | Caprio et al. | 283/70 |
| 4,745,097 | | 5/1988 | Maekawa et al. | 503/209 |
| 4,762,342 | | 8/1988 | Thompson | 282/9 R |
| 4,814,319 | | 3/1989 | Matsumoto et al. | 503/216 |
| 4,846,594 | | 7/1989 | Riskin | 400/188 |
| 4,853,364 | | 8/1989 | Liang et al. | 503/216 |
| 4,859,561 | | 8/1989 | Metz et al. | 430/138 |
| 4,871,193 | | 10/1989 | Wörndli | 283/72 |
| 4,877,767 | | 10/1989 | Liang et al. | 503/212 |
| 4,912,080 | | 3/1990 | Weinstein | 503/200 |
| 4,935,401 | | 6/1990 | Pendergrass, jr. | 503/206 |
| 4,938,507 | | 7/1990 | Ashby et al. | 282/9 R |
| 4,947,343 | | 8/1990 | Amari | 364/518 |
| 4,957,380 | | 9/1990 | Gerstle et al. | 400/279 |
| 4,959,343 | | 9/1990 | Weinstein | 503/200 |
| 4,970,193 | | 11/1990 | Liang et al. | 503/201 |
| 4,974,035 | | 11/1990 | Rabb et al. | 355/320 |
| 4,977,060 | | 12/1990 | Liang et al. | 430/138 |
| 4,977,131 | | 12/1990 | Macaulay | 503/201 |
| 4,996,184 | | 2/1991 | Bevan et al. | 503/226 |
| 5,002,311 | | 3/1991 | Brunjes | 282/9 R |
| 5,004,271 | | 4/1991 | Piatt | 283/65 |
| 5,039,652 | | 8/1991 | Doll et al. | 503/206 |
| 5,127,879 | | 7/1992 | Schubert | 462/2 |
| 5,135,437 | * | 8/1992 | Schubert | 462/8 |
| 5,137,494 | | 8/1992 | Schubert et al. | 462/68 |
| 5,154,668 | | 10/1992 | Schubert | 462/25 |
| 5,173,080 | | 12/1992 | Longtin | 462/2 |
| 5,197,922 | * | 3/1993 | Schubert | 462/8 X |
| 5,203,739 | | 4/1993 | Neubauer | 462/6 |
| 5,224,897 | | 7/1993 | Linden et al. | 462/24 |
| 5,248,279 | * | 9/1993 | Linden et al. | 462/8 |
| 5,248,280 | | 9/1993 | Lockwood | 462/19 |
| 5,393,265 | * | 2/1995 | Linden et al. | 462/18 X |
| 5,395,288 | * | 3/1995 | Linden et al. | 462/28 X |

OTHER PUBLICATIONS

"Flip–N–Rite", 7–page instructions by Gary Thompson.

FORM Magazine, Feb., 1989, pp. 74–80.

Business Forms Labels & Systems, Jul. 1990, p. 48.

"Pressure Sensitive Papers", Project 2558, No. 222, TAPPI Coating Committee, 1965. (copy filed previously).

"Pressure Sensitive Papers", Project 2558, TAPPI Coating Committee, Dec., 1967. (copy filed previously).

Facsimiles of BH Medical, MAP Phone Message, Moore Two–Way Rite, St. Vincent Medical Center, Maybelline and Hartz Mountain forms.

* cited by examiner

SINGLE SHEET OF PAPER FOR DUPLICATING INFORMATION ENTERED ON BOTH SURFACES THEREOF

CROSS-REFERENCE TO RELATED APPLICATIONS

This application is a continuation-in-part of commonly-owned, U.S. patent application Ser. No. 08/077,290, filed Jun. 15, 1993 (now U.S. Pat. No. 5,393,265, issued Feb. 28, 1995).

This application is a continuation-in-part of commonly-owned, U.S. patent application Ser. No. 08/126,538, filed Sep. 24, 1993 (now U.S. Pat. No. 5,395,288, issued Mar. 7, 1995).

The aforementioned U.S. patent application Ser. No. 08/077,290 is a division of commonly-owned U.S. patent application Ser. No. 07/908,540, filed Jun. 29, 1992 (now U.S. Pat. No. 5,224,897, issued Jul. 6, 1993), which is a continuation of commonly-owned U.S. patent application Ser. No. 07/591,781, filed Oct. 2, 1990 (status, abandoned).

The aforementioned U.S. patent application Ser. No. 08/126,538 is a division of commonly-owned U.S. patent application Ser. No. 08/808,847, filed Dec. 16, 1991 (now U.S. Pat. No. 5,248,279, issued Sep. 28, 1993).

This application also functions as a "division" of both of the aforementioned commonly-owned, copending U.S. patent application Nos. 08/077,290 and 08/126,538, in that it is largely directed to subject matter which was restricted (and subsequently withdrawn from consideration) in those two parent cases, each of which depends variously back to commonly-owned U.S. patent application Ser. No. 07/334,183, filed Apr. 6, 1989 (now U.S. Pat. No. 5,127,879, issued Jul. 7, 1992).

The aforementioned U.S. patent application Ser. No. 07/591,781 is a continuation-in-part of commonly-owned U.S. patent application Ser. No. 07/497,219, filed on Mar. 22, 1990 (now U.S. Pat. No. 5,154,668, issued Oct. 13, 1992), which is a continuation-in-part of commonly-owned U.S. patent application Ser. No. 07/494,565, filed on Feb. 26, 1990 and accorded a filing date of Mar. 16, 1990 (now U.S. Pat. No. 5,137,494, issued Aug. 11, 1992), which is a continuation-in-part of commonly-owned U.S. patent application Ser. No. 07/436,189, filed Nov. 13, 1989 (now U.S. Pat. No. 5,197,922, issued Mar. 30, 1993), which is a continuation-in-part of the aforementioned U.S. patent application Ser. No. 07/334,183.

The aforementioned U.S. patent application Ser. No. 08/808,847 is a continuation-in-part of commonly-owned U.S. patent application No. 07/723,690, filed on Jun. 24, 1991 (now U.S. Pat. No. 5,135,437, issued Aug. 4, 1992), which is a continuation of commonly-owned U.S. patent application Ser. No. 07/484,686, filed Feb. 23, 1990 (status abandoned), which is a continuation-in-part of the aforementioned commonly-owned U.S. patent application Ser. No. 07/436,189.

TECHNICAL FIELD OF THE INVENTION

The invention relates to methods and apparatus for replicating information entered on both sides of a single sheet of paper, especially carbonless copying techniques.

BACKGROUND OF THE INVENTION

Carbonless copy forms are well known. A typical two-part form is a "manifold" (many part) construction including a top sheet having a coated back (CB) containing microencapsulated (generally colorless) dye, and a bottom sheet having a coated front (CF) containing a reactive dye-revealing substance. The top and bottom sheets are assembled, such as by gluing, into a "manifold", or many part set, which typically has a "stub". The pressure of writing on the front surface of the top sheet causes the microcapsules on the CB-coated back surface of the top sheet to rupture, releasing dye onto the CF-coated front surface of the bottom sheet, whereupon the writing is revealed in a contrasting (visible) color on the front surface of the bottom sheet.

Multiple carbonless copies are produced in a similar manner. One or more intermediate sheets are assembled (in the manifold assembly) between the CB top and CF bottom sheets. Each intermediate sheet has a carbonless front (CF) coating on its front surface for revealing the (CB) dye from the previous sheet, and has a carbonless back (CB) coating on its back surface for releasing dye to the CF-coated surface of the next sheet in the set. The intermediate sheets are termed "CFB" sheets. Using these techniques, one or more carbonless copies of information entered on the front surface of the original (top) sheet can be reproduced on the front surface of the copy (intermediate and bottom) sheets.

The chemistry of the CB (image-transferring) and CF (imagerevealing) coatings is well known, as are techniques for applying these coatings to paper stock. Generally, in order for a reaction between a CF coating and a CB coating to occur, they must be from a "common" reaction system. These coatings and techniques include various coatings applied to paper stock at the mill, as it is being produced, and coatings applied later (typically during the printing process) to plain paper stock. OPAS (On Press Application System) coatings offered by Mead Corporation are an example of the latter.

One well known variation of the two part CB/CF chemistry is the "Self-Contained" ("SC") coating. The SC coating is essentially a mixture of CB and CF, and is applied to the front surface of an underlying sheet for autogenously revealing an image of writing on the front surface of an overlying, un-coated sheet, in response to pressure rupturing microencapsulated (typically the CB) constituents.

Another coating is a "transfer-onto-plain-paper" coating, wherein the back side of the overlying sheet is coated and the front surface of the underlying sheet is not coated. Since this type of coating functions in conjunction with plain paper, in an autogenous manner similar to SC, but is applied to the overlying versus underlying sheet, it can be termed "anti-SC". U.S. Pat. No. 4,352,855 discloses such a "transfer-onto-plain-paper" coating.

A variation of the single sided carbonless form is found in so-called "two-way write" systems. One such example is found in U.S. Pat. No. 4,000,916, issued to Lucas, which describes a manifold report form having three superimposed record sheets (top, middle and bottom). Carbon sheets and protective sheets are arranged between the record sheets. Information entered on the front surface of the top record sheet is reproduced on the front surfaces of the middle and bottom sheets. The form is then flipped over, in its entirety, and various carbon and protective sheets are removed. Information entered on the back surface of the bottom sheet is reproduced on the back surface of the middle and top sheets.

With such two-way write systems, a true original is not formed. Rather, each of the top and bottom sheets contains "original" (e.g., hand written) information on only one surface, and "copy" (reproduced by carbon paper or the CB/CF dye reaction) information on the other surface. Such a "bifurcation" of the original information is unsuitable in many applications, such as for legal forms.

For a "true-original", two-sided self-replicating form, the top sheet would have original writing on both sides, and additional sheets would have copy images in both sides. A "true-original" is often required in legal documents, and the like.

An early example of a true-original system is found in U.S. Pat. No. 2,802,678 (Bright; 1957), wherein several sheets, interleaved carbon papers and interleaved guard sheets are employed. This patent also discloses an alternate configuration of the sheets wherein a "two-way rite" manifold assembly is produced.

Another example of a true-original system is U.S. Pat. Nos. 3,981,523, 4,036,511, RE 30,041 and RE 30,116 (Maalouf), which employ separate, non-manifolded carbonless-coated sheets.

Another example of a true-original type system is found in U.S. Pat. No. 4,126,334 (Van Malderghem), which discloses a manifold assembly of three sheets. Information is entered on one side of a top sheet, and is imaged onto corresponding one sides of an intermediate and bottom sheet. The intermediate sheet is removed from the assembly, the top sheet is flipped over, and information entered on the opposite side of the top sheet is imaged onto the corresponding opposite side of the bottom sheet.

Additional examples of "two-way rite" and "true-original" manifold form assemblies are found in U.S. Pat. Nos. 4,715,620 and 4,762,342, issued to Thompson, and are discussed in greater detail hereinbelow. As with Van malderghem, the examples set forth in the Thompson patents are also manifold assemblies, and rely on flipping the top sheet over a stub for entering information on the opposite side of the top sheet.

U.S. Pat. Nos. 4,715,620 and 4,762,342, issued to Thompson, attempt to solve the challenge of providing a "true" original where the top sheet has "original" information on the front and back surfaces thereof. Therein, top, intermediate and bottom sheets are joined in a manifold assembly having a stub. Patterned carbon papers and/or carbonless coatings are employed, between the various sheets, as in the two-way write systems. Information is entered on the front surface of the top sheet. The top sheet is then "flipped" (repositioned) around the stub so that its front surface is in contact with the back surface of the bottom sheet. Additional information is then entered on the exposed back surface of the top sheet. The front surface of the top sheet is coated with carbonless CB and the back surface of the bottom sheet is coated with carbonless CF so that the information entered on the back surface of the top sheet is reproduced on the back surface of the bottom sheet.

Using Thompson's techniques, it is extremely difficult to maintain registration (alignment) of the top sheet when it is flipped around the stub. Hence, it is suggested by Thompson that the stub be "gently folded over" along with the top sheet. This causes a gap between the top sheet and bottom sheet, which is inapposite to carbonless image forming. The top sheet, when folded over the stub in this manner, must be smoothed out prior to entering the additional information on the back surface of the top sheet. Additionally, if the stub is not folded properly, the top sheet will not be in register with the other sheets when it is flipped over for entering information on the back surface thereof.

The implementation of all of the above-described manifold assemblies (forms) is further complicated by the need for machinery necessary to collate, glue and/or staple individual, dissimilarly coated sheets of paper, carbon papers and protective sheets into a manifold arrangement. This necessitates costly set up charges for the equipment, creates delays in going from paper stock to preprinted form, and creates cumbersome inventory requirements.

Generally, any of the techniques of employing a manifold form assembly for either "two-way rite" or "true-original" systems are limited in utility in that 1) if the top sheet is to be repositioned, it is extremely difficult to maintain registration (alignment) when a stub of any kind is involved; 2) they are generally formed of many sheets of different paper stock, and require collating and assembling at the end of the production line; and 3) they are generally not very user-friendly.

The aforementioned commonly-owned U.S. patent application Ser. No. 07/334,183 discloses the "genesis" of two-sided (or duplex) copying of both sides of an original form, wherein an original part (portion) of a single sheet has information entered, such as by pen, on both sides thereof, which information is replicated on both sides of a copy part (portion) of the same single sheet. Techniques for effecting this result using carbon paper and carbonless coatings are disclosed therein.

The aforementioned commonly-owned U.S. patent application Ser. No. 07/436,189 discloses further techniques for effecting two-sided copying with a single sheet of paper, using carbonless coatings, and discloses techniques for "patterning" the carbonless coatings, and discloses techniques for making more than one copy of information entered on both sides of an original portion (panel) of a single sheet of paper.

The aforementioned commonly-owned U.S. patent application Ser. No. 07/484,686 discloses a technique wherein a single sheet of paper is divided into three panels: an original panel which is void of any carbonless coating; a copy panel which is coated with carbonless CF (image revealing) on both sides; and an intermediate transfer panel which is coated with carbonless CB (image transferring) on both sides.

The aforementioned commonly-owned U.S. patent application Ser. No. 07/494,565 discloses various techniques of patterning coatings on a single sheet of paper to avoid writing in coated areas.

The aforementioned commonly-owned U.S. patent application Ser. No. 07/497,219 discloses techniques for making two copies of information entered on both sides of an original portion of a single sheet of paper, without patterning, employing two dissimilar carbonless systems (i.e., the CB from a one system is not reactive with the CF from another system, and vice-versa).

Although all of the aforementioned commonly-owned U.S. Patent Applications disclose techniques for making duplex (two-sided) carbonless copies, using a single sheet of paper, certain improvements to those techniques have been developed by the inventors thereof.

DISCLOSURE OF THE INVENTION

It is a general object of the present invention to provide improvements in self-replicating duplex forms.

It is a further object of the invention to provide improved coating techniques for self-replicating duplex forms.

It is a further object of the invention to provide improved "user-friendliness" in self-replicating duplex forms.

It is a further object of the present invention to provide improved manufacturing techniques for self-replicating duplex forms.

It is a further object of the invention to provide improved coating arrangements for self-replicating duplex forms.

It is further object of the present invention to provide improved physical configurations for self-replicating duplex forms.

It is further object of the present invention to provide improved end uses for self-replicating duplex forms.

Additionally, as set forth in the above-referenced commonly owned U.S. patent application Ser. No. 08/126,538:

It is a further object of the invention to provide a single sheet, non-manifolded, two-way rite system.

It is a further object of the invention to provide improved techniques for making two or more copies in either a true-original or two-way rite system.

SUMMARY OF PARENT CASES

By way of summary, according to the inventions disclosed in the parent cases, a single sheet of paper is divided (delineated) by fold lines into two or more panels (portions), one of which serves as an "original" panel for entering information on both sides thereof, another of which serves as a "copy" panel for reproducing the information entered on both the front and back surfaces of the original panel.

Providing a "set" of carbonless papers, consisting of an original coated on both sides with carbonless CB and a copy coated on both sides with carbonless CF is also disclosed.

Substantially fully coating the original panel with carbonless CB on both sides is also disclosed.

Patterning the CB coating on the original panel to leave areas clear of CB coating (which, with some CB coatings tends to clog pens) for entering information on the original panel, and offsetting the clear areas, from front-to-back on the original panel, is disclosed.

Methods and apparatus for ensuring a front-to-back offset of areas for entering information on the front and back surfaces of the original panel are disclosed.

The use of Self-Contained (SC) coatings is disclosed.

Providing self-replicating duplex forms as a single sheet of paper is generally emphasized.

Dividing (delineating) a single sheet into three panels by two fold lines is disclosed—an original panel for entering information on both sides thereof, and devoid of any coatings; a copy panel, coated on both sides with carbonless CF, for reproducing the information on both sides thereof, and an intermediate transfer panel, coated on both sides with carbonless CB, for effecting reproduction from the original to the copy panels. Alternatively, the intermediate transfer panel is formed from a separate sheet of paper, and may be coated on only one side thereof with carbonless CB.

The original panel is preferably white, and the copy panel is preferably tinted a dissimilar color, such as pink. With mill stock, the pink tint is usually in the paper stock itself. If employed, the intermediate transfer panel is preferably dissimilarly colored from either of the original or copy panels. According to the present invention, the copy panel can be tinted any contrasting (from white), including light green.

Throughout the various embodiments described in the parent cases, and in the present disclosure, the fold lines are preferably perforated to facilitate folding the various panels one way for filling out variable information on one side ("face", or "Side 1") of the original panel, the other way for filling out variable information on the other side ("back", or "Side 2") of the original panel, and to facilitate separating the various panels after they are completely filled out (i.e., on both sides).

As used herein, a sheet of paper has two sides, or surfaces—namely a front surface and a back surface. Similarly, the original and copy panels themselves have two surfaces—a front surface and a back surface.

Furthermore, throughout the various embodiments described in the parent cases and in the present disclosure, the side-by-side orientation of the original and copy panels (and intermediate transfer panel) with a vertical fold line is disclosed, as is an orientation wherein the original and copy panels are one above the other with a horizontal fold line.

Generally speaking, throughout the various embodiments described in the parent cases and in the present disclosure, the size of the panels is immaterial. However, most of the examples refer to a duplex (two-sided) form having panels measuring a conventional 8½ by 11 inches.

Throughout the descriptions in this application, cross-references are made to the disclosures of the copending applications, which are incorporated by reference as though fully set forth herein. These cross-references are intended to provide clarity to the descriptions of the improvements described herein, and are not intended to fully summarize the content of the disclosures of the copending applications.

According to the present invention, an "endorsable" carbonless CB coating is applied to substantially the entire original panel. The "endorsable" CB coating alleviates any pen-skipping problem.

Alternatively, the carbonless CB coating applied to the original panel is "photocopyable", or another off-the-shelf coating which is highly endorsable.

According to the present invention, the thicknesses (equivalent weights) of the CB and CF coatings are closely matched. Preferably, the equivalent weight of the CF coating is increased to nearly match that of the CB coating. This is particularly useful for roll stock, and for individual sheets stacked with the CB panels in register. In the case of dissimilar paper stock, the overall thicknesses of the (coated) paper stocks may be closely matched.

Alternatively, in a stack of unfolded, pre-treated sheets, the stack is "staggered". In other words, a first number of sheets, such as 250–1000 sheets, are stacked in register (CB to CB, CF to CF). A second number of sheets in the stack are reversed, so that their CB panels, while in register with one another, are in register with the CF panels of the first number of sheets. Similarly, the CF panels of the second stack, while in register with one another, are in register with the CB panels of the first number of sheets in the stack. This reverse stacking can be carried out with further numbers of sheets in the stack.

According to the present invention, the paper stock is highly opaque so that fixed and variable information on one side of the form is not noticeable from the other side of the form. Further, the paper stock is sufficiently dense (non-porous) that the CB dye released onto one side of the CF-coated copy panel (for revealing an image on that side) does not "bleed through" to the other side of the CF-coated copy panel (revealing a reverse image on the other side).

According to the present invention, although the original and copy panels are substantially fully coated and able to reproduce writing upon any area of either surface (face or back) of the original panel, specific areas for entering information on the front and back surfaces of the original panel are specified, and delineated such as by pre-printed borders. The areas for entering information on the front surface of the original panel are offset, front-to-back, from the areas for entering information on the back surface of the original panel. This ensures that an area of the CB coating on the front surface of the original panel which is written upon is not employed for carbonless reproduction when writing on the back surface of the original panel, and vice-versa.

According to the present invention, the offset of specific areas for entering information on the front and back of the original panel is manually checked. The checking technique involves creating (either by hand or computer-assisted) a "hard copy" artwork master (for the printing of fixed information and delineations of specific areas for entering information) for Side 1 (front) of the original panel, and superimposing thereupon hard copy of the artwork for Side 2 (back) of the original page. Superimposing Side 1 and Side 2 can be done in various ways, each of which involves printing on a reasonably transparent medium, such as acetate, or even photocopy paper. The artwork masters are then printed, such as by using a photocopier, onto acetate (or other reasonable transparent medium, with registration marks. The two acetates are then placed back-to-back and held up to the light to check for conflicts of areas for filling in information. If such conflicts exist, the specific areas for filling in information on either the front or back of the original panel must be moved to avoid such conflict.

According to the present invention, the form may be printed with "fixed" (pre-printed) information after it is carbonless coated, which is most applicable to "mill stock".

Alternatively, the form may be printed with fixed information prior to carbonless coating, which is most applicable to an on-press coating process, such as OPAS (trademark of Mead).

In either case (i.e., printing before or after coating), printing on both sides can be effected in one pass through a suitable printing press.

Alternatively, one side of the paper can be printed in a first pass on the printing press, and the other side can be printed on a subsequent pass through the press. (In an OPAS process, with multiple colors, it may be necessary to pass the paper stock through the printing press more than twice, to print the various colors and coat the various coatings thereon, if the number of printing/coating stations is limited.)

According to the present invention, the original panel is one color (preferably white), and the copy panel is tinted a dissimilar color, such as pink, canary, goldenrod, green or blue. The tint can be incorporated into the paper stock itself (such as it usually is, prior to coating, for mill stock), it can be applied as an ink, appropriately screened (when printing mill stock or when using an OPAS process), it can be applied as a tint, or it can be applied as a coloring in the CF coating deposited on the copy panel. In the case of an intermediate transfer panel, the intermediate transfer panel is preferably tinted a dissimilar color from either of the original and copy panels.

According to the present invention, in order to provide a visual cue as to the existence of the copy panel behind the original panel, either the copy panel is slightly larger, such as ⅛" to ½' wider than the original (e.g., the copy panel is between 8⅝" and 9" wide), or the original panel is slightly, such as ⅛" to ½" narrower than the copy panel. In either case, the copy panel has a "marginal strip", or "extension" that protrudes (e.g., widthwise) discernably beyond the original panel when the form is folded along the boundary.

According to a feature of the invention, in the narrow strip of the copy panel that protrudes beyond the original panel, instructions pertaining to the proper use of the form are preprinted. These instructions would contain text such as "YOUR COPY", and/or "FILL IN SIDE 1 OF THE ORIGINAL, RE-FOLD THE FORM, FILL IN SIDE 2 OF THE ORIGINAL".

According to a feature of the invention, a registration line is printed along the marginal strip in register with an outer edge of the original panel.

According to a feature of the invention, the registration line is perforated for removal of the marginal strip after both sides of the original panel are filled in and the original and copy panels are separated.

According to an additional feature of the present invention, a legend notifying the user that the copy panel is "Your Copy" is pre-printed in one or more areas on the front and back sides of the copy panel.

According to a feature of the invention, when the form is filled in with a computer printer, Side 1 of the original panel is filled in, the form is refolded to expose Side 2 of the original panel for entering (variable information) and the left margin offset is increased to compensate for the marginal strip.

According to the present invention, the original panel is coated on both sides with carbonless CF, the copy panel is coated on both sides with carbonless CF for reproducing information entered on the original panel, and a separate, intermediate transfer panel is coated on only one side with carbonless CB. The intermediate transfer panel is positioned between the original and copy panels so that information entered on one side of the original panel is reproduced on a side of the copy panel, and is positioned again between the re-folded original and copy panels so that information entered on the other side of the original panel is reproduced on the other side of the copy panel. The CF coating on the original panel is "superfluous", in the sense that it does not contribute to the carbonless reproduction of information entered on the original panel. Further, in contrast to some CB coatings, the CF coating is less apt to cause pen-skipping. In the context of the original and copy panels being formed from a single sheet, having an identical (CF) coating on the original and copy panels simplifies production of the paper stock. CF C2S (CF, Coated Two Sides) stock for other purposes is known, and the CB C1S (CB, Coated One Side) intermediate transfer panel is "off the shelf". It is not generally known to re-use a CB sheet, as they typically appear in manifolds for one-way reproduction.

Alternatively, the intermediate transfer sheet can be CFB coated front and back), coated on one surface with CF and coated on the other surface with CB. The CB surface must always be in contact with the copy panel to effect reproduction.

An advantage of this configuration is that the original and copy panels are identically coated, but only the copy panel reproduces, with the intermediate panel inserted. Hence, insofar as paper stock is concerned, it doesn't matter which panel is the original and which panel is the copy.

Further according to the invention, a portfolio-type folder is provided having two covers (sides). The sheet forming the original and copy panels is folded and stored on one side of the portfolio. The intermediate transfer sheets are stored on the other side of the portfolio.

A variant configuration is to have plain paper original and copy panels, preferably manufactured from a single folded sheet of plain paper. An intermediate carbon panel would be inserted therebetween to effect reproduction of information entered on both sides of the original panel onto both sides of the copy panel.

According to the present invention, paper stock for the original and copy panels are produced independently, and are joined using a variety of techniques into a single "virtual" sheet. The joining techniques are applicable to the various coating configurations discussed herein, as well as in the commonly-owned U.S. Patent Applications.

In some of the configurations, off-the shelf carbonless paper stock is advantageously employed.

According to the invention, in order to obtain various configurations of uncoated, CB-coated and CF-coated surfaces on the various panels of the form, off-the-shelf carbonless CB, CF, CFB and/or CF C2S stock is laminated to provide the appropriate coatings in the proper locations.

According to the present invention, elaborating on the disclosure of the above-referenced U.S. patent application Ser. No. 08/077,290, an oversize sheet of CFB, such as four times the width of the desired two panel form, is Z-folded and laminated to construct a two-sided self-replicating form having an original panel with CF on both sides and a copy panel with CB on both sides. To effect this result, a one end portion is folded over and laminated to a middle portion to form the original panel of the desired two-sided self-replicating form, with the CF-coated surface of the oversize sheet exposed on both sides of the original panel, and another end portion is folded over and laminated to another middle portion to form the copy panel of the desired two-sided self-replicating form, with the CB-coated surface of the oversize sheet exposed on both sides of the copy panel. The oversize sheet can be, for example, 10# stock. When laminated, the resulting two-sided self-replicating form will be essentially twice as thick, or 20#.

Preferably, according to a feature of the present invention, the adhesive used to laminate the oversize sheet is substantially opaque (e.g., a dense white or neutral color), to prevent writing on one side of the original panel from being readily discerned from the other side of the original panel. It is neither admitted nor denied that this feature (opacity of the adhesive) was disclosed in the above-referenced U.S. patent application Ser. No. 08/077,290. Further according to the invention, the thickness of the laminated article is in the range of 20–24# (pounds).

The various improvements set forth above, and described in greater detail below, can be combined in various ways to make the self-replicating form easier to use and more manufacturable.

Additionally, as set forth in the above-referenced commonly-owned U.S. patent application Ser. No. 08/126,538:

According to the invention, a first single sheet of paper is delineated to have a "first" original panel and a "second" copy panel. A second, similar sheet of paper is delineated to have a third copy panel and a fourth copy panel.

Both sheets are folded one way, and the second sheet is interposed ("nested") between the panels of the first sheet. The sheets are appropriately carbonless coated so that information entered on one surface of the first original panel is imaged onto a corresponding one surface of the underlying third copy panel, then onto a corresponding one surface of the next underlying fourth copy panel, then onto a corresponding one surface of the next underlying second copy panel.

Both sheets are re-folded, another way, and the second sheet is re-interposed between the panels of the first sheet. The sheets are appropriately carbonless coated so that information entered on the opposite surface of the first original panel is imaged onto a corresponding opposite surface of the underlying third copy panel, then onto a corresponding opposite surface of the next underlying fourth copy panel, then onto a corresponding opposite surface of the next underlying second copy panel.

In this manner, two two-panel sheets are employed, and three two-sided copies of a two-sided true-original are produced.

Embodiments using carbonless coatings covering substantially the entire surfaces of the panels ("fully-coated") and only selected areas of the panels ("patterned") are disclosed.

According to the invention, a first single sheet of paper is delineated to have a "first" panel and a "second" panel. A second, similar sheet of paper is delineated to have a "third" panel and a "fourth" panel.

Both sheets are folded, and the second sheet is interposed (nested) between the panels of the first sheet. The sheets are appropriately carbonless coated so that information entered on one surface of the uppermost first panel is imaged onto a corresponding one surface of the underlying third panel, then onto a corresponding one surface of the next underlying fourth panel, then onto a corresponding one surface of the next underlying second panel.

The sheets are repositioned as a whole (they are not re-folded), so that the opposite surface of the second panel is uppermost, and are appropriately carbonless coated so that information entered on the opposite surface of the second panel is imaged onto a corresponding opposite surface of the underlying fourth panel, then onto a corresponding opposite surface of the next underlying third panel, then onto a corresponding opposite surface of the next underlying first panel.

In this manner, two two-panel sheets are employed, and while none of the panels has original writing on both sides, four instances of a two-sided document are produced.

According to the invention, a single sheet of paper is delineated to have a "first" panel and a "second" panel.

The sheet is folded, and appropriately carbonless coated so that information entered on one surface of the uppermost first panel is imaged onto a corresponding one surface of the underlying second panel.

The sheet is repositioned as a whole (it is not re-folded), so that the opposite surface of the second panel is exposed for writing, and is appropriately carbonless coated so that information entered on the opposite surface of the second panel is imaged onto the corresponding opposite surface of the first panel.

In this manner, while none of the panels has original writing on both sides, two instances of a two-sided document are produced.

It has previously been disclosed that the copy panel can be coated with a "self-contained" ("SC") type carbonless coating, so that the original panel does not need to be carbonless coated.

According to the invention, a single sheet of paper is delineated into two panels, an original panel and a copy panel. The original panel is coated with a transfer-onto-plain-paper type carbonless coating (hereinafter "anti-SC" coating), and the copy panel is un-coated. In a case where the anti-SC coating is not endorsable, it is applied to the original panel in a patterned configuration (i.e., offset from front-to-back, so that writing areas are not coated).

In this manner, with the sheet folded one way, information entered on one surface of the original panel is imaged onto a corresponding one surface of the copy panel. With the sheet folded another opposite way, information entered on the opposite surface of the original panel is imaged onto a corresponding opposite surface of the copy panel.

According to the present invention, a single sheet of paper is delineated into an original and a copy panel. The original panel is un-coated, and the copy panel is provided with an image-receiving carbonless coating.

The sheet is folded one way, and a separate sheet of paper having an image-transferring carbonless coating is interposed between the original and copy panels so that information entered on one surface of the original panel is imaged onto a corresponding one surface of the copy panel.

The sheet is folded the other way, and the separate (or another separate) image-transferring sheet is re-inserted between the original and copy panels so that information entered onto the opposite surface of the original panel is imaged onto the corresponding opposite surface of the copy panel.

This particular embodiment of the invention resides in coating the copy panel with a carbonless coating (CF) that is capable of revealing an image in either of two colors (e.g., blue or black), and in selecting from two differently-coated image-transferring sheets that are coated with one of two image-transferring coatings (i.e., CB or CB') that will cause an image to reveal itself on the copy panel in a selected one of the two possible colors.

Alternatively, a single image-transferring sheet is employed, having a one color image-transferring coating (i.e., CB') on its one surface and another color image-transferring coating (i.e., CB) on its opposite surface.

According to the present invention, there are various form constructions and methods of use that were non-elected for one reason or another in various of the parent cases. They are represented herein, for further prosecution.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawings. Although the invention will be described in the context of these preferred embodiments, it should be understood that it is not intended to limit the spirit and scope of the invention to these particular embodiments.

The following FIGS. 7–11 are similar to FIGS. 1–5 of the aforementioned U.S. patent application Ser. No. 08/126,538.

Generally, throughout the descriptions that follow, a sheet of paper (#11) has a front surface (#12)and a back surface (#14) and is divided by a perforated fold line (#20) into two "panels"—an "original" panel (#16) for entering information on both sides thereof, and a "copy" panel (#18) for replicating information on both sides thereof. Each of the panels may be considered as having a "front" surface defined by the front surface of the sheet and a "back" surface defined by the back surface of the sheet. (In the numbering scheme throughout the figures, there is a general correspondence of the aforementioned numbers indicated by a "#" prefix, where "#" is the figure number.) Each of the panels has an "inner" edge along the fold line. Each of the panels may also be considered as having two surfaces, a "one" surface (designated by an "a" suffix) and an "opposite" surface (designated by a "b" suffix). However, it should be realized that a particular surface of the multi-panel sheet may comprise contiguous "a" and "b" surfaces of various panels.

In cases where separate original and copy panels are discussed, they may ultimately be joined into a "virtual" single sheet of paper. Similarly, in the laminated constructions discussed herein, various laminate panels are assembled into a single laminated sheet.

It should be understood that the concept of a single sheet of paper is not limited to single sheets, per se, but also includes paper produced on a roll which is typically cut into single sheets either before or after printing.

DETAILED DESCRIPTION OF THE INVENTION

Figure 1A:
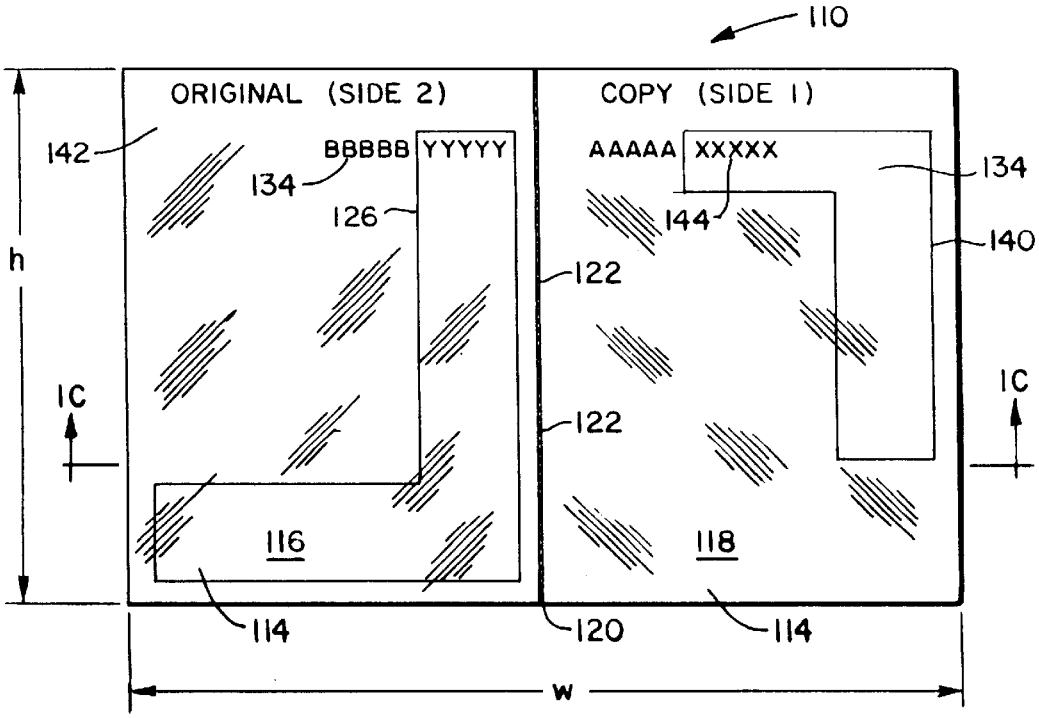
FIG. 1A is a top plan view of a self-replicating duplex form.
Figure 1B:
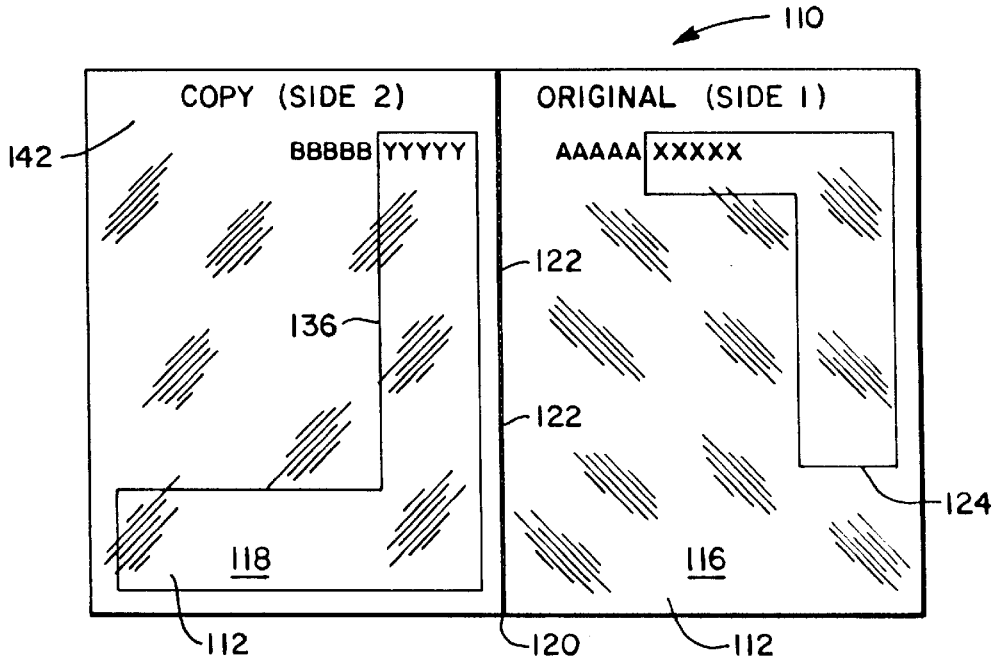
FIG. 1B is a bottom plan view of the form of FIG. 1A.
Figure 1C:
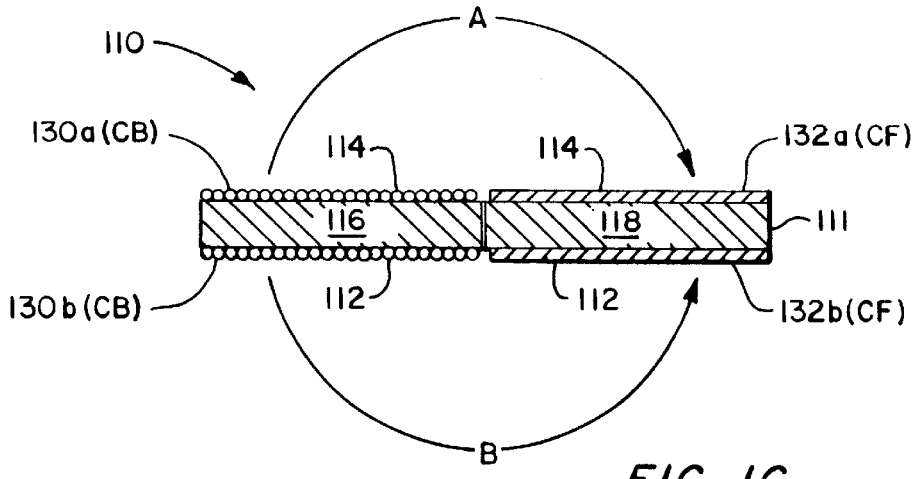
FIG. 1C is a cross-sectional view of the form of FIG. 1A.

FIGS. 1A–1C show a self-replicating form 110 comprising a single sheet of paper 111 having a front surface 112 and a back surface 114. The sheet is divided into an "original" panel 116 and a "copy" panel 118 by a fold line 120. The fold line is provided with a series of perforations 122 for folding and separating the two panels 116, 118. The sheet has a height (h) and a width (w), and the fold line bisects the width. In the case where the height and width are eleven inches and seventeen inches, respectively, the original and copy panels each measure 8½×11 inches, which is a common size for a form or other stationery article. The present invention is not limited to these dimensions, nor is it limited to a vertical fold line.

The following legends appear on the top of the panels, as an aid to following the description, but would not necessarily be printed on the form: "ORIGINAL (SIDE 1)" on the front surface 112 of the original panel 116; "ORIGINAL (SIDE 2)" on the back surface 114 of the original panel 116; "COPY (SIDE 1)" on the back surface 114 of the copy panel 118; and "COPY (SIDE 2)" on the front surface 112 of the copy panel 118.

A specific area 124 on the front surface 112 of the original panel 116 is designated for the user filling in (entering) first "variable" information (represented by "XXXXX"), such as with a pen or typewriter. The remaining area of the front surface 112 of the original panel 116 may be utilized for providing first pre-printed, "fixed" information (represented by "AAAAA") on the form 110.

A specific area 134 on the back surface 114 of the copy panel 118 is aligned with the area 124 on the front surface 112 of the original panel 116, when the form 110 is folded one way, as indicated by the arrow "A", and reproduces the variable information ("XXXXX") entered in the area 124 on the front surface 112 of the original panel 116.

A specific area 126 on the back surface 114 of the original panel 116 is designated for the user filling in (entering) second "variable" information (represented by "YYYYY"), such as with a pen or typewriter. The remaining area of the back surface 114 of the original panel 116 may be utilized for providing second pre-printed, "fixed" information (represented by "BBBBB") on the form 110.

A specific area 136 on the front surface 112 of the copy panel 118 is aligned with the area 126 on the back surface 114 of the original panel 116, when the form 110 is folded another, opposite way, as indicated by the arrow "B", and reproduces the variable information ("YYYYY") entered in the area 126 on the back surface 114 of the original panel 116.

The areas 124, 126, 134 and 136 can each comprise several non-contiguous areas. Only one area is shown for each, for illustrative clarity.

In order to effect reproduction of information entered on both sides of the original panel 116 onto both sides of the copy panel 118, the form is coated with carbonless coatings, as follows.

A carbonless CB treatment 130*a* is applied to substantially the entire back surface 114 of the original panel 112 for transferring an image of the first variable information ("XXXXX") entered on the front surface 112 of the original panel 116 onto the back surface 114 of the copy panel 118.

A carbonless CF treatment 132*a* is applied to substantially the entire back surface 114 of the copy panel 118 for revealing an image of the first variable information ("XXXXX") entered on the front surface 112 of the original panel 116.

A carbonless CB treatment 130*b* is applied to substantially the entire front surface 112 of the original panel 112 for transferring an image of the second variable information ("YYYYY") entered on the back surface 114 of the original panel 116 onto the front surface 112 of the copy panel 118. A carbonless CF treatment 132*b* is applied to substantially the entire front surface 112 of the copy panel 118 for revealing an image of the second variable information ("YYYYY") entered on the back surface 114 of the original panel 116.

In use, the panels are folded one way, as indicated by the arrow "A", to enter information on the front of the original panel, and are folded another way, as indicated by the arrow "B", to enter information on the back of the original panel. This information is reproduced on the back and front surfaces, respectively, of the copy panel, as explained above. The form is then unfolded and the panels are separated along the perforations 122 of the fold line 120.

In the aforementioned U.S. patent application Ser. No. 07/334,183, coating substantially the entire front and back surfaces of the original and copy panels with carbonless CB and CF treatments, respectively, was discussed. As noted in the aforementioned U.S. patent application Ser. No. 07/436,189, some CB coatings tend to clog the tips of ball point pens, thereby causing pen skipping (difficulty in entering information on a CB coated area of the original panel). The solution proposed in the aforementioned U.S. patent application Ser. No. 07/436,189 was applying the coatings only to specific, offset areas on the face (front) and back of the original panel (offset patterning of the CB coatings).

According to the present invention, the carbonless CB coating applied to the original panel is an "endorsable" coating which does not cause a pen to skip when written upon. Empirical testing by the applicants has shown that certain CB coatings, such as those described in U.S. Pat. Nos. 3,016,308 and 3,429,827 (assigned to Moore Business Forms) and "AQUEOUS OPAS" (under development by MEAD/OPAS) are highly "endorsable". Other off-the-shelf coatings have varying degrees of endorsability. The CF coating on the copy panel must be reactive with the selected CB coating.

The carbonless CB coating applied to the original panel may also be selected from a class of coatings that are "photocopyable". Applicants' tests of photocopyable CB coatings indicate that they exhibit a high degree of endorsability. In other words, they accept a substantial amount of writing without causing any pen skipping problem. Examples of photocopyable carbonless coatings are "RALLY" (available from Appleton Papers) and "TARTAN" (available from MEAD). Photocopyable carbonless paper is also available from Xerox Corp., and contains uniformly small CB microcapsules.

Testing by applicants has demonstrated that writing in a coated area one side of the original panel does not visibly affect the ability of that coated area to transfer an image when information is entered in a perfectly aligned area on the other side of the original panel. Nevertheless, the possibility exists in some applications, and using some types of carbonless coatings, that the "superfluous" release of dye from the written-upon CB coating will attenuate the ability of that CB coating to transfer an image, when writing from the other side of the form.

According to the present invention, although the original and copy panels are substantially fully coated (i.e., with endorsable CB) and able to reproduce variable information entered upon any area of either surface (face or back) of the original panel, advantageously specific areas 124 and 126 for entering information on the front and back surfaces, respectively, of the original panel 116 are specified, and delineated such as by pre-printed borders. The areas 124 for entering information on the front surface 112 of the original panel 116 are offset, front-to-back, from the areas 126 for entering information on the back surface 114 of the original panel 116. This ensures that an area of the CB coating on the front surface of the original panel which is written upon (i.e., the area 124) is not employed for carbonless reproduction when writing on the back surface of the original panel, and vice-versa.

Methods and apparatus for ensuring a front-to-back offset of areas for entering information on the front and back surfaces of the original panel are disclosed in the aforementioned U.S. patent application Ser. No. 07/494,565, and are incorporated by reference herein.

According to the present invention, the offset of specific areas for entering information on the front and back of the original panel is manually checked. The checking technique involves creating (either by hand or computer-assisted) a "hard copy" artwork master (for the printing of fixed information and delineations of specific areas for entering information) for Side 1 (front) of the original panel, and superimposing thereupon hard copy of the artwork for Side 2 (back) of the original page. Superimposing the artwork for Side 1 and Side 2 can be done in various ways, each of which involves printing on a reasonably transparent medium, such as acetate, or even photocopy paper. The artwork masters are then printed, such as by using a photocopier, onto acetate (or other reasonably transparent medium), preferably with registration marks. The two acetates are then placed back-to-back (with registration marks aligned) and viewed (such as by holding up to the light source) to check for "conflicts" (superposition) of areas for filling in information on the front (face) and back of the original panel. If such a conflict exists, the layout of either the front or back of the original panel must be modified to ensure that there is a front-to-back offset of all areas for filling in information.

Inasmuch as the invention described in the parent and present cases deals with the making of a two-sided copy of information entered on both sides of an original panel (e.g., form), it is desirable that information entered or reproduced on one side of the original and copy panel, respectively, does not show through when viewing the other side of the original and copy panel, respectively.

According to the present invention, the paper stock is highly opaque so that fixed and variable information on one side of the form is not readily perceived from the other side of the form. Further, the paper stock is sufficiently dense (non-porous) that the CB dye released onto one side of the CF-coated copy panel (for revealing an image on that side) does not "bleed through" to the other side of the CF-coated copy panel (revealing an undesirable "reverse image" on the other side). Preferably, the form is made from 20# (twenty pound) paper stock, such as "form bond".

In FIG. 1C, it appears that the CB and CF coatings are closely matched in thickness (although the drawings are merely illustrative, and exaggerated to aid in understanding the invention). In reality, in most carbonless coating processes, the CB coating tends to be measurably thicker than the CF coating. Typical equivalent weights for the CB coating are 1.5 pounds, and typical equivalent weights for the CF coating are 0.3 pounds. (As used herein, "equivalent weight" is an indicator of actual thickness.) Inasmuch as the original panel has two thicknesses of CB coating (one each on the front and back surfaces), and the copy panel has two thicknesses of CF coating (one each on the front and back surfaces), the original panel would normally be loaded with approximately 3.0 pounds of CB coating, and the copy panel would be loaded with 0.6 pounds of CF coating. In a stack of unfolded, carbonless-coated sheets (such as shown in FIGS. 1A and 1B), laid flat with the CB panels in register and the CF panels in register, eventually, if the stack was high enough, the different coating loading would become noticeable. Similarly, in a roll of carbonless-coated paper, a thickness difference would become evident, and the roll would tend to assume a conical profile. Such a thickness difference between the CB and CF coatings can possibly present a handling problem.

According to the present invention, the thicknesses (equivalent weights) of the CB and CF coatings are closely matched (as illustrated in FIG. 1C). Preferably, the equivalent weight of the CF coating is increased to nearly match that of the CB coating, rather than vice-versa. (A minimum CB thickness is required to maintain reproduction quality.) This is particularly useful for roll stock, and for individual sheets stacked with the CB panels in register.

Alternatively, when joining a CB-coated original panel to a CF-coated copy panel, as described hereinbelow, the paper stock thicknesses can be adjusted to provide an overall correspondence of thickness between the CB-coated original panel and the CF-coated copy panel, taking into account the thickness of the paper and any coatings thereon. This is also applicable in the case of an un-coated original panel, such as is discussed in the aforementioned U.S. patent application Ser. No. 484,686.

In either case, an additional benefit of the present invention is evident, in that CB-coated panels stacked in register (on unfolded sheets or separate panels) will not be in contact with CF-coated, dye-revealing panels. Contact of CB and CF surfaces presents problems of creating spurious images during storage and handling, which are discussed in U.S. Pat. No. 4,062,567 (Macaulay).

Alternatively, in a stack of unfolded, coated sheets having unequally weighted panels, the stack is "staggered". In other words, a first number of sheets, such as 250–1000 sheets, are stacked in register (CB to CB, CF to CF). A second number of sheets in the stack are reversed, so that their CB panels, while in register with one another, are in register with the CF panels of the first number of sheets. Similarly, the second number of CF panels, while in register with one another, are in register with the CB panels of the first number of sheets in the stack. This "reverse stacking" can be carried out with further numbers of sheets in the stack.

There are basically two techniques for coating paper stock for this invention—the paper can be coated with carbonless coatings at the paper mill, or it can be coated "on press", such as with OPAS (On Press Application System) coatings. With already coated mill stock, the paper is printed after being coated. With OPAS, the paper is usually printed immediately prior to being coated.

According to the present invention, the form 110 is printed with fixed information after carbonless coatings are applied thereto.

Alternatively, the form 110 is printed with fixed information prior to (or in connection with) carbonless coatings being applied thereto.

In either case, printing on both sides can be accomplished in a single pass through a suitable printing press. Alternatively, one side of the paper can be printed (and OPAS coated) in one pass on the printing press, and the other side can be printed on a subsequent pass through the press. Registration of the printed information from one side to the other side of the form is critical in either case, and in the case of two (or more) passes, a re-insertion press would be required.

As disclosed in the aforementioned U.S. patent application Ser. No. 07/334,183, the original panel is preferably white, and the copy panel is preferably tinted a dissimilar color, such as pink. With mill stock, the pink tint is usually in the paper stock itself. As disclosed in the aforementioned U.S. patent application Ser. No. 07/484,686, the intermediate transfer panel may be dissimilarly colored from either of the original or copy panels.

According to the present invention, the tint on the copy (or intermediate transfer) panel can be 1) incorporated in the paper stock itself, which is most appropriate for mill stock, and which is most applicable to the "joining" improvements described hereinbelow, 2) applied as an ink, appropriately screened, which is most appropriate for the single sheet embodiments of the present invention, 3) applied in a tinting process, or 4) it can be applied as a coloring in the carbonless coating deposited on the panel being tinted. The latter three techniques (2,3 and 4) are most applicable to OPAS processes.

As noted hereinbelow, the copy panel can be larger (wider) than the original panel.

Also, as noted below, an additional intermediate transfer sheet can be provided to eliminate the need for having carbonless CB coatings on the original panel.

Also, as noted below, the original and copy panels can be produced as separate sheets, to be joined later into a single "virtual" sheet, or can be produced as a laminated article.

As indicated by the arrow "A" in FIG. 1A, sheets, once printed with fixed information, are best provided to the user in a folded configuration, with the copy panel behind the original panel, and Side 1 of the original panel 116 exposed for entering information on the face 112 of the original panel 116. If the original and copy panels are of closely matched dimension (e.g., 8½"×11" each), it may not be immediately apparent to the end user that there are two panels in the folded form.

According to the present invention, in order to provide a visual cue as to the existence of the copy panel behind the original panel, the copy panel is larger than the original panel. In a side-by-side orientation of the original and copy panels, the copy panel would be wider than the original panel. This can be accomplished in one of two ways: either the copy panel is slightly, such as ⅛" to ½" wider than the original (i.e., the copy panel is between 8⅝" and 9" wide), or the original panel is slightly, such as ⅛" to ½" narrower than the copy panel. In either case, the copy panel has a "marginal strip", or "extension" that protrudes, widthwise, discernably beyond the original panel when the form is folded along the boundary (220). In cases where the copy and original panels are disposed one atop the other (as shown in FIGS. 1P and 1Q of the aforementioned U.S. patent application Ser. No. 07/436,189), the copy panel is advantageously longer than the original panel. Providing a wider copy panel is discussed hereinbelow.

Figure 2C:
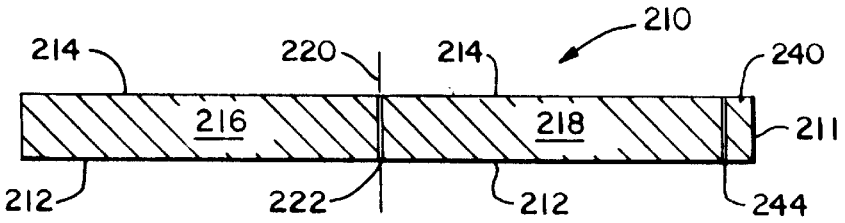
FIG. 2C is a cross-sectional view of the form of FIG. 2A.
Figure 2A:
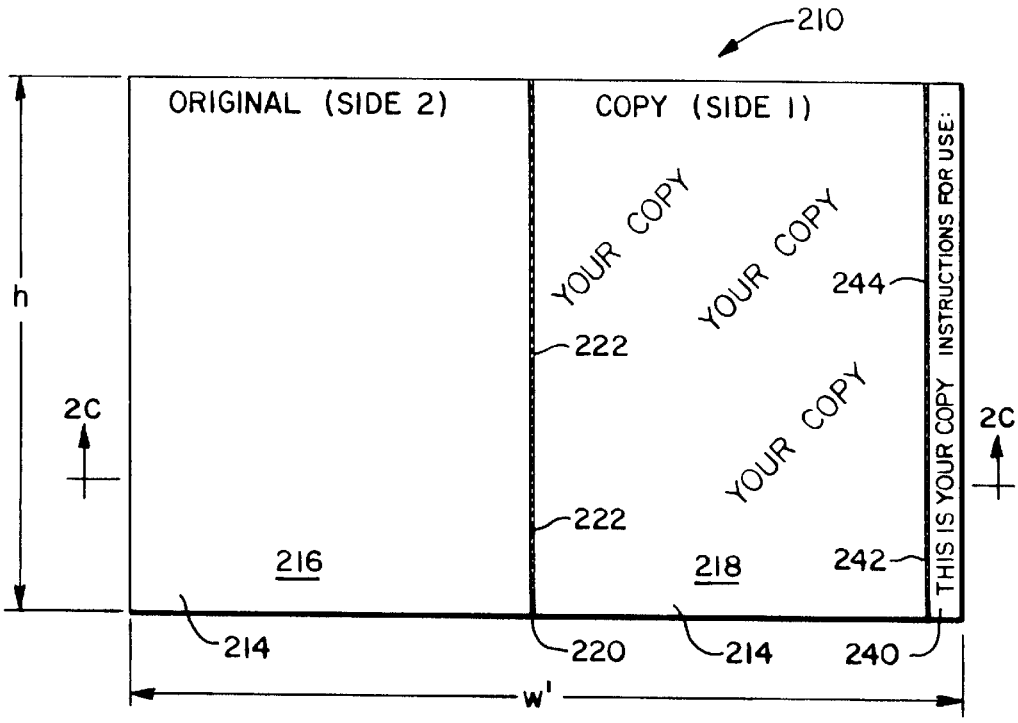
FIG. 2A is a top plan view of a self-replicating duplex form.
Figure 2B:
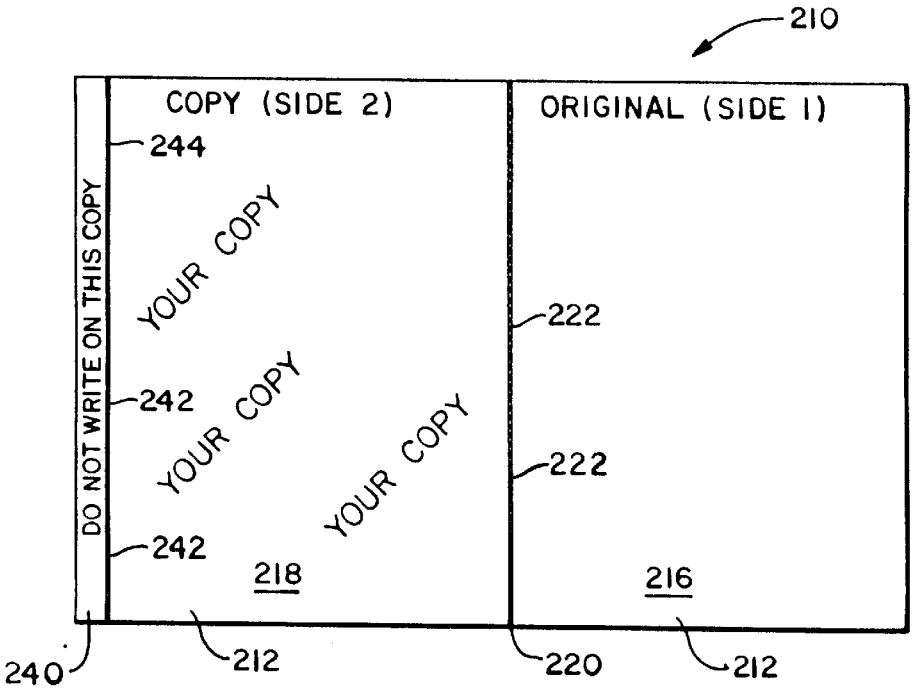
FIG. 2B is a bottom plan view of the form of FIG. 2A.

FIGS. 2A–2C show self-replicating form 210 comprising a single sheet of paper 211 having a front surface 212 and a back surface 214. The sheet is divided into an "original"

panel 216 and a "copy" panel 218 by a fold line 220. The fold line is provided with a series of perforations 222 for folding and separating the two panels 216, 218. The sheet has a height (h) and a width (w'), and, unlike the form 110, the fold line 220 does not "exactly" bisect the width. Rather, in the case where the height and width are eleven inches and 17½ inches, respectively, the original panel measures 8½ inches wide by 11 inches high, which is a common size for a form, and the copy panel measures 9 inches wide by 11 inches high. The present invention is not limited to these dimensions, nor to a vertical fold line. In FIGS. 2A, 2B and 2C, the form is shown without carbonless coatings and without specific areas for entering variable information delineated, for illustrative clarity, as well as to provide utility in descriptions of other coating configurations discussed herein.

Because the copy panel 218 is wider than the original panel 216, a marginal strip 240 along the outer edge of the copy panel is exposed when the form is folded (either way).

According to the invention, a "registration" line 242 may be printed at a position along the edge of the copy panel, in register with the outer edge of the original panel (when the form is folded), e.g. at 8½ inches from the fold 420.

Further, whether or not the registration line 242 is actually printed, a line of perforations 244 may be disposed along that line. In this manner, once the form is completely filled in on both sides, the marginal strip 420 can easily be removed, thereby providing original and copy panels of the same dimension (e.g., 8½ inches wide).

According to a feature of the invention, in the marginal strip 240 of the copy panel 218 that protrudes beyond the original panel 216 (when folded), instructions pertaining to the proper use of the form are pre-printed (as "fixed" information). These instructions would contain text such as "THIS IS YOUR COPY INSTRUCTIONS FOR USE:", which would be visible on the back surface 214 of the copy panel 218 when the form is folded one way for entering information on the face 212 of the original panel 216, and "DO NOT WRITE ON THIS COPY", which would be visible on the front surface 212 of the copy panel 218 when the form is folded the other way for entering information on the back 214 of the original panel 216.

According to an additional feature of the present invention, further "cues" are provided to the user to indicate that the copy panel is for reproducing information, not for entering it. These could include legends such as "YOUR COPY" pre-printed as fixed information in a "random repeat" pattern across the front and back surfaces of the copy panel (generally exclusive of the area defined by the marginal strip). Preferably, these legends are "screened" (printed in a dot pattern having 5–20% density) so they won't obscure other information on the form.

These various cues, that the original panel is for entering variable information (i.e., filling in the form) and that the copy panel should not be written upon, including tinting the copy panel, providing a marginal strip on the copy panel extending beyond the edge of the original panel when the form is folded (either way), providing legends in the marginal strip (and instructions for use of the form), and providing legends on the front and back surfaces of the copy panel, should ensure that the form is properly utilized.

Although many duplex forms are filled in by hand, variable information may be entered with a typewriter or computer printer. When filling out Side 1, the fold (220; i.e., the inner edges of the original and copy panels) is to the left of the form, and can be aligned against the left margin "stop" of a typewriter or printer. When the form is re-folded to enter information on Side 2 of the original panel, the fold (220) is to the right, and the marginal strip (240; e.g., outer edge of the copy panel) is to the left. With the extreme outward edge of the copy panel abutting the left margin stop of the typewriter or printer, this will cause a rightward shift of the form, equivalent to the width of the marginal strip. When using a typewriter, this would not present much of a problem. However, when using a computer printer, spaces for filling in information on the back of the original panel would be shifted ½ inch to the right of where they otherwise (without the marginal strip) are supposed to be. (This would not be a problem if the marginal strip were removed prior to printing on Side 2.)

According to the invention, when the form 210 is filled in with a computer printer, printing on the back (Side 2) of the original panel is caused to shift to the right an amount equivalent to the width of the marginal strip 240 (e.g., ½ inch) to ensure proper registration of variable information being entered with the space (e.g., 126, 136 of FIGS. 1A and 1B) where it is supposed to be entered (and reproduced).

As noted above, the equivalent weights of the original and copy panels can be made equal.

Also, as noted below, an additional intermediate transfer sheet can be provided to eliminate the need for having carbonless CB coatings on the original panel.

Also, as noted below, the original and copy panels can be produced as separate sheets, to be joined later into a single "virtual" sheet, or can be produced as a laminated article.

Figure 4C:
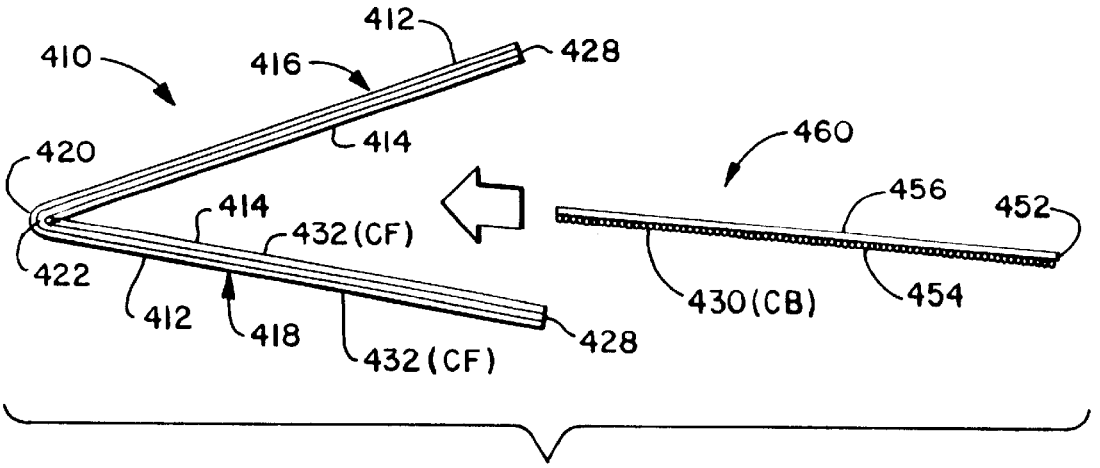
FIG. 4C is a cross-sectional view of the self-replicating form of FIG. 4A.
Figure 4A:
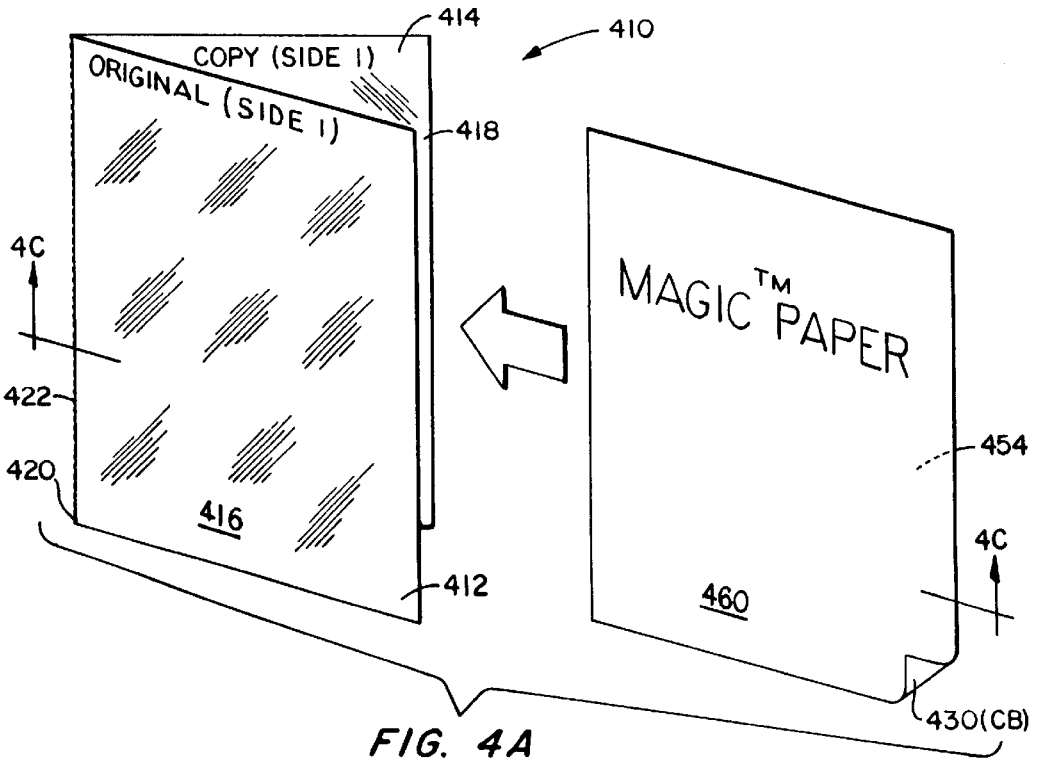
FIG. 4A is a perspective view of a self-replicating duplex form, partially folded one way.
Figure 4B:
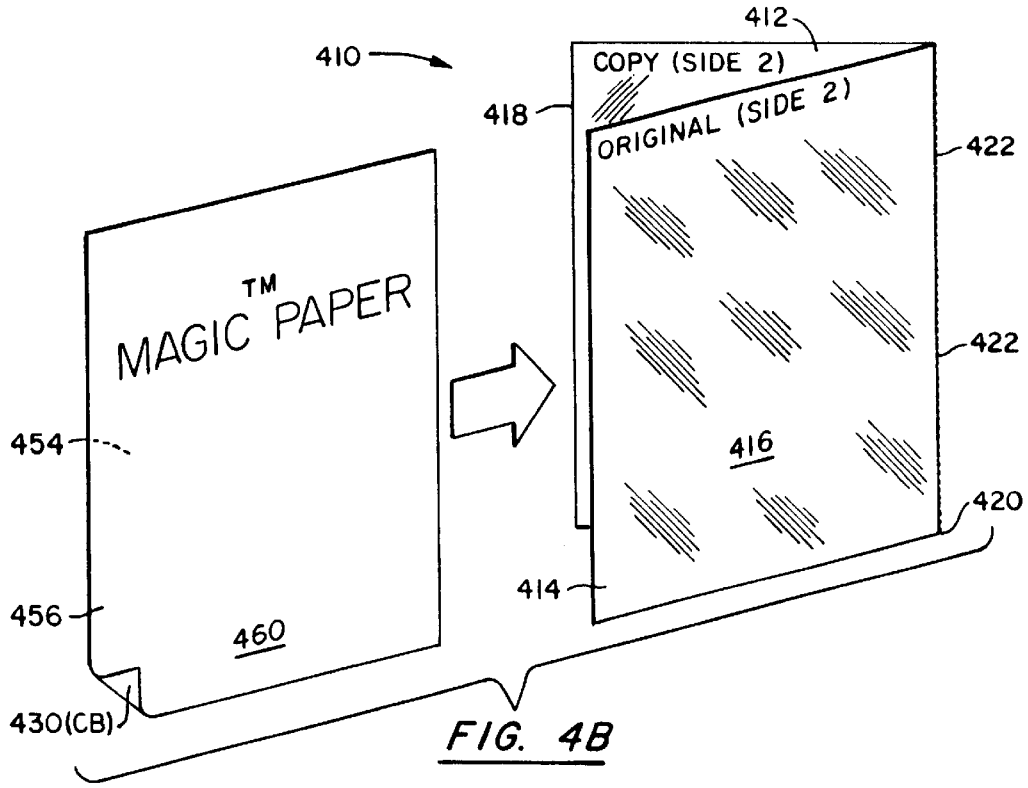
FIG. 4B is a perspective view of the self-replicating form of FIG. 4A, folded another way.

FIGS. 4A–4C show a form 410 comprising a single folded sheet 411 of paper, having a front surface 412 and a back surface 414.

The sheet is divided into an "original" panel 416 and a "copy" panel 418 by a fold line 420. The fold line is provided with a series of perforations 422 for folding and separating the two panels 416, 418. The sheet has a height and a width. The fold line 420 may bisect the width, as in FIGS. 1A–1C, so that the original and copy panels are both 8½×11 inches. Preferably, the sheet is wider and the copy panel is provided with a marginal extension (240), as shown in FIGS. 2A–2C, so that the original panel is 8½×11 inches and the copy is wider (e.g. 9×11 inches). The present invention is not limited to these dimensions, nor to a vertical fold line.

In marked contrast to the tendency of CB coatings causing pen-skipping, it is noted that CF coatings tend not to interfere with writing, such as with a ball point pen.

According to the present invention, the original panel is coated with both sides with carbonless CF 432, the copy panel is coated on both sides with carbonless CF for reproducing information entered on the original panel, and a separate, intermediate transfer panel 460 is coated on only side with carbonless CB 430. As in the aforementioned U.S. patent application Ser. No. 07/484,686, the intermediate transfer panel is positioned between the original and copy panels so that information entered on one side of the original panel is reproduced on a side of the copy panel, and is re-positioned between the refolded original and copy panels so that information entered on the other side of the original is reproduced on the other side of the copy panel. The CF coating on the original panel is "superfluous", in the sense that it does not contribute to the carbonless reproduction of information entered on the original panel. However, in the context of the original and copy panels being formed from a single sheet, having an identical (CF) coating on the original panel simplifies production of the paper stock.

Alternatively, the intermediate transfer sheet can be CFB coated front and back), coated on one surface with CF and coated on the other surface with CB. The CB surf ace must always be in contact with the copy panel to effect reproduction.

An advantage of this configuration is that the original and copy panels are identically coated, but only the copy panel reproduces, with the intermediate panel inserted. Hence, insofar as paper stock is concerned, it doesn't matter which panel is the original and which panel is the copy.

A variant configuration is to have plain paper original and copy panels, preferably manufactured from a single folded sheet of plain paper. An intermediate carbon panel would be inserted therebetween to effect reproduction of information entered on both sides of the original panel onto both sides of the copy panel.

Figure 5:
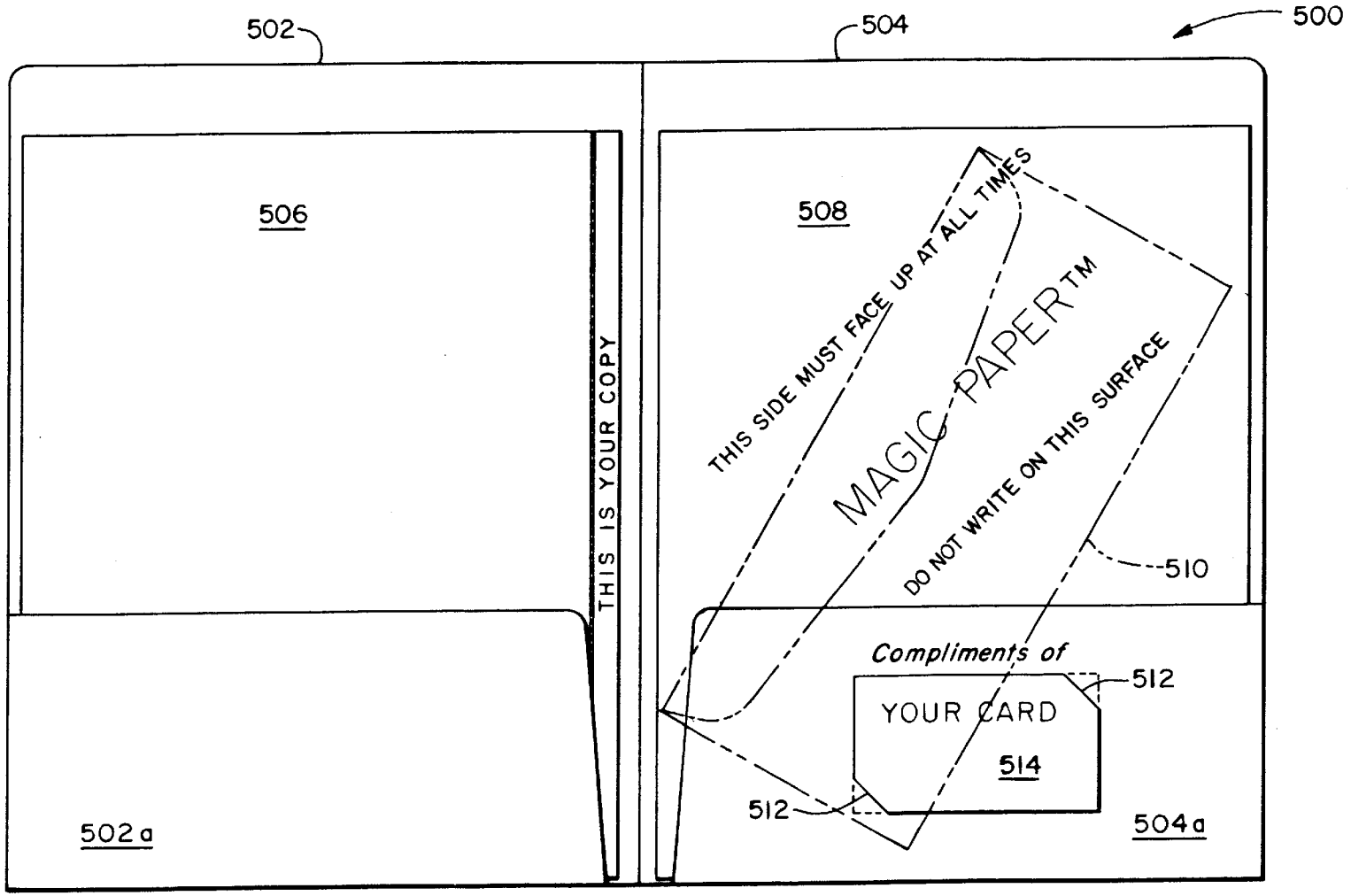
FIG. 5 is a plan view of a portfolio for containing a stationary articles manufactured according to the present invention.

FIG. 5 shows a presentation folder 500 having a front cover 502 and a back cover 504. Each of the front and back covers is provided with a flap 502*a* and 504*a*, respectively, for holding stationery articles. In this example, the front cover holds a stationery article 506, such as the several of the folded panels 416 and 418 of FIG. 4A, and the back cover holds a stationery article 508 such as the intermediate transfer sheet 460 of FIG. 4A. Additionally, envelopes 510 are suitably stored in the back cover with the stationery articles 508. Additionally, the back flap 504*a* is provided with two spaced-apart slits 512 for holding another stationery article, such as a business card 514. The presentation folder 500 is useful for the form of FIG. 4A, as well as for the form disclosed in the aforementioned U.S. patent application Ser. No. 07/484,686 (plain paper original, CF-coated copy), or for other form configurations disclosed in this or the parent cases.

As noted above, the equivalent weights of the original and copy panels can be made equal.

Also, as noted above, the copy panel can be larger (e.g., wider) than the original panel.

Also, as noted below, the original and copy panels can be produced as separate sheets, to be joined later into a single "virtual" sheet, or can be produced as a laminated article.

As disclosed in the aforementioned U.S. patent application Ser. No. 07/436,189, the form (e.g., the form 110 of FIG. 1A) can be provided as a single sheet of paper, or as two separate sheets (panels) in a "set"). Generally, constructing the two-sided, self-replicating carbonless form of this invention from a single sheet of paper, or from a fabricating that functions as a single sheet of paper is preferred.

According to the present invention, two separate panels are produced, for example one having a CB coating on both sides and forming the original panel, the other having a CF coating on both sides and forming the copy panel. The original and copy panels are joined at their inner edges using a variety of techniques disclosed herein to form a "virtual" single sheet. In this manner, paper stocks for the original and copy panels can be produced separately, thereby simplifying manufacture thereof, especially for mill stock.

It should be noted that the original panel can be uncoated, as described in the aforementioned U.S. patent application Ser. No. 484,686, in which case it would be joined to a CF-coated copy panel.

It should also be noted that the original panel can be CF-coated, as described above.

FIGS. 3A–3H show various techniques of joining individual original and copy panels 316 and 318 into a single, "virtual" sheet 310 having a front surface 312 and a back surface 314. This technique would be especially useful for manufacturers who lack the capability of coating each side of the sheet (e.g., the sheet 110 of FIG. 1A) with both carbonless CB and CF coatings, in that a CB-coated original panel can be joined to a CF coated copy panel. This is relevant whether the panels are substantially fully coated (as shown in FIGS. 1A–1C, and as disclosed in the aforementioned U.S. patent application Ser. No. 07/334,183), or have coatings applied only to specific areas (as disclosed in the aforementioned U.S. patent application Ser. Nos. 07/436,189 and 07/494,565), or in the case of a non-coated original panel and CF-coated copy panel (as disclosed in the aforementioned U.S. patent application Ser. No. 07/484,686). Throughout FIGS. 3A–3H, an original panel and a copy panel are joined at or near what will ultimately be the fold line (e.g., the perforated fold line 120 of FIG. 1A) of the virtual sheet.

Figure 3A:
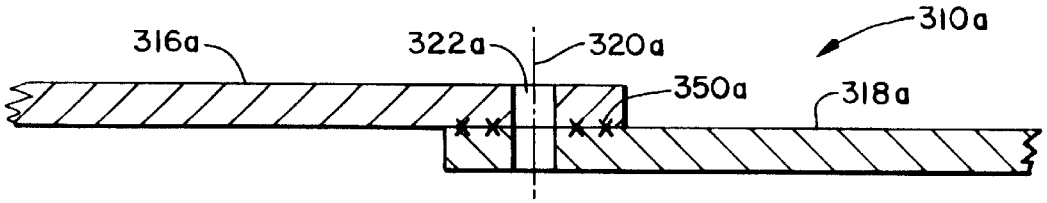
FIG. 3A is a cross-sectional view of a self-replicating duplex form, showing an embodiment of a technique for joining two panels into a "virtual" sheet.

FIG. 3A shows a first technique for joining an original panel 316*a* and a copy panel 318*a* into a single, virtual sheet 310*a*. In this embodiment, inner edges of the original and copy panels 316*a* and 318*a*, respectively, are simply overlapped, for instance by one-quarter inch, at what will ultimately be the fold line 320*a* (corresponding to the fold line 120 of FIG. 1A), and are glued with together with an adhesive 350*a*. A line of perforations 322*a* (corresponding to the perforations 122 of FIG. 1A) are provided through the overlapping inner edges of the original and copy panels, at the fold line 320*a*.

Figure 3B:
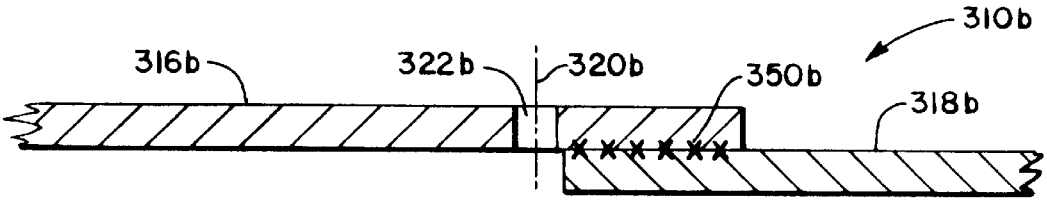
FIG. 3B is a cross-sectional view of a self-replicating duplex form, showing an alternate embodiment of a technique for joining two panels into a "virtual" sheet.

FIG. 3B shows an alternate technique for joining the original and the copy panels, 316*b* and 318*b*, into a single virtual sheet 310*b*. In this embodiment, again the inner edges of the original and copy panels 316*b* and 318*b*, respectively, are overlapped, for instance by one-quarter inch, near what will ultimately be the fold line 320*b* (corresponding to the fold line 120 of FIG. 1A), and are glued with together with an adhesive 350*b*. A line of perforations 322*b* (corresponding to the perforations 122 of FIG. 1A) is provided through the inner edge of the original panel, off to one side of the fold line 320*b*, more particularly, near the inner edge of the original panel 316*b*, adjacent the overlap. In this manner, the overlapping inner edges of the original and copy panels are separated from the original panel, and are "carried" with the copy panel.

Figure 3C:
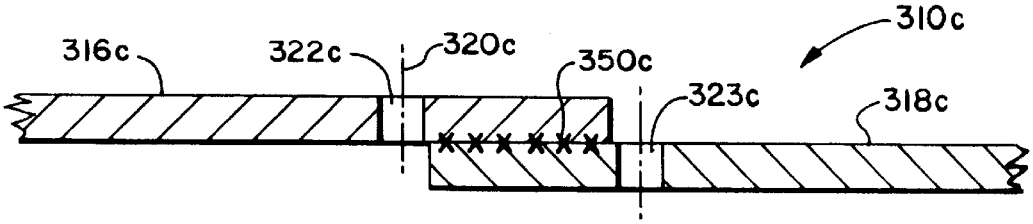
FIG. 3C is a cross-sectional view of a self-replicating duplex form, showing an alternate embodiment of a technique for joining two panels into a "virtual" sheet.

FIG. 3C shows an alternate technique for joining the original and the copy panels, 316*c* and 318*c*, into a single virtual sheet 310*c*. In this embodiment, again the inner edges of the original and copy panels 316*c* and 318*c*, respectively, are overlapped, for instance by one-quarter inch, at what will ultimately be the fold line 320*c* (corresponding to the fold line 120 of FIG. 1A),and are glued with together with an adhesive 350*c*. Two lines of perforations 322*c* and 323*c* are provided through the inner edges of the original and copy panels, off to either side of the fold line 320*c*, more particularly, near the inner edges of the original and copy panels, adjacent the overlap. In this manner, the overlapping inner edges of the original and copy panels may ultimately be separated from both the original and copy panels, and may be discarded as waste.

Figure 3D:
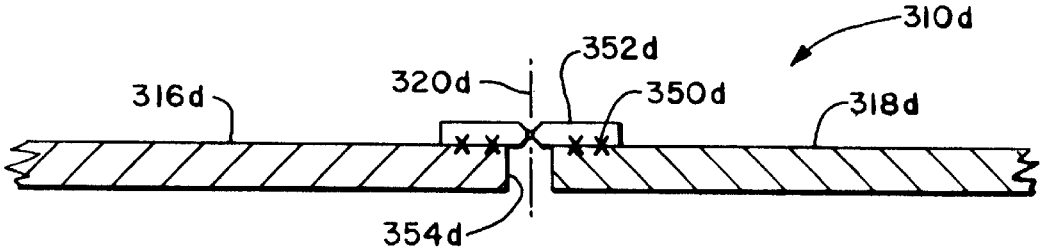
FIG. 3D is a cross-sectional view of a self-replicating duplex form, showing an alternate embodiment of a technique for joining two panels into a "virtual" sheet.

FIG. 3D shows an alternate technique for joining the original and the copy panels, 316*d* and 318*d*, into a single virtual sheet 310*d*. In this embodiment, the inner edges of the original and copy panels 316*d* and 318*d*, respectively, are abutted, or nearly abutted, there being a small gap 354*d* (0.0–0.125 inches) therebetween, at what will ultimately be the fold line 320*d* (corresponding to the fold line 120 of FIG. 1A). A narrow (e.g., one-eighth to one-half inch wide) tape 352*d* is laid along the fold line 320*d*, "bridging" the gap between the inner edges of the original and copy panels, and is secured to the inner edges of the original and copy panels with an adhesive 350*d*. As shown, the tape is "necked down" in thickness along the fold line 320*d*, to form a "living hinge" to facilitate folding the form (as discussed hereinabove) and to facilitate separating the original from the copy panel (after completely filling in the variable information on the form) along the fold line 320*d*. The tape 352*d* may be a paper or plastic tape, and in either case should be very thin so that it does not contribute significantly to the thickness of the sheet 310*d*.

Figure 3E:
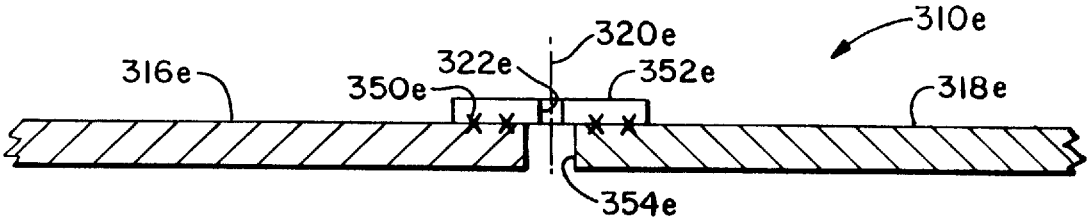
FIG. 3E is a cross-sectional view of a self-replicating duplex form, showing an alternate embodiment of a technique for joining two panels into a "virtual" sheet.

FIG. 3E shows an alternate technique for joining the original and the copy panels, 316*e* and 318*e*, into a single virtual sheet 310*e*. In this embodiment, again the inner edges of the original and copy panels 316*e* and 318*e*, respectively, are abutted, or nearly abutted, there being a small gap (0.0–0.125 inches) therebetween, at what will ultimately be the fold line 320*e* (corresponding to the fold line 120 of FIG. 1A). Again, a narrow (one-eighth to one-quarter inch wide) tape 352*e* is laid along the fold line 320*e*, "bridging" the gap 354*e* between the inner edges of the original and copy panels, and is secured to the inner edges of the original and copy panels with an adhesive 350*e*. As shown, the tape is provided with perforations 322*e* (corresponding to the perforations 122 of FIG. 1A) along the fold line 320*e*, to form a "living hinge" to facilitate folding the form (as discussed hereinabove) and to facilitate separating the original from the copy panel (after completely filling in the variable information on the form) along the fold line 320*e*. The tape 352*e* may be a paper or plastic tape, and in either case should be very thin so that it does not contribute significantly to the thickness of the sheet 310*e*.

Figure 3F:
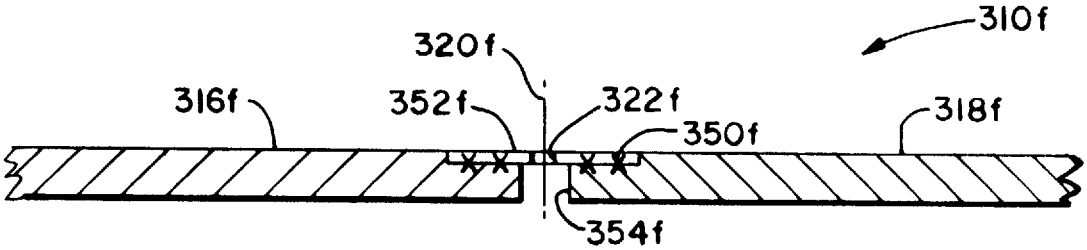
FIG. 3F is a cross-sectional view of a self-replicating duplex form, showing an alternate embodiment of a technique for joining two panels into a "virtual" sheet.

FIG. 3F shows an alternate technique for joining the original and the copy panels, 316*f* and 318*f*, into a single virtual sheet 310*f*. In this embodiment, again the inner edges of the original and copy panels 316*f* and 318*f*, respectively, are abutted, or nearly abutted, there being a small gap 354*f* (0.0–0.125 inches) therebetween, at what will ultimately be the fold line 320*f* (corresponding to the fold line 120 of FIG. 1A). Again, a narrow (one-eighth to one-quarter inch wide) tape 352*f* is laid along the fold line 320*f*, "bridging" the gap between the inner edges of the original and copy panels, and is secured to the inner edges of the original and copy panels with an adhesive 350*f*. As shown, the tape is provided with perforations 322*f* (corresponding to the perforations 122 of FIG. 1A) along the fold line 320*f*, to form a "living hinge" to facilitate folding the form (as discussed hereinabove) and to facilitate separating the original from the copy panel (after completely filling in the variable information on the form) along the fold line 320*e*. The tape 352*f* may be a paper or plastic tape, and in either case should be very thin so that it does not contribute significantly to the thickness of the sheet 310*f*. As illustrated in FIG. 3F, the tape 352*f* is extremely thin, such as on the order of 0.1–0.5 mil, and is preferably pressed into the structure of the original and copy panels so that it does not add to their thickness at all. A suitable tape for this application is a mylar reinforcement tape available from Hammermill Papers (Flat-Stak™).

Figure 3G:
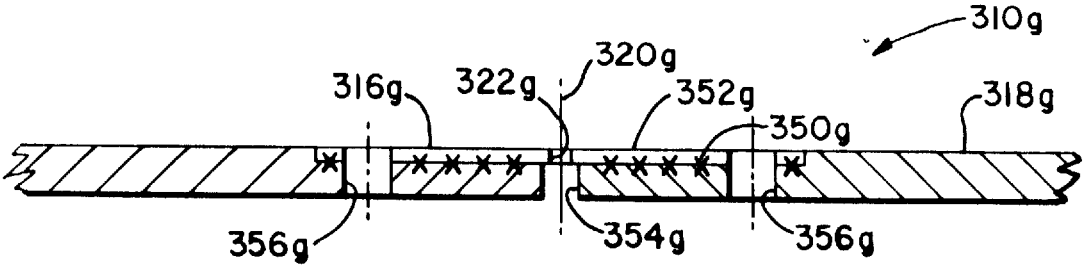
FIG. 3G is a cross-sectional view of a self-replicating duplex form, folded one way, showing an alternate embodiment of a technique for joining two panels into a "virtual" sheet.

FIG. 3G shows a technique for joining the original and copy panels 316*g* and 318*g* into a single virtual sheet 310, and is similar in many respects to the technique discussed with respect to FIG. 3F. In this case, however, the tape 352*g* is wider (e.g., one inch wide), and is provided with holes 356*g* for locating the original and/or copy panels in a three-ring binder, or the like. To this end, holes 356*g* in the copy panel 318*g* are provided through an outer portion of the tape 352*g* as well as through the copy panel 318*g*, at an appropriate distance from the fold line 320*g* that the copy panel 318*g* can be mounted in a binder (not shown), or in a file folder with two-prong fasteners (not shown). Similarly, holes 356*g* in the original panel 316*g* are provided through an outer portion of the tape 352*g* as well as through the original panel 316*g*, at an appropriate distance from the fold line 320*g* that the original panel 316*g* can be mounted in a binder or file folder. Referring to FIGS. 1A and 1B, it is seen that the "left" edges of "Sides 1" of both the original and copy panels are disposed at the fold line. The holes 356*g* are preferably formed in the tape and the original with the form already folded (i.e., after pre-printing and after filling out). This technique is especially appropriate for retaining the original and/or copy panels in a three-ring binder. Should it be desired that only the copy panel is punched with holes 356*g* for retention in a binder or the like, the holes 356*g* would need to be formed with the form unfolded. Also, by providing the wider tape configuration shown in FIG. 3G, without the holes 356*g* already punched therein, this provides the end user with the option of punching holes as desired, through the tape which will act as a reinforcement for the panel in a binder. The reinforcement feature is especially important, for instance, in the case of a lightweight panel, such as a 10–12# copy panel.

Figure 3H:
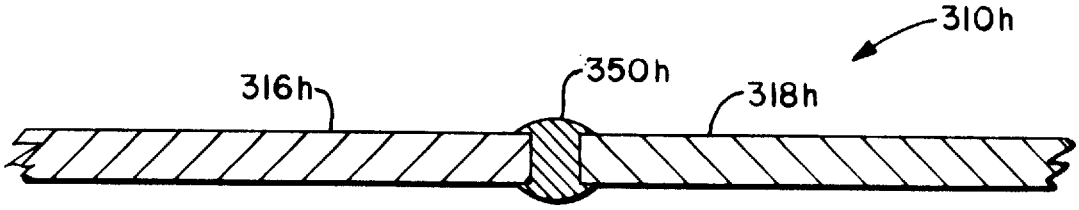
FIG. 3H is a cross-sectional view of the self-replicating duplex form of FIG. 3G, folded another way.

FIG. 3H shows an alternate technique for joining the original and the copy panels, 316*h* and 318*h*, into a single virtual sheet 310*h*. In this embodiment, again the inner edges of the original and copy panels 316*h* and 318*h*, respectively, are abutted, or nearly abutted, there being a small gap (0.0–0.125 inches) therebetween, at what will ultimately be the fold line 320*h* (corresponding to the fold line 120 of FIG. 1A). A narrow "bead" of adhesive 350*h* is laid along the fold line 320*h*, "bridging" the gap between the inner edges of the original and copy panels. As shown, the bead 350*h* does not need to be provided with perforations, as it will act as a "living hinge" to facilitate folding the form (as discussed hereinabove) and to facilitate separating the original from the copy panel (after completely filling in the variable information on the form) along the fold line 320*h*. As with the tape embodiments, the adhesive should be very thin so that it does not add significantly to the thickness of the sheet 310*h*. A suitable adhesive for this application is any of a number of "padding" adhesives such as are commonly used by forms manufacturers.

As noted above, the equivalent weights of the original and copy panels can be made equal. More significantly, however, the "base" paper stocks for the original and copy panels, and their total coated thicknesses, can be completely dissimilar. For instance, in a case where it is desirable to have an uncoated, high rag content or acid-free original panel, such a panel can be joined with a CF-coated copy panel. (An embodiment with an uncoated original panel, a CF-coated copy panel and a CB-coated intermediate transfer panel is disclosed in the aforementioned U.S. patent application Ser. No. 484,686.)

Also, as noted above, the copy panel can be advantageously larger than the original panel.

Also, as noted above, an additional intermediate transfer sheet can be provided to eliminate the need for having carbonless CB coatings on the original panel.

It was discussed, hereinabove, how two panels of paper can be joined into a single "virtual" sheet. Such a technique is useful, for instance, for manufacturers who lack capability of producing a single sheet with the various coating configurations discussed herein and in the aforementioned patent applications.

FIGS. 6A–6J show various techniques for manufacturing a self-replicating duplex form (or stationary article) as a laminated structure. The views are "exploded", and cross-section lines are omitted from the paper stock. CB coatings are shown as circles, and CF coatings are shown as cross-section lines. Throughout the figures, individual laminates are laid together to form various original and copy panels, in a single "virtual" sheet. Where trim lines ("A" and "B" are shown, the original panel 616*x* extends from the trim line "A" to the fold line 620*x*, and the copy panel 618*x* extends from the fold line to the trim line "B". ("x" is the figure suffix "a" through "j".) AS will be evident, while trim lines are shown, the paper need not be trimmed.

In the case of an original panel coated on both sides with carbonless CB and a copy panel coated on both sides with carbonless CF, in a "true" single sheet configuration, as disclosed for instance in the aforementioned U.S. patent application Ser. No. 07/334,183, it would be necessary to coat both sides of the sheet with both CB and CF coatings. This would require manufacturing capability which may be beyond the reach of some carbonless paper manufacturers. The techniques described below make producing forms with the various coating arrangements discussed herein and hereinbefore in the aforementioned U.S. Patent Applications available to virtually every manufacturer or print shop.

Figure 6A:
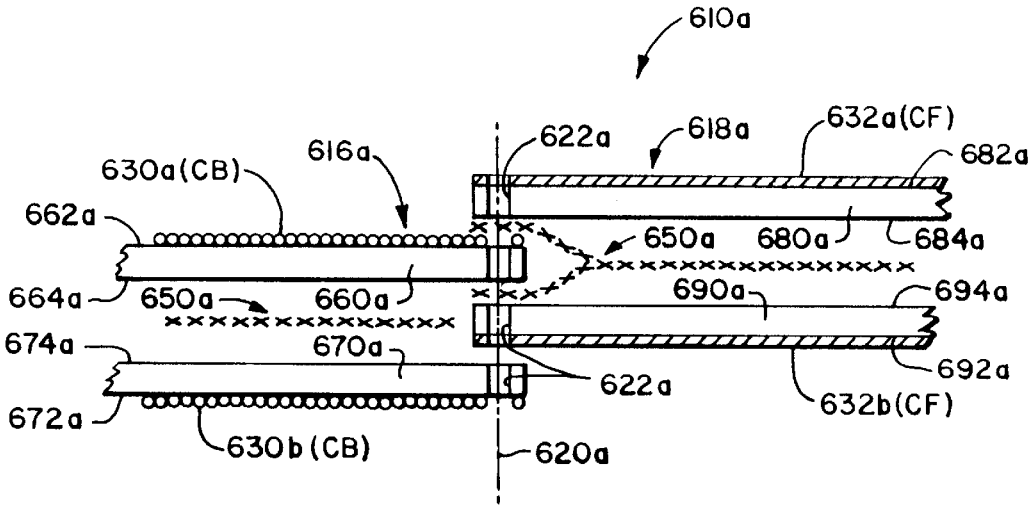
FIG. 6A is a cross-sectional view of a self-replicating duplex form, showing an embodiment of a technique for laminating two panels into a "virtual" sheet.

FIG. 6A shows (exploded view) a technique for manufacturing separate panels of readily-available carbonless paper stock into a single "virtual" sheet 610*a*. In this case, the original panel 616*a* is formed to two panels ("laminates") of carbonless CB paper stock (each coated on only one side with carbonless CB) and two panels of carbonless CF paper stock (each coated on only one side with carbonless CF), as follows.

A panel (laminate) 660*a* of carbonless CB paper stock has a coating 630*a* of carbonless CB on one of its surfaces 662*a* and is uncoated (i.e., does not have a carbonless coating) on its opposite surface 664*a*. Similarly, a panel (laminate) 670*a* of carbonless CB paper stock is coated on one of its surfaces 672*a* with carbonless CB 630*b*, and its opposite surface 674*a* is not coated. A layer of adhesive 650*a* is applied between the uncoated surfaces 664*a* and 674*a* of the panels 660*a* and 670*a*, respectively, to form a laminated structure for the original panel 616*a* which is coated on both sides with carbonless CB.

A panel (laminate) 680*a* of carbonless CF paper stock has a coating 632*a* of carbonless CF on one of its surfaces 682*a* and is uncoated (i.e., does not have a carbonless coating) on its opposite surface 684*a*. Similarly, a panel (laminate) 690*a* of carbonless CF paper stock is coated on one of its surfaces 692*a* with carbonless CF 632*b*, and its opposite surface 694*a* is not coated. A layer of adhesive 650*a* is applied between the uncoated surfaces 684*a* and 694*a* of the panels 680*a* and 690*a*, respectively, to form a laminated structure for the copy panel 618*a* which is coated on both sides with carbonless CF.

As shown, the inner edges of the panels 660*a*, 670*a*, 680*a* and 690*a* can be interleaved and overlapped, in a manner similar to that shown with respect to FIG. 3A, and perforated with perforations 622*a* along a fold line 620*a* distinguishing the original panel 616*a* from the copy panel 618*a*.

Alternatively, the inner edges of the two CF panels 680*a* and 690*a* can be laminated and sandwiched between (not shown), rather than interleaved with (as shown) the two CB panels 660*a* and 670*a*. This would resemble the next configuration discussed with respect to FIG. 6B.

In the various laminating techniques disclosed wherein the inner edges of the original and copy panels are overlapped (e.g., FIGS. 6A, 6B, 6C, 6D and 6F), the fold line 620 and perforations 622 can advantageously be located off to one side of the overlapping inner edges of the original and copy panels, as shown in FIG. 3B, preferably towards the inner edge of the original panel.

Figure 6B:
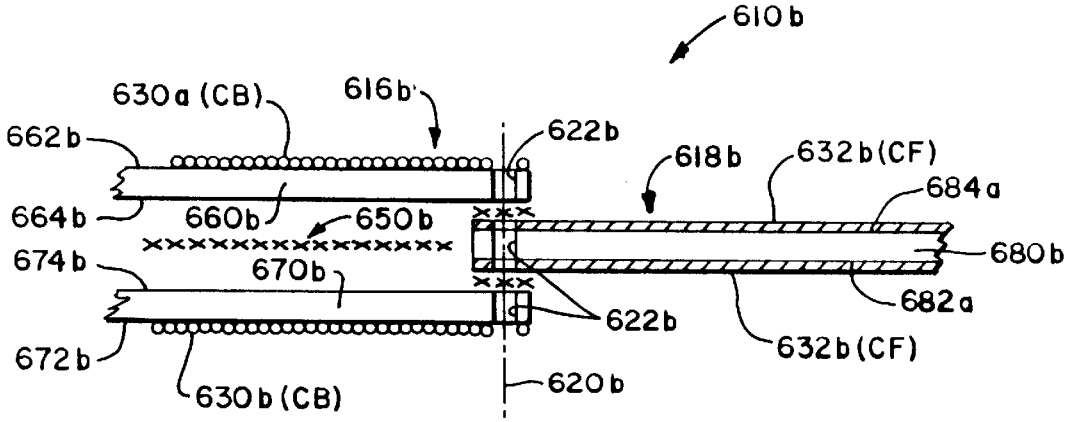
FIG. 6B is a cross-sectional view of a self-replicating duplex form, showing an alternate embodiment of a technique for laminating two panels into a "virtual" sheet.

FIG. 6B shows an alternate technique for forming a single "virtual" sheet having an original panel coated on both sides with carbonless CB and a copy panel coated on both sides with carbonless CF.

As in the previously described embodiment (FIG. 6A), a panel 660*b* of carbonless CB paper stock has a coating 630*a* of carbonless CB on one of its surfaces 662*b* and its opposite surface 664*b* is not CB-coated. A panel 670*b* of carbonless CB paper stock is coated on one of its surfaces 672*b* with carbonless CB 630*b*, and its opposite surface 674*a* is not CB-coated. A layer of adhesive 650*b* is applied between the uncoated surfaces 664*b* and 674*b* of the panels 660*b* and 670*b*, respectively, to form a laminated structure for the original panel 616*b* which is coated on both sides with carbonless CB.

Unlike the previously described embodiment (FIG. 6A), in this embodiment a single panel 680*b* of "CF C2S" (coated on both sides with carbonless CF) coated carbonless paper has a CF coating 632*b* on one of its surfaces 682*b* and has a CF coating 632*b* on its opposite surface 684*b*.

As in the previously described embodiment (FIG. 6A), the inner edge of the CF-coated copy panel 618*b* is sandwiched between the inner edges of the panels 660*b* and 670*b* forming the original panel 616*b*. The inner edges are appropriately perforated with perforations 622*b* along a fold line 620*b*.

Although not shown, a single panel coated with CB on both sides could be joined to two panels (or a folded single panel) coated with CF on one side. In such a case, the panel 680*b* would be CB coated (both sides) and the panels 660*b* and 670*b* would be CF-coated (one side).

Figure 6C:
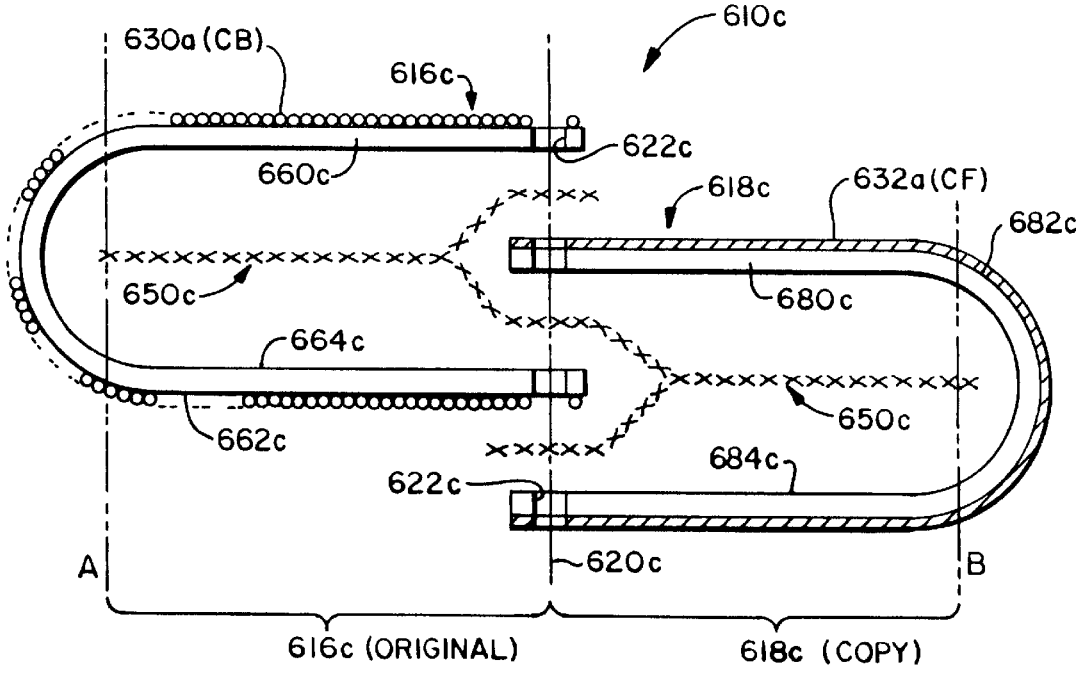
FIG. 6C is a cross-sectional view of a self-replicating duplex form, showing an embodiment of a technique for laminating two panels into a "virtual" sheet.

FIG. 6C illustrates a variation on the technique of FIG. 6A, but is also applicable to the technique of FIG. 6B. In this case, there is only one CB panel 660*c*, and it is folded upon itself so that its CB-coated surface 662*c* is exposed. Its uncoated surface 664*c* is glued with an adhesive 650*c* to form a laminated original panel 616*c* having a CB coating 630*a* on both its front and back surfaces. Although the folds are shown curved (with a relatively large radius), they are preferably ultimately creased, as shown in FIGS. 6G–6J. As indicated by the line "A", the actual fold of the CB panel 660*c* can be excised (trimmed) at the outer edge of the original panel 616*c*.

Similarly, in this embodiment there is only one CF panel 680*c*, and it is folded upon itself so that its CF-coated surface 682*c* is exposed, after lamination. Its uncoated surface 684*c* is glued with an adhesive 650*a* to form a laminated copy panel 618*c* having a CF coating 632*a* on both its front and back surfaces. As indicated by the line "B", the actual fold of the CF panel 680*c* can be excised (trimmed) to form the outer edge of the copy panel 618*c*.

In FIGS. 6C–6J, trim lines "A" and "B" are shown. The original panel extends between the trim line "A" and the fold line (620*x*) and the copy panel extends between the fold line and the trim line "B". While the laminated article need not be trimmed (but preferably are trimmed), these trim lines aid in following the descriptions of the drawings.

The technique of FIG. 6C, namely laminating a panel upon itself, can be applied to only one of the panels, for instance to form the original panel 616*b* of the embodiment of FIG. 6B (which uses a single thickness CF C2S copy panel 618*b*, and therefore need not be a laminated structure of two CF panels).

Figure 6D:
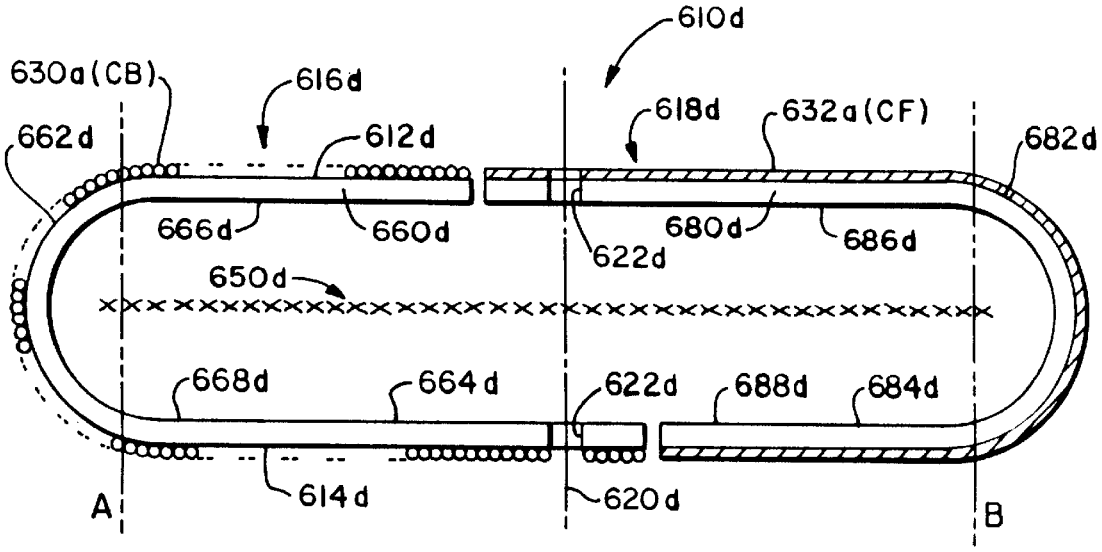
FIG. 6D is a cross-sectional view of a self-replicating duplex form, showing an alternate embodiment of a technique for laminating two panels into a "virtual" sheet.

FIG. 6D shows a variation on the technique of FIG. 6C, dealing mainly with the way in which the inner edges of the original and copy panels are joined together. In this case, by way of example, a single CB panel 660*d* is folded and laminated so that its CB-coated surface 632*d* is exposed, forming both sides of the original panel 616*d*, and a single CF-coated panel 680*d* is folded and laminates so that its CF-surface 682*d* is exposed, forming both sides of the copy panel 618*d*. The uncoated surfaces 664*d* and 684*d* of the CB and CF panels 660*d* and 680*d*, respectively, are glued with a laminating adhesive 650*d*. The resulting form has a front surface 612*d* and a back surface 614*d*. A portion 666*d* of the panel 660*d* forming the front surface of the original panel extends nearly to the fold line 620*a*, and a portion 668*d* of the panel 660*d* forming the back surface of the original panel extends slightly past the fold line. Conversely, a portion 686*d* of the panel 680*d* forming the front surface of the copy panel 618*a* extends slightly past the fold line, overlaps the inner edge of the portion 668*d*, and abuts the inner edge of the portion 666*d*. A portion 688*d* of the panel 680*d* forming the back surface of the copy panel extends nearly to the fold line and abuts the inner edge of the portion 668*d*. In contrast to the embodiments of FIGS. 6A, 6B and 6C, this configuration does not increase the thickness of the resultant form at the joint (fold line 620*d*). The overlap of portions 668*d* and 686*d* discussed above is readily reversed so that the portions 666*d* and 688*d* would extend slightly past the fold line and overlap each other.

Figure 6E:
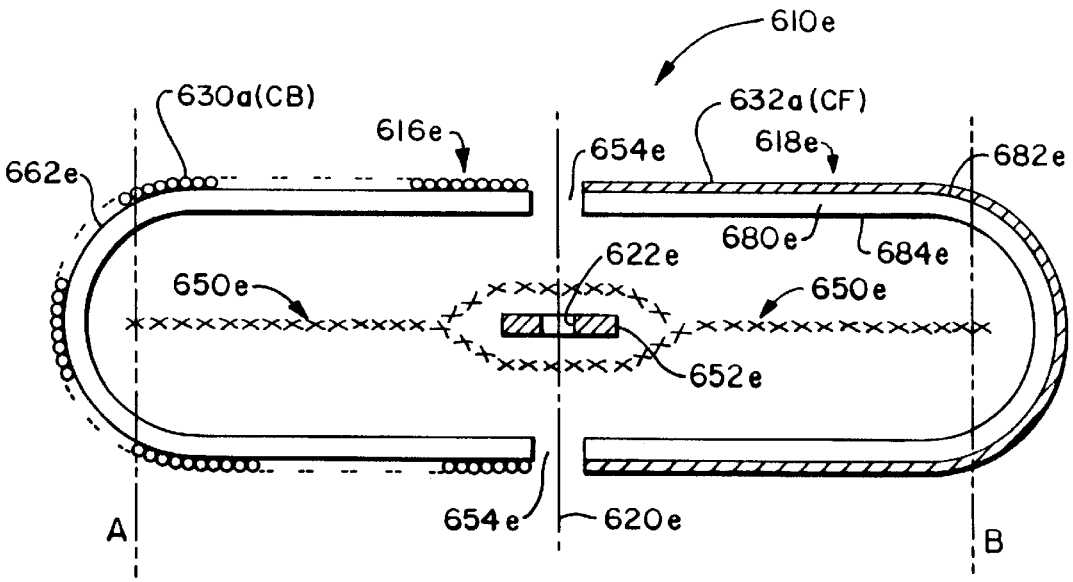
FIG. 6E is a cross-sectional view of a self-replicating duplex form, showing an alternate embodiment of a technique for laminating two panels into a "virtual" sheet.

FIG. 6E shows an alternate technique for producing a virtual single sheet form 610*e* as a laminated structure. As in the technique discussed with respect to FIG. 6C, a single CB panel 660*e* is folded and laminated so that its CB-coated surface 662*e* is exposed, forming both sides of the original panel 616*e*, and a single CF-coated panel 680*e* is folded and laminates so that its CF-surface 682*e* is exposed, forming both sides of the copy panel 618*e*. In a manner similar to that shown in FIG. 3E, a narrow tape 652*e* bridges the gaps 654*e* between the inner edges of the original and copy panels. However, in this case, the tape 652*e* is located within the interior of the form, between the laminates of the original and copy panels. The uncoated surfaces 662*e* and 682*e* of the panels 660*e* and 680*e*, respectively, are laminated with an adhesive 650*e*.

The gap can be of "zero" dimension, resulting in a perfect "butt" joint between the inner edges of the original and copy panels, or it can be small, such as on the order of a few thousandths or tens of thousandths of an inch to facilitate folding of the original panel one way for entering (variable) information on one side thereof and the other way for entering information on the other side thereof. In either case (zero or finite gap), the inner edges of the original and copy panels can be maintained perfectly parallel by first overlapping them then trimming them (not shown).

Figure 6F:
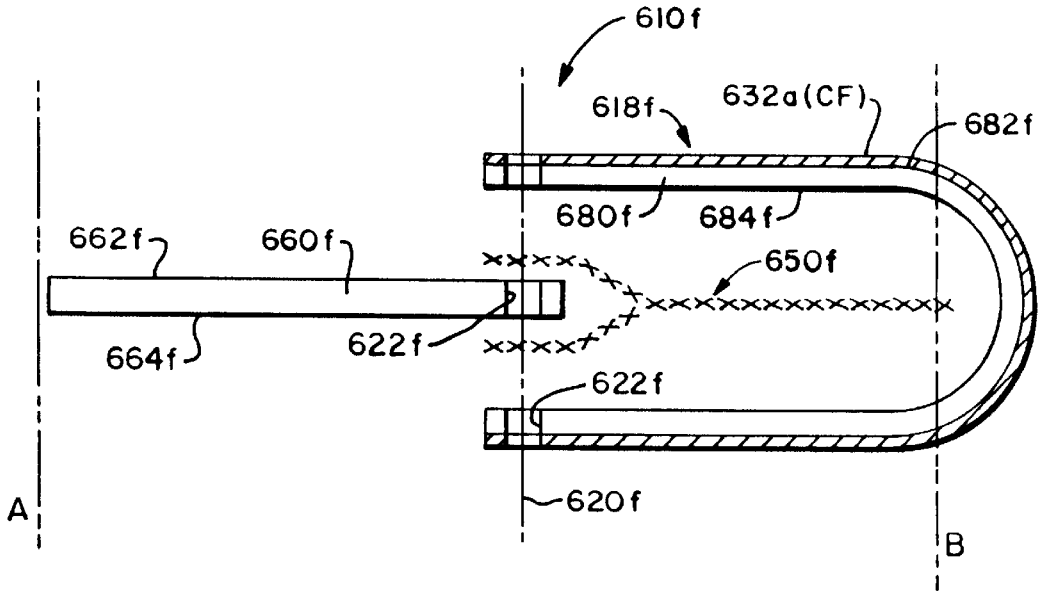
FIG. 6F is a cross-sectional view of a self-replicating duplex form, showing an embodiment of a technique for laminating two panels into a "virtual" sheet.

FIG. 6F shows an alternate technique for producing a form of laminated construction, similar in many respects to the technique discussed with respect to FIG. 6B. In this case, a plain paper panel 660*f* (not carbonless coated and not of laminated construction) forming the original panel 616*f* is joined to a CF panel 680*f* folded to form the copy panel 618*f*. The panel 680*f* is formed of CF-coated paper stock, and is folded so that its CF surface 682*f* is exposed to form the front and back surfaces of the copy panel. This configuration relates, but is not limited to the form disclosed in the aforementioned U.S. patent application Ser. No. 07/484,686 wherein the original panel is not coated, the copy panel is coated on both sides with CF, and an intermediate CB-coated transfer panel (not shown) effects image transfer from the original panel to the copy panel. The uncoated surfaces 662*f* and 682*f* are laminated with an adhesive 650*f*.

Figure 6G:
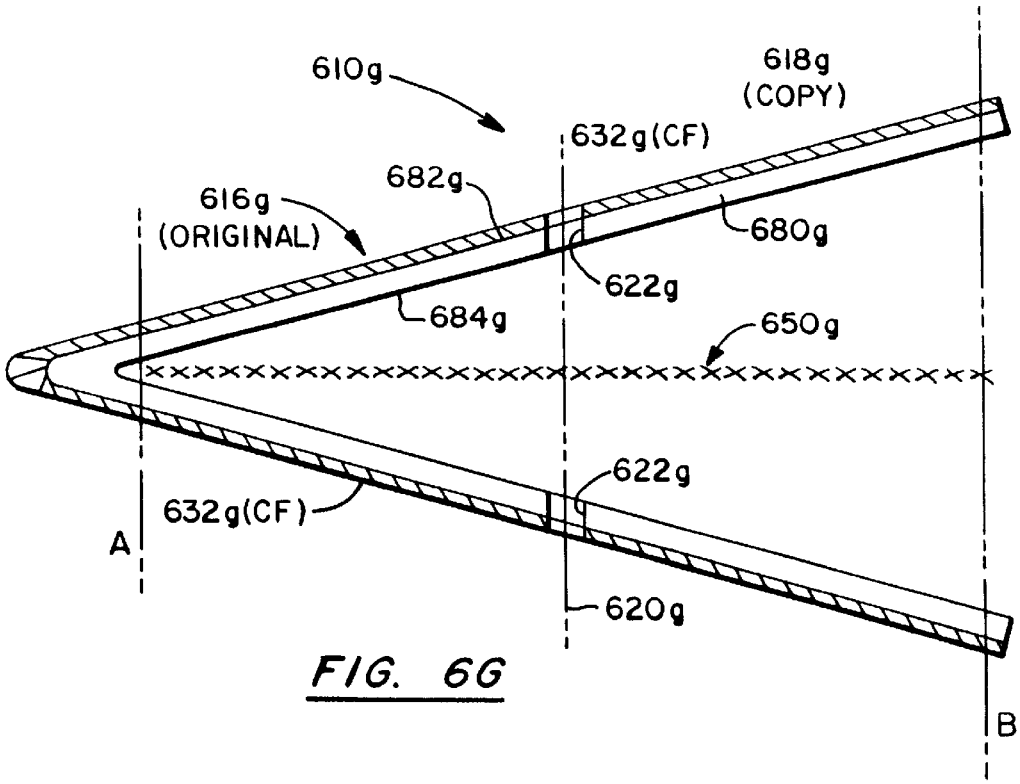
FIG. 6G is a cross-sectional view of a self-replicating duplex form, showing an alternate embodiment of a technique for laminating two panels into a "virtual" sheet.

FIG. 6G shows an alternate technique for producing a form of laminated construction, similar in many respects to the technique discussed for forming the laminated copy panel (680*c*) of FIG. 6C. In this case, a single CF-coated panel 680*g* is folded to expose its CF-coated surface 682*g* and conceal its uncoated surface 684*g*. An original panel 616*g* is thus formed to one side of the fold line 620*g*, and a copy panel 618*g* is formed to the other side of the fold line. Both original and copy panels have CF coating 632*g* on both sides, as described with respect to the configuration of, for example, FIG. 4C. The uncoated surface 684*g* of the panel 680*g* is laminated with an adhesive 650*g*.

Figure 6H:
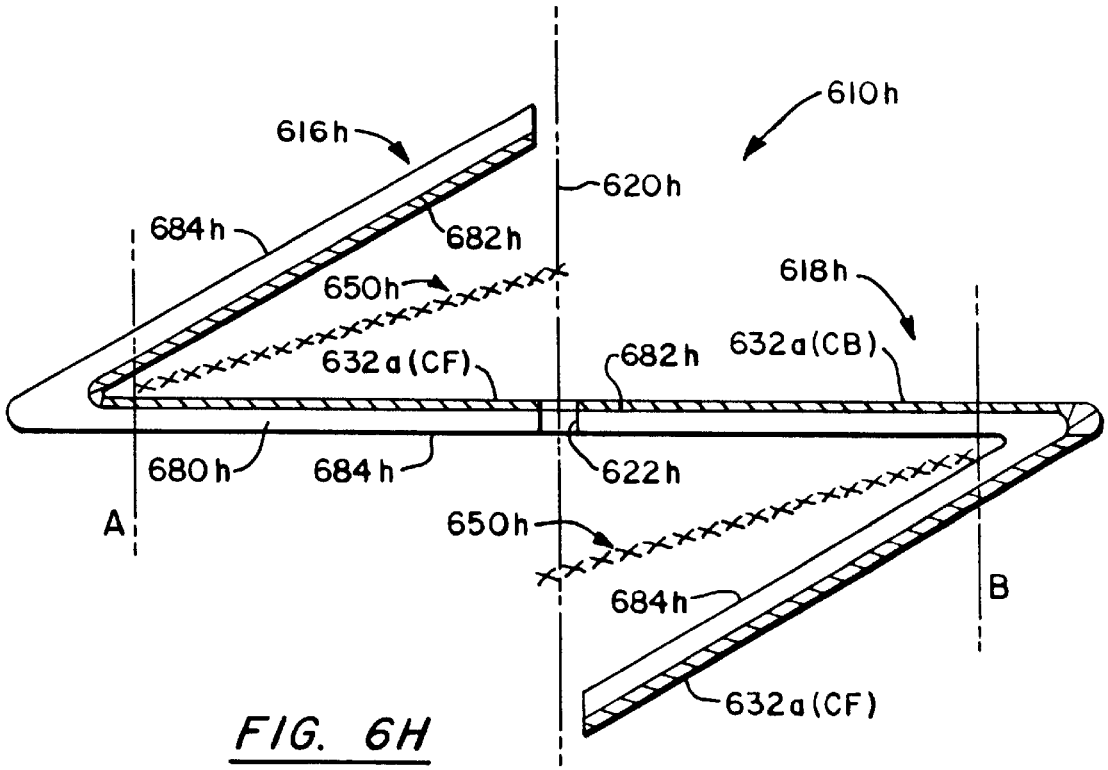
FIG. 6H is a cross-sectional view of a self-replicating duplex form, showing an alternate embodiment of a technique for laminating two panels into a "virtual" sheet.

FIG. 6H shows a laminating technique for another coating configuration. This configuration relates, but is not limited to the form disclosed in the aforementioned U.S. patent application Ser. No. 07/484,686 wherein the original panel is not coated, the copy panel is coated on both sides with CF, and an intermediate CB-coated transfer panel (not shown) effects image transfer from the original panel to the copy panel. In this case, a sheet of paper stock 680*h* having a CF-coating 632*a* on one side 682*h* thereof (and no carbonless coating on the opposite side 684*h*) is folded in a "Z" configuration so that the ultimately formed original panel 616*h* will be uncoated (684*h*) and the ultimately formed copy panel 618*h* will have a CF coating 632*a* on both sides.

Figure 6I:
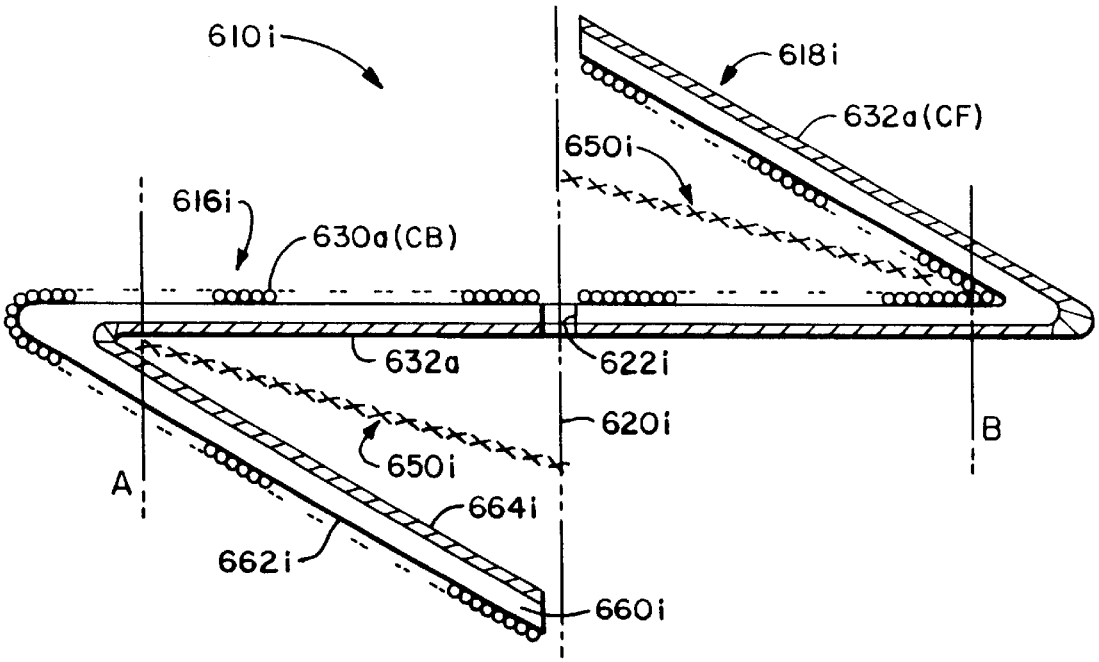
FIG. 6I is a cross-sectional view of a self-replicating duplex form, showing an embodiment of a technique for laminating two panels into a "virtual" sheet.

FIG. 6I shows a laminated technique for producing a form having a CB C2S (both sides CB-coated) original panel 616*i* and a CF C2S (both sides coated) copy panel 618*i*, such as is disclosed in the aforementioned U.S. patent application Ser. No. 07/334,183 wherein the original panel is CB-coated on both sides and the copy panel is CF-coated on both sides. In this case, a single sheet of CFB (CF-coated front, CB-coated back) paper stock 660*i* is folded in a "Z" configuration so that a portion of the sheet 660*i* to one side of the fold line 620*i* is folded and glued CF-face 664*i* to CF-face so that the CB coating 630*a* is exposed (for entering information) on both sides of the original panel 616*i*, and so that a portion of the sheet 660*i* to the other side of the fold line is folded CB-face 662*i* to CB-face so that the CF coating 632*i* is exposed for reproducing information on both sides of the copy panel 618*i*.

Interestingly, as shown in FIG. 6I, due to the fact that each of the original and copy panels has two thicknesses of paper (laminate), two thicknesses of CB coating and two thicknesses of CF coating, they are inherently of equal thickness (equivalent weights), which has advantages as discussed hereinabove. This is true for the laminating techniques of FIGS. 6G through 6J.

Figure 6J:
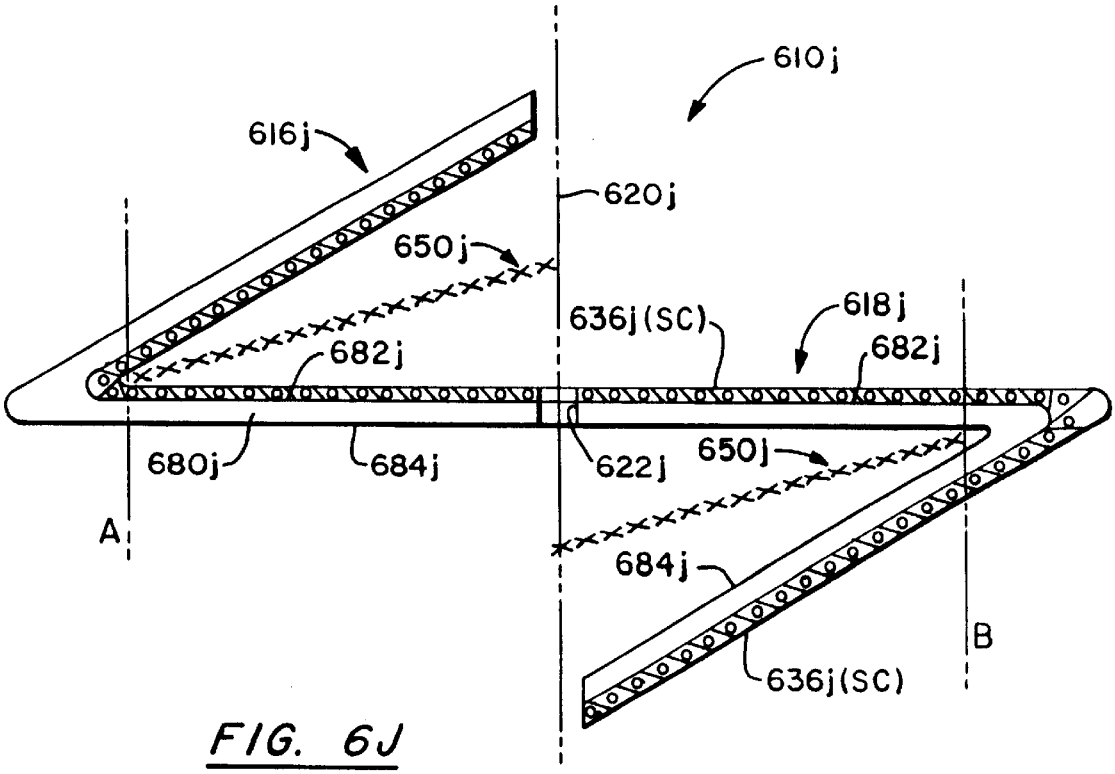
FIG. 6J is a cross-sectional view of a self-replicating duplex form, showing an alternate embodiment of a technique for laminating two panels into a "virtual" sheet.

FIG. 6J shows yet another laminating technique, again a "Z-fold" configuration, producing a plain paper (no carbonless coating) original panel 616*j* and a copy panel 618*j* having Self-Contained (SC) coating 636*j* on both sides, as disclosed in the aforementioned U.S. patent application Ser. No. 07/436,189 wherein the original panel is not carbonless coated, and the copy panel is coated with carbonless SC (Self-contained) on both sides. This type of construction is especially advantageous in that the SC-coated copy panel can be made sufficiently thick that the "wrong" side (i.e., the side that is not supposed to be reproducing, unless the form is folded an opposite way) does not reveal an image, for instance on the order of 36# (laminated), or greater (40# in the case of folding 20#) SC-stock. Folded as in FIG. 6I, a portion of the sheet 680*j* forming the original panel 616*j* is folded and glued 650*j*) SC-face 682*j* to SC-face, and a portion of the sheet 680*j* forming the copy panel 618*j* is folded plain (uncoated) face 684*j* to plain face (and glued 650*j*). In these "Z" configurations (FIGS. 6H, 6I, 6J), the outer edges of the sheet may be folded in just short of the fold line (620*x*), leaving a weak, single thickness area at the fold line for facilitating folding and separating (even without perforations 622*x*) the original from the copy panel.

The above-described laminating techniques advantageously employ relatively thin (e.g., 10–12™) carbonless paper stock that is readily available from most manufacturers. For the adhesive (650*x*), present adhesives used for stubbing and padding are suitably employed.

In this, as in all cases, the original and copy panels may ultimately be disposed one above the other with a horizontal fold line separating them. Generally, having the original and copy panels side-by-side with a vertical fold line yields a more "user-friendly" form orientation, and is very distinguishable from manifold forms.

In those embodiments where a panel is folded upon itself to expose a coating on one side of the panel for the front and back surfaces of the original or copy panels, fixed information can be pre-printed on the one surface ultimately exposed for writing. In this manner, duplex (two-sided) preprinted information can be provided by printing only one side of a sheet, in an intermediate (prior to laminating) step.

The laminating techniques disclosed herein may advantageously be combined with the any of the coating techniques, the larger copy panel techniques, the coating configurations, and the joining techniques discussed hereinabove. Other folding and laminating arrangements are intended to be within the scope of the invention.

Various improvements to the disclosures of the parent cases are disclosed, which make the self-replicating duplex form more "user friendly" and easier to manufacture.

The detailed descriptions set forth hereinabove essentially "mirror" the detailed descriptions from the aforementioned U.S. patent application Ser. No. 07/908,540, and no significant renumbering of the figures and corresponding text is required. The detailed descriptions set forth hereinbelow essentially "mirror" the detailed descriptions from the aforementioned U.S. patent application Ser. No. 08/808,847, with the figures and corresponding text renumbered.

Figure 7A:
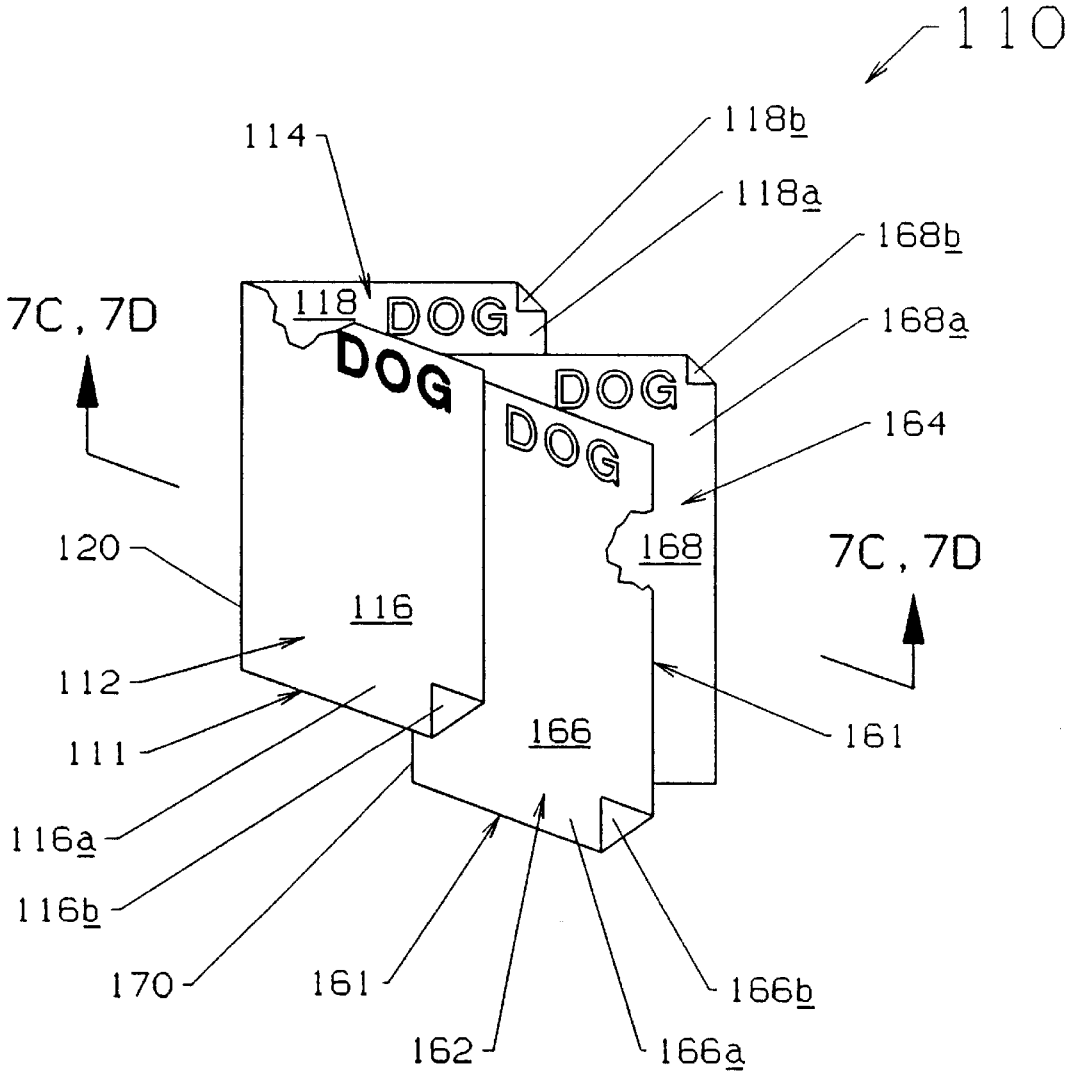
FIG. 7A is a perspective view of a "true-original" type, two-sided, self-replicating form set, with the individual elements folded one way, for entering information on one surface of the original panel.
Figure 7B:
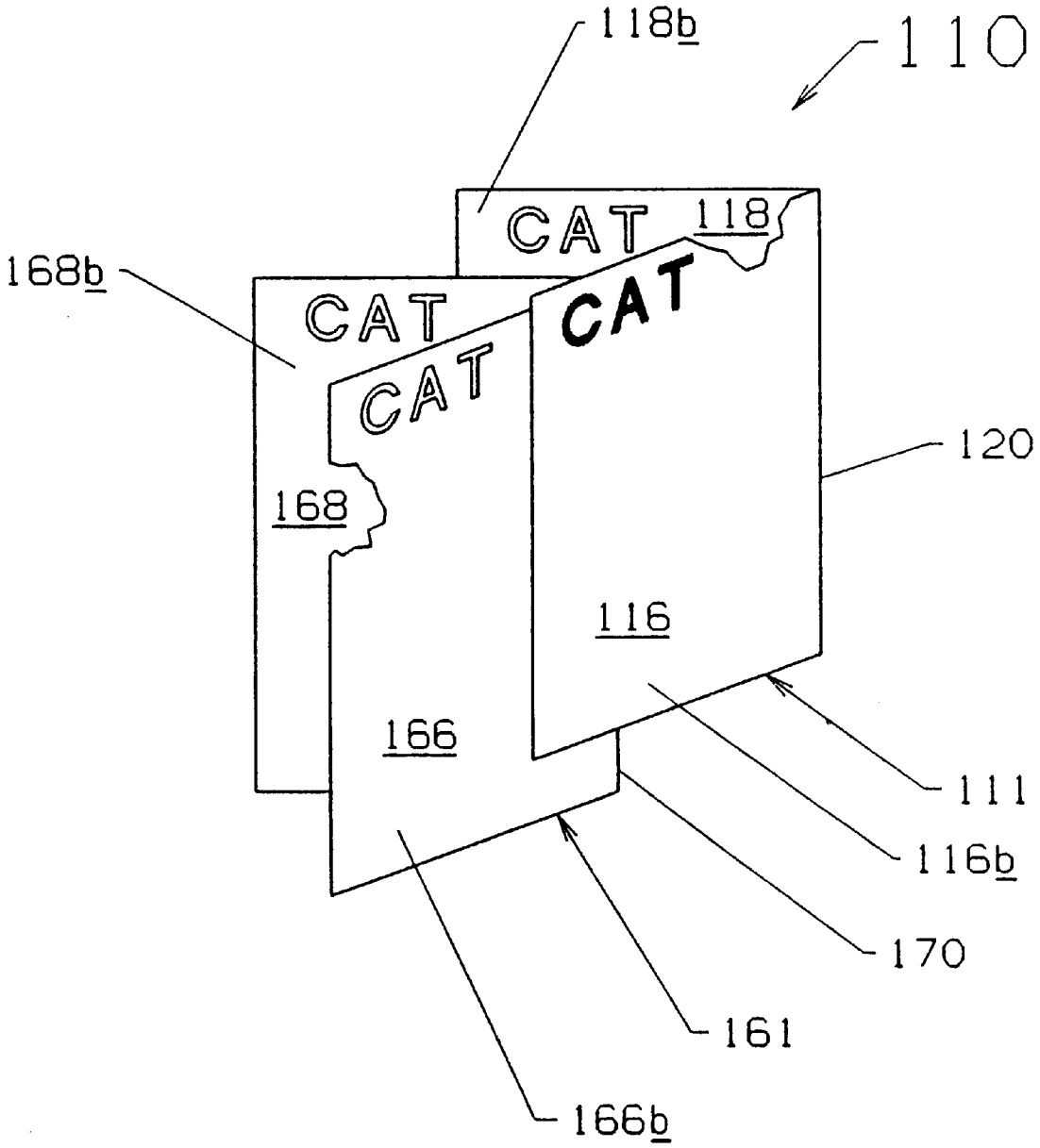
FIG. 7B is a perspective view of the form set of FIG. 7A, folded another way, for entering information on the opposite surface of the original panel.

FIGS. 7A and 7B are similar to FIGS. 1A and 1B of U.S. patent application Ser. No. 08/126,538, and show a two-sided, self-replicating form 110, capable of making multiple two-sided copies of a true, two-sided original.

A first sheet of paper 111 has a front surface 112 and a back surface 114. The sheet 111 is delineated into a "first" original panel 116 and a "second" copy panel 118, preferably by a fold 120, and the fold 120 is preferably provided with a series of perforations (not shown) for aiding in folding and facilitating separating (after use) the two panels 116, 118.

A second sheet of paper 161 has a front surface 162 and a back surface 164. The sheet 161 is delineated into a "third" copy panel 166 and a "fourth" copy panel 168. The delineation in the second sheet 161 is preferably folded 170 and perforated in a manner similar to the first sheet. The panels 116, 118, 166 and 168 are all nominally the same size, e.g. measuring 8½×11 inches. However, as disclosed in parent U.S. patent application Ser. No. 591,781, the second copy panel 118 advantageously can be made slightly larger (e.g., wider) than the first original panel 116. The fourth copy panel may also be larger than the third copy panel, in like manner.

In FIG. 7A, the sheet 111 is shown folded one way, and the sheet 161 is shown folded a corresponding one way, and the folded sheet 161 is inserted between the panels of the folded sheet 111. The figure shows the folded sheet 161 being inserted between the panels of the sheet 111. With carbonless coatings appropriately disposed on the surfaces of the various panels, discussed below, information ("DOG") entered on one surface 116*a* of the first original panel 116 ("DOG", in solid lettering) will be imaged onto a corresponding one surface 166*a* of the third copy panel 166 ("DOG", in phantom lettering), will further be imaged onto a corresponding one surface 168*a* of the fourth copy panel 168 ("DOG", in phantom), and will yet further be imaged onto a corresponding one surface 118*a* of the second copy panel 118 ("DOG", in phantom). The second sheet 161 is fully inserted (nested between the panels of the folded first sheet) so that its fold 170 is "snugged up" against the fold 120 of the first sheet 111, to maintain proper alignment of the various panels, thereby ensuring that information entered at a particular location on the original is imaged onto a corresponding particular location on the copy panels.

In FIG. 7B, the sheet 111 is shown re-folded another, opposite way, so that the opposite surface 116*b* of the first original panel 116 is exposed for writing. The sheet 161 is also re-folded a corresponding opposite way, and the folded sheet 161 in inserted between the panels of the folded sheet 111. With appropriate carbonless coatings, discussed below, information ("CAT") entered on the opposite surface 116*b* of the first original panel 116 ("CAT", in solid lettering) will be imaged onto the corresponding opposite surface 166*b* of the third copy panel 166 ("CAT", in phantom lettering), will further be imaged onto the corresponding opposite surface 168*b* of the fourth copy panel 168 ("CAT", in phantom), and will yet further be imaged onto the corresponding opposite surface 118*b* of the second copy panel 118 ("CAT", in phantom). Again, the second sheet 161 is fully inserted so that its fold 170 is "snugged up" against the fold 120 of the first sheet 111, to maintain proper alignment of the various panels.

Before discussing how the various panels are carbonless coated, it should be noted that the front surface 112 of the overall sheet 111 comprises the one surface 116*a* of the first original panel 116 and the contiguous opposite surface 118*b* of the second copy panel 118. Similarly, the back surface 114 of the sheet 111 comprises the opposite surface 116*b* of the first original panel 116 and the contiguous one surface 118*a* of the second copy panel 118. Likewise, the front surface 162 of the sheet 161 comprises the one surface 166*a* of the third copy panel 166 and the contiguous opposite surface 168*b* of the fourth copy panel 168, and the back surface 164 of the sheet 161 comprises the opposite surface 166*b* of the third copy panel 166 and the contiguous one surface 168*a* of the fourth copy panel 168. This is a different way of calling out the parts than has been used previously (i.e., in the parent cases). Generally, in the parent cases, the front/back surfaces of the overall sheet were given descriptive prominence, and we had front (i.e., of the original panel) to back (i.e., of he copy panel) imaging. Herein, the one/opposite surfaces of the various panels are given descriptive prominence, and the one surface to one surface convention is adopted. Irrespective of whether the surfaces of the overall sheet or of the individual panels are given descriptive prominence, the form functions just the same.

Figure 7C:
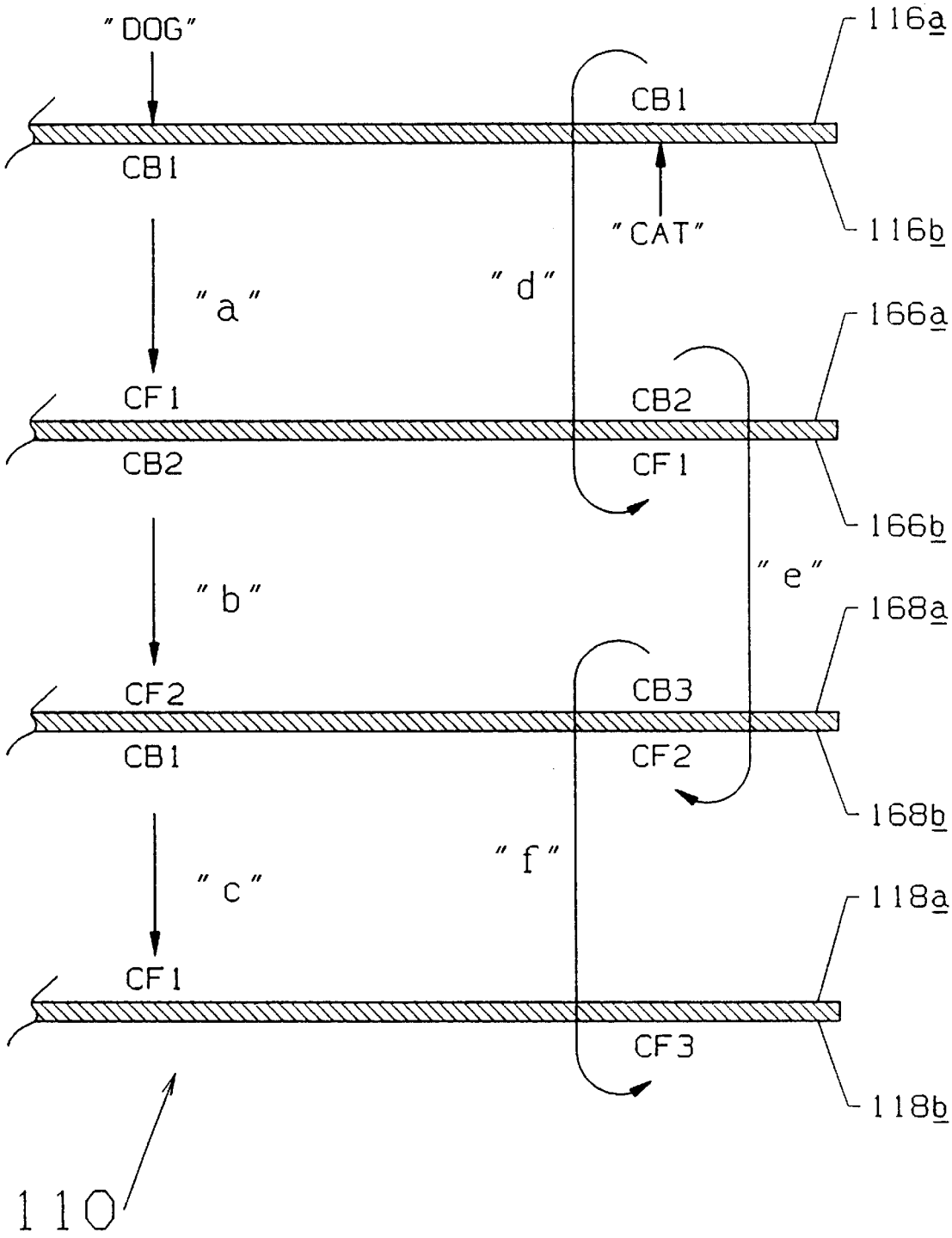
FIG. 7C is a cross-sectional view of the form set of FIGS. 1A and 1B, showing a "fully-coated" embodiment of carbonless coatings.

FIG. 7C, which is similar to FIG. 1C of U.S. patent application Ser. No. 08/126,538, shows one embodiment of carbonless coating the sheets 111 and 161. The cross-section is "exploded", in the sense that the single sheet nature of the sheets 111 and 161 is not shown, nor ar the folds 120 and 170 illustrated.

In this embodiment, the panels are "fully coated", and information can be entered at any location on either surface of the original panel 116, and will be reproduced at corresponding locations on corresponding surfaces of the copy panels.

The opposite surface 116*b* of the first original panel 116 is coated over substantially its entire area with a carbonless CB image-transferring coating selected from a first reactive system (hereinafter "CB1"). The one surface 166*a* of the third copy panel 166 is coated with a carbonless CF image-revealing coating selected from the first reactive system (hereinafter "CF1"), so that first information ("DOG") entered on the one surface 116*a* of the original panel 116 will be imaged by the CB1 coating on the opposite surface 116*b* of the original panel 116 onto the CF1-coated one surface 166*a* of the third copy panel 166. See arrow "a".

The opposite surface 166*b* of the third copy panel 166 is coated over substantially its entire area with a "CB2" coating, selected from a second carbonless system that is non-reactive with the first carbonless system. The one surface 168*a* of the fourth copy panel 168 is coated over substantially its entire area with a "CF2" coating from the second carbonless system, so that writing on the one surface 116*a* of the original panel 116 will further be imaged onto the one surface 168*a* of the fourth copy panel 168. See arrow "b".

The opposite surface 168*b* of the fourth copy panel 168 is coated over substantially its entire area with a CB1 coating, and the one surface 118*a* of the second copy panel 118 is coated over substantially its entire area with a CF1 coating, so that writing on the one surface 116*a* of the original panel 116 will further be imaged onto the one surface 118*a* of the second copy panel 118. See arrow "c".

Two mutually non-reactive carbonless systems are discussed in the aforementioned parent U.S. patent application Ser. No. 07/497,219. One system comprises CB1 and CF1, which react with one another. A second system comprises CF2 and CB2, which react with one another. By definition, CB1 does not react with CF2, and CB2 does not react with CF1. As will be evident from the following discussion, a third carbonless system comprising CB3 and CF3 is employed, and is at least partially mutually non-reactive with the first and second carbonless systems. As will become evident, it is important that the CB3 component of the third carbonless system does not react with either of CF1 or CF2. However, it is immaterial whether the CF3 component reacts with either of CB1 or CB2, since the disclosed form construction does not required that the CF3 and either of CB1 or CB2 components are both disposed (mixed) on the same surface of a panel or brought into contact with one another by the intimate contact of two panels.

As mentioned above, for entering second information ("CAT") in the other direction, namely from the opposite surface 116*b* of the first original panel 116 to the opposite surfaces 166*b*, 168*b* and 118*b* of the third, fourth and second copy panels 166, 168 and 118, respectively, the panels are re-folded, and the second sheet 161 is re-inserted between the panels of the first sheet 111. The sheets 111 and 161 are carbonless coated as follows.

The one surface 116*a* of the original panel 116 is coated over substantially its entire area with a CB1 component of the first carbonless system. The opposite surface 166*b* of the third copy panel 166 is coated with a CF1 component from the first carbonless system. In this manner, writing on the opposite surface 116*b* of the original panel 116 will be imaged by the CB1 coating on the one surface 116*a* of the original panel 116 onto the opposite surface 166*b* of the third copy panel 166. See arrow "d".

It should be noted that the surfaces of the third copy panel 166 are coated with a mixture of CB2 and CF1. These two carbonless system components (CB2 and CF1) are mixed and applied in a manner similar to self-contained ("SC") coatings, but they do not react with one another. Again, reference is made to the aforementioned U.S. patent application Ser. No. 07/497,219.

The one surface 166*a* of the third copy panel 166 is coated over substantially its entire area with a CB2 component, and the opposite surface 168*b* of the fourth copy panel 168 is coated over substantially its entire area with a CF2 component, so that writing on the opposite surface 116*b* of the original panel 116 will further be imaged onto the opposite surface 168*b* of the fourth copy panel 168. See arrow "e". Again, the CF2 and CB1 components can be mixed in a manner similar to an SC coating, but they will not autogenously react with one another.

The one surface 168*a* of the fourth copy panel 168 is coated over substantially its entire area with a CB3 component from a third carbonless system. The CB3 component is not reactive with the CF1 and CF2 components of the first and second carbonless systems, respectively. The opposite surface 118*b* of the second copy panel 118 is coated over substantially its entire area with a CF3 coating, reactive with the CB3 component, so that writing on the opposite surface 116*b* of the original panel 116 will further be imaged onto the opposite surface 118*b* of the second copy panel 118. See arrow "f".

In the event that the CB coatings on the original panel 116 are not endorsable, and exhibit a tendency to cause pen-skipping, it is also possible to pattern the coatings on the original and copy panels. As will be seen in the description of FIG. 7D, below, this eliminates coatings from selected writing areas on the original panel 116 where information will be entered—while retaining coatings in selected coating areas behind the selected writing areas.

Figure 7D:
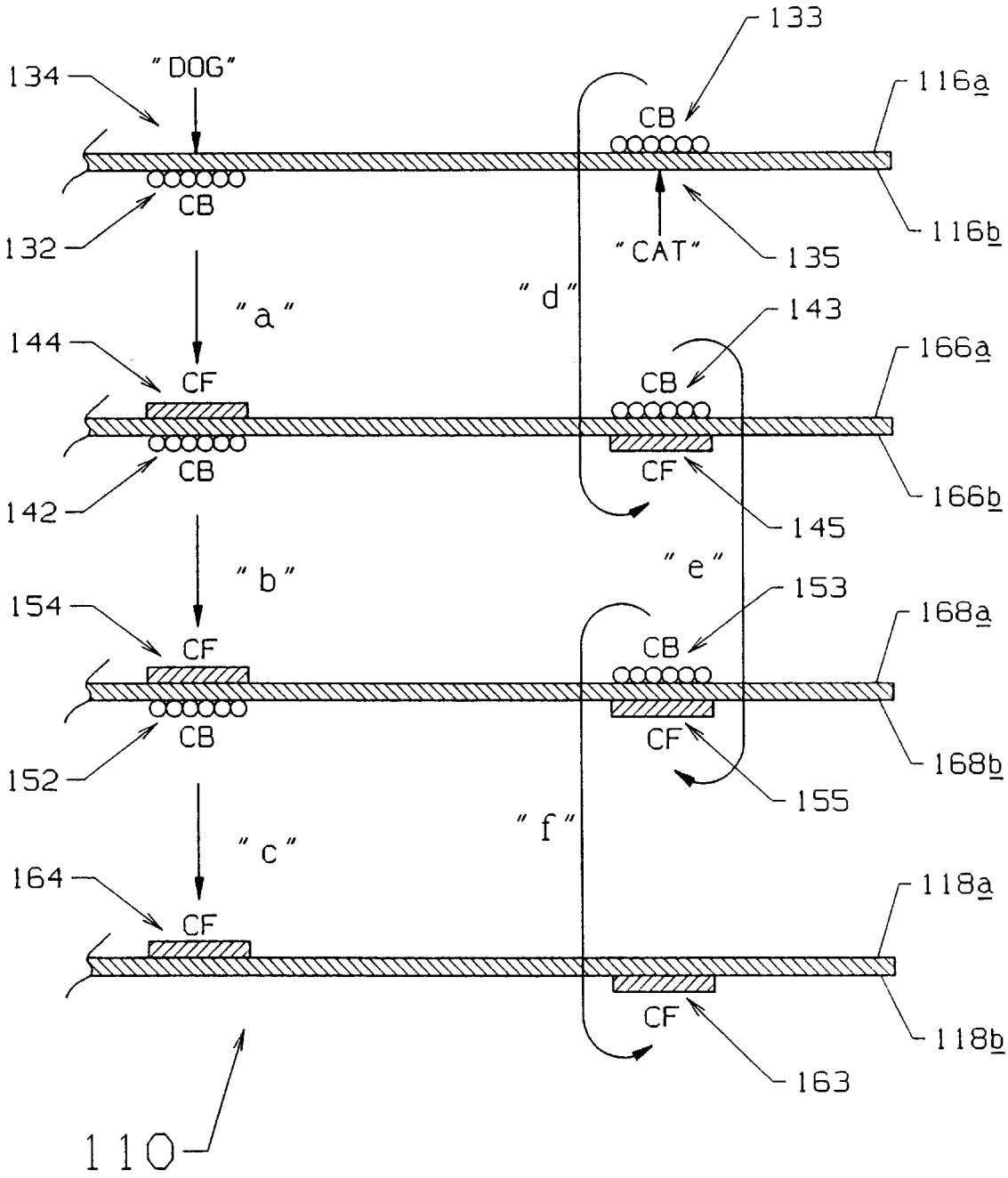
FIG. 7D is a cross-sectional view of the Form set of FIGS. 7A and 7B, showing a patterned embodiment of carbonless coatings.

FIG. 7D, similar to FIG. 1D of the aforementioned U.S. patent application Ser. No. 08/126,538, shows the form 110 of FIGS. 7A and 7B with patterned carbonless coatings. CB and CF components from a single carbonless system are employed.

A carbonless CB component is applied to a selected coating area 132 on the opposite surface 116*b* of the original panel 116 which is directly behind a selected writing area 134 on the one surface 116*a* of the original panel 116. A carbonless CF component is applied to a selected area 144 on the one surface 166*a* of the second copy panel 166, for revealing an image of first information ("DOG") entered upon the selected writing area 134. See arrow "a". The area 144 is aligned with the area 134.

A carbonless CB component is applied to a selected coating area 142 on the opposite surface 166*b* of the third copy panel 166 which is directly behind the selected area 144. A carbonless CF component is applied to a selected area 154 on the one surface 168*a* of the fourth copy panel 168, for revealing an image of writing ("DOG") impressed upon the selected writing area 134. See arrow "b". The area 154 is aligned with the areas 134, 132, 144 and 142.

A carbonless CB component is applied to a selected coating area 152 on the opposite surface 168*b* of the fourth copy panel 168 which is directly behind the selected area 154. A carbonless CF component is applied to a selected area 164 on the one surface 118*a* of the second copy panel 118, for revealing an image of writing ("DOG") impressed upon the selected writing area 134. The area 164 is aligned with the areas 134, 132, 144, 142, 154 and 152.

The selected areas 134, 132, 144, 142, 154, 152 and 164 comprise only a portion of the respective panel surfaces, and may be one contiguous area or a plurality of non-contiguous areas. As will be seen, the remaining areas on the surfaces of the panels are "reserved" for imaging in the opposite direction.

As mentioned above (FIGS. 7A and 7B), the sheets are re-folded and re-inserted for entering second information ("CAT") on the opposite surface 116*b* of the original panel 116, and reproducing the second information on corresponding opposite surfaces of the copy panels.

A carbonless CB component is applied to a selected coating area 133 on the one surface 116*a* of the original panel 116 which is directly behind a selected writing area 135 on the opposite surface 116*b* of the original panel 116. A carbonless CF component is applied to a selected coating area 145 on the opposite surface 166*b* of the third copy panel 166, for revealing an image of writing ("CAT") impressed upon the selected writing area 135. See arrow "d". The area 145 is aligned with the area 133.

A carbonless CB component is applied to a selected coating area 143 on the one surface 166*a* of the third copy panel 166 which is directly behind the selected area 145. A carbonless CF component is applied to a selected area 155 on the opposite surface 168*b* of the fourth copy panel 168, for revealing an image of writing ("CAT") impressed upon the selected writing area 135. See arrow "e". The area 155 is aligned with the areas 135, 133, 145 and 143.

A carbonless CB component is applied to a selected coating area 153 on the one surface 168*a* of the fourth copy panel 168 which is directly behind the selected area 155. A carbonless CF component is applied to a selected area 183 on the opposite surface 118*b* of the second copy panel 118, for revealing an image of writing ("DOG") impressed upon the selected writing area 135. See arrow "f". The area 163 is aligned with the areas 135, 133, 145, 143, 155 and 153.

The first selected areas 134, 132, 144, 142, 154, 152 and 164 are "offset", or non-aligned front-to-back, on a per panel basis with the second selected areas 135, 133, 145, 143, 155, 153 and 163.

Although the form 110, described hereinabove, creates a "true-original" having original writing on both sides of the original panel, it is evidently somewhat complex to use. For example, if the second sheet 161 is not re-folded and inserted correctly between the panels of the re-folded first sheet 111, the desired result may not be achieved. Hence, it is useful to create a form having two interleaved (nested) folded single sheets that is easier to use. As will be seen in the description that follows, the result is a "two-way rite" type form, wherein none of the panels have original writing on both sides. Hence, the term "original" panel is not employed. Rather, the terms "first", "second", "third" and "fourth" panels are employed. But for the arrangement of carbonless coatings, and the way in which the form is used, the basic construction of the form set 200 is very similar to the form set 100 of FIGS. 7A, 7B and 7D.

Figure 8A:
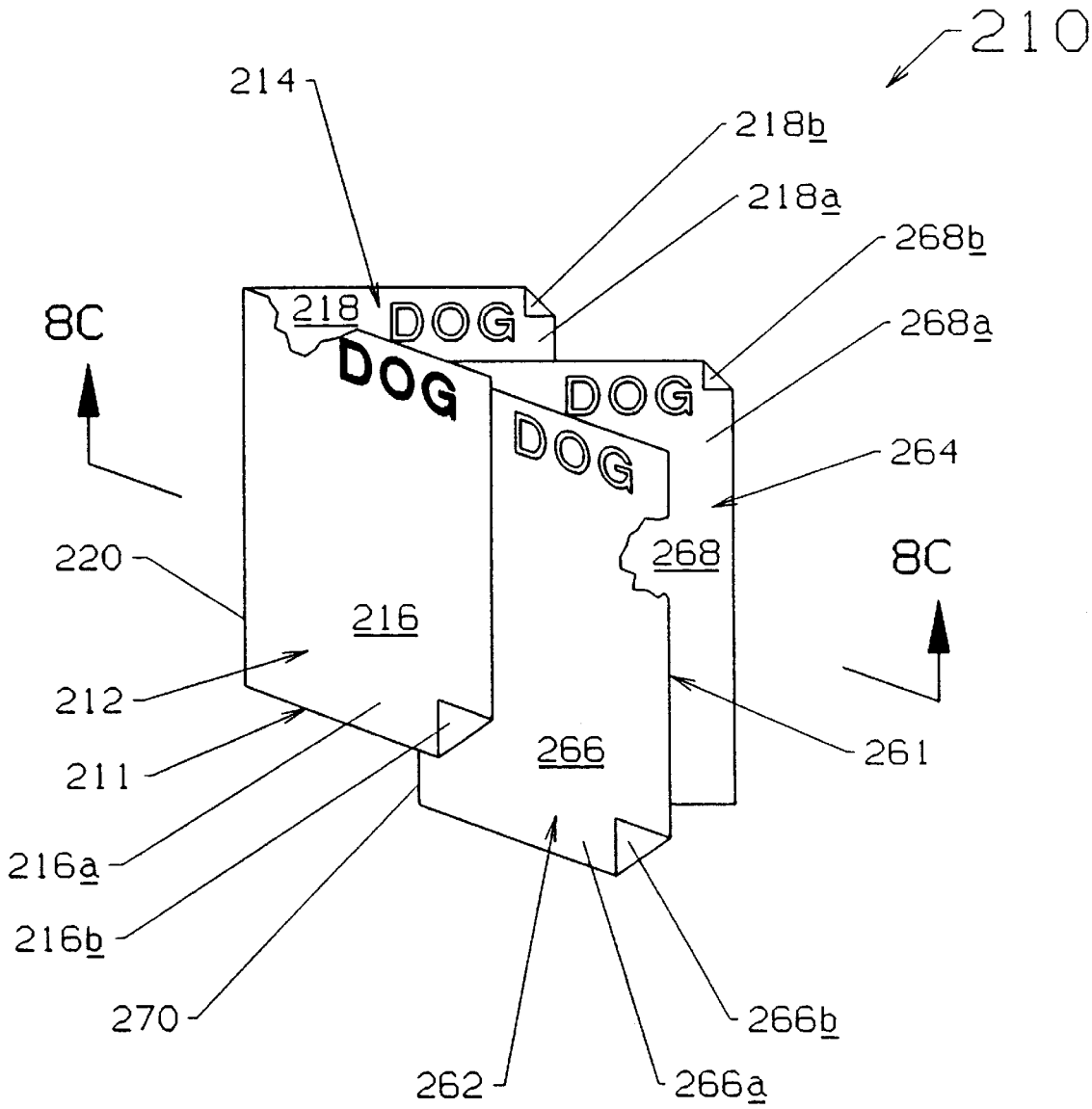
FIG. 8A is a perspective view of a "two-way-rite" type two-sided, self-replicating form set, with the individual elements folded one way, for entering information on one surface of the original panel.
Figure 8B:
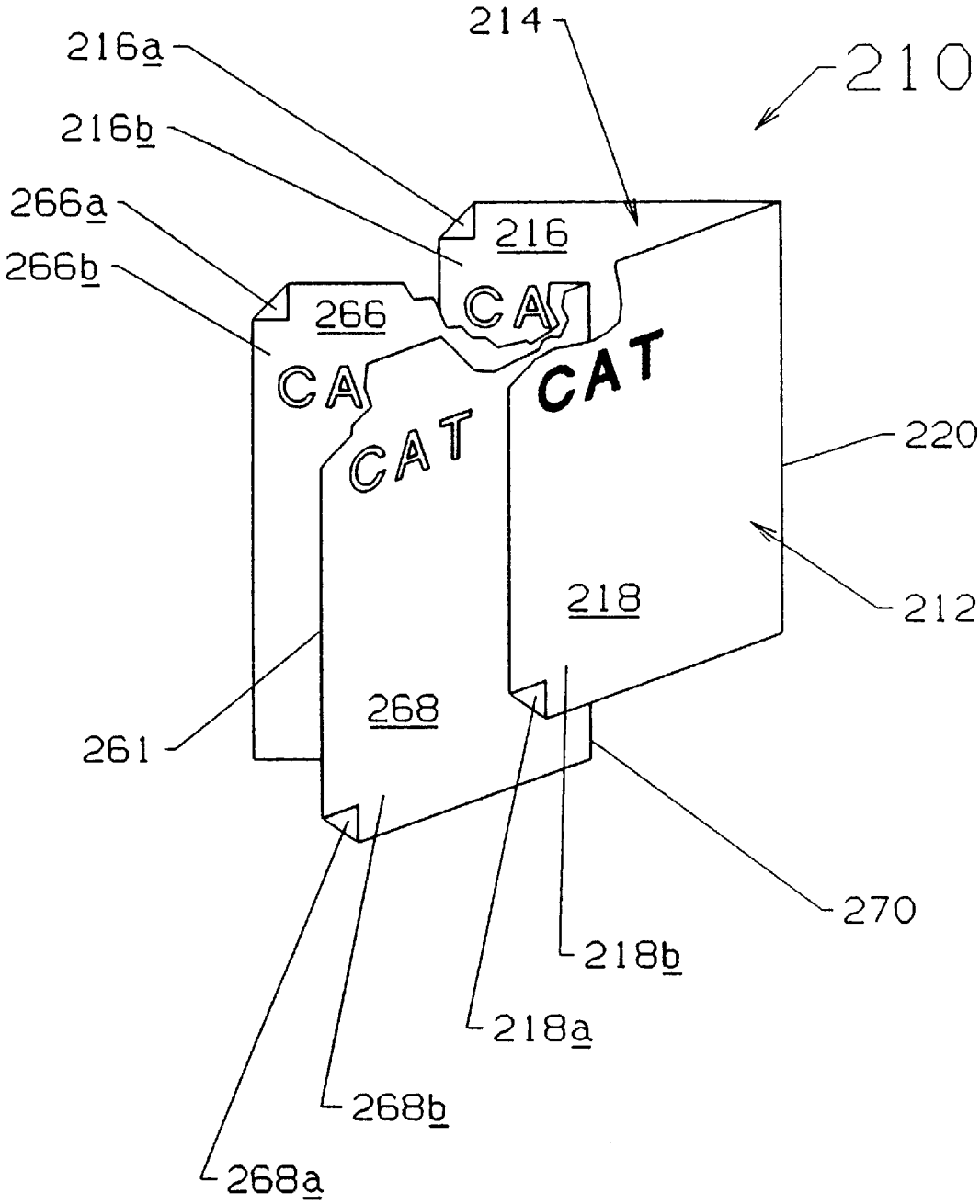
FIG. 8B is a perspective view of the form set of FIG. 8A, folded another way, for entering information on the opposite surface of the bottom-most copy panel.
Figure 8C:
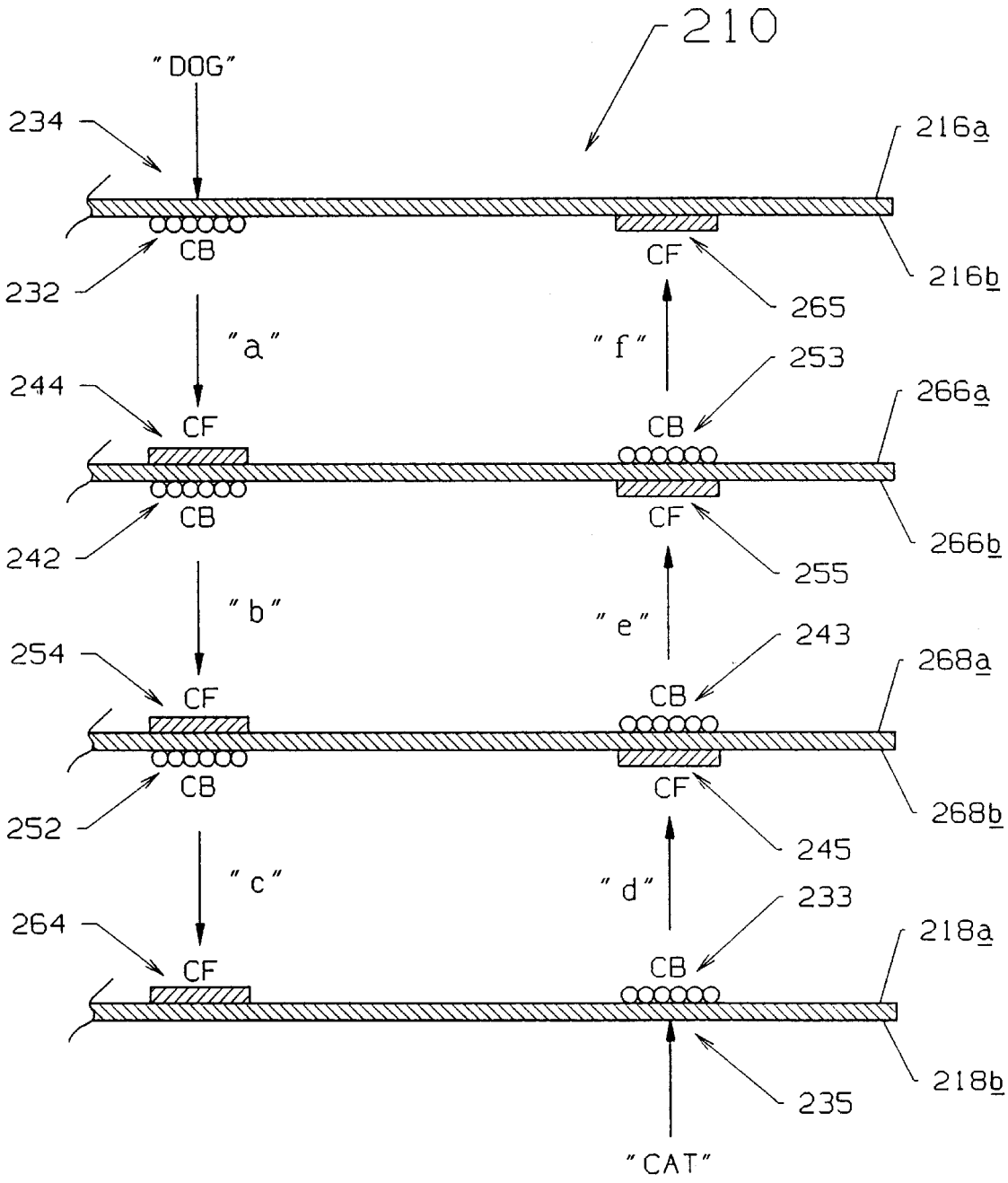
FIG. 8C is a cross-sectional view of the form set of FIGS. 8A and 8B, showing the carbonless coatings.

FIGS. 8A–8C, similar to FIGS. 2A–2C of the aforementioned U.S. patent application Ser. No. 08/126,538, show a form set 210 comprising two individual sheets 211 and 261.

A first sheet of paper 211 has a front surface 212 and a back surface 214. The sheet 211 is delineated into a "first" panel 216 and a "second" panel 218, preferably by a fold 220, and the fold 220 is preferably provided with a series of perforations (not shown) for aiding in folding and facilitating separating (after use) the two panels 216, 218.

A second sheet of paper 261 has a front surface 262 and a back surface 264. The sheet 261 is delineated into a "third" panel 266 and a "fourth" panel 268. The delineation in the second sheet 261 is preferably folded 270 and perforated in a manner similar to the first sheet. The panels 216, 218, 266 and 268 are all nominally the same size, e.g. measuring 8½×11 inches. However, as disclosed in the aforementioned U.S. patent application Ser. No. 07/591,781, the second panel 218 is advantageously slightly larger (e.g., wider) than the first panel 216.

In FIG. 8A, the sheet 211 is folded one way, and the sheet 261 is folded a corresponding one way, and the folded sheet 261 is inserted (nested) between the panels of the folded sheet 211. The figure shows the sheet 261 being inserted between the panels of the sheet 211. With carbonless coatings appropriately disposed on the surfaces of the various panels, discussed below, information ("DOG") entered on one surface 116*a* of the first panel 116 ("DOG", in solid lettering) will be imaged onto a corresponding one surface 266*a* of the third panel 266 ("DOG", in phantom lettering), will further be imaged onto a corresponding one surface 268*a* of the fourth panel 268 ("DOG", in phantom), and will yet further be imaged onto a corresponding one surface 218*a* of the second panel 218 ("DOG", in phantom). The second sheet 261 is fully inserted so that its fold 270 is "snugged up" against the fold 220 of the first sheet 211, to maintain proper alignment of the various panels.

In FIG. 8B, the sheets 211 and 261 remain folded and interleaved as in FIG. 8A, but together they are flipped over in their entirety so that the opposite surface 218*b* of the second panel 218 is exposed (up) for writing. With appropriate carbonless coatings, discussed below, information ("CAT") entered on the opposite surface 218*b* of the second panel 218 ("CAT", in solid lettering) will be imaged onto the corresponding opposite surface 268*b* of the fourth panel 268 ("CAT", in phantom lettering), will further be imaged onto the corresponding opposite surface 266*b* of the third panel 266 ("CAT", in phantom), and will yet further be imaged onto the corresponding opposite surface 216*b* of the first panel 216 ("CAT", in phantom).

Hence, the first panel 216 has original first writing (DOG) on its one surface 216*a*, and duplicate first writing (CAT) imaged onto its opposite surface 216*b*. Similarly, the second panel 268 has original second writing (CAT) on its opposite surface 268*b*, and duplicate first writing (DOG) imaged onto its one surface 266*a*. The third and fourth panels of the second sheet 261 have duplicate first writing (DOG) imaged onto their one surfaces 266*a* and 268*a*, respectively, and have duplicate second writing (CAT) imaged onto their opposite surfaces 266*b* and 268*b*, respectively. These are the hallmarks of a "two-way rite" type system, in that none of the elements (in this case, panels—usually individual sheets) has original first and second writing on both sides (surfaces).

Before discussing how the various panels are carbonless coated, it should be noted that the front surface 212 of the sheet 211 comprises the one surface 216*a* of the first panel 216 and the contiguous opposite surface 218*b* of the second panel 218. Similarly, the back surface 214 of the sheet 211 comprises the opposite surface 216*b* of the first panel 216 and the contiguous one surface 218*a* of the second panel 218. Likewise, the front surface 262 of the sheet 261 comprises the one surface 266*a* of the third panel 266 and the contiguous opposite surface 268*b* of the fourth panel 268, and the back surface 264 of the sheet 261 comprises the opposite surface 266*b* of the third panel 266 and the contiguous one surface 268*a* of the fourth panel 168.

FIG. 8C shows how the various panels are carbonless coated to achieve the two-sided, self-replicating functions set forth above. The carbonless coating components are applied to selected areas ("patterning"), rather than to substantially the entire surface ("fully-coated") of a panel, and CB and CF components from a single carbonless system are employed.

A carbonless CB component is applied to a selected coating area 232 on the opposite surface 216*b* of the first panel 216 which is directly behind a selected writing area 234 on the one surface 216*a* of the first panel 116. A carbonless CF component is applied to a selected area 244 on the one surface 266*a* of the third panel 266, for revealing an image of first information ("DOG") entered upon the selected writing area 234. See arrow "a". The area 244 is aligned with the areas 234 and 232.

A carbonless CB component is applied to a selected coating area 242 on the opposite surface 266*b* of the third panel 266 which is directly behind the selected area 244. A carbonless CF component is applied to a selected area 254 on the one surface 268*a* of the fourth panel 168, for revealing an image of writing ("DOG") impressed upon the selected writing area 234. See arrow "b". The area 254 is aligned with the areas 234, 232, 244 and 242.

A carbonless CB component is applied to a selected coating area 252 on the opposite surface 268*b* of the fourth panel 168 which is directly behind the selected area 254. A carbonless CF component is applied to a selected area 264 on the one surface 218*a* of the second panel 218, for revealing an image of writing ("DOG") impressed upon the selected writing area 234. The area 264 is aligned with the areas 234, 232, 244, 242, 254 and 252.

The selected areas 234, 232, 244, 242, 254, 252 and 264 comprise only a portion of the respective panel surfaces, and may be one contiguous area or a plurality of non-contiguous areas. As will be seen, the remaining areas on the surfaces of the panels are "reserved" for imaging in the opposite direction.

As mentioned above (FIGS. 8A and 8B), the sheets are not re-folded, nor are they re-inserted for entering second information ("CAT") on the opposite surface 118*b* of the second panel, and reproducing the second information on corresponding opposite surfaces of the fourth, third and first panels. Rather, they are simply re-oriented in their entirety, so that the opposite surface 218*b* of the second panel 218 is exposed for writing.

A carbonless CB component is applied to a selected coating area 233 on the one surface 218*a* of the second panel 218 which is directly behind a selected writing area 235 on the opposite surface 218*b* of the second panel 218. A carbonless CF component is applied to a selected coating area 245 on the opposite surface 268*b* of the fourth panel 268, for revealing an image of writing ("CAT") impressed upon the selected writing area 235. See arrow "d". The area 245 is aligned with the areas 235 and 233.

A carbonless CB component is applied to a selected coating area 243 on the one surface 268*a* of the fourth panel 268 which is directly behind the selected area 245. A carbonless CF component is applied to a selected area 255 on the opposite surface 266*b* of the third panel 266, for revealing an image of writing ("CAT") impressed upon the selected writing area 235. See arrow "e". The area 255 is aligned with the areas 235, 233, 245 and 243.

A carbonless CB component is applied to a selected coating area 253 on the one surface 266*a* of the third panel 266 which is directly behind the selected area 255. A carbonless CF component is applied to a selected area 265 on the opposite surface 216*b* of the first panel 216, for revealing an image of writing ("CAT") impressed upon the selected writing area 235. See arrow "f". The area 265 is aligned with the areas 235, 233, 245, 243, 255 and 253.

The first selected areas 234, 232, 244, 242, 254, 252 and 264 are offset from the second selected areas 235, 233, 245, 243, 255, 253 and 265.

Figure 9A:
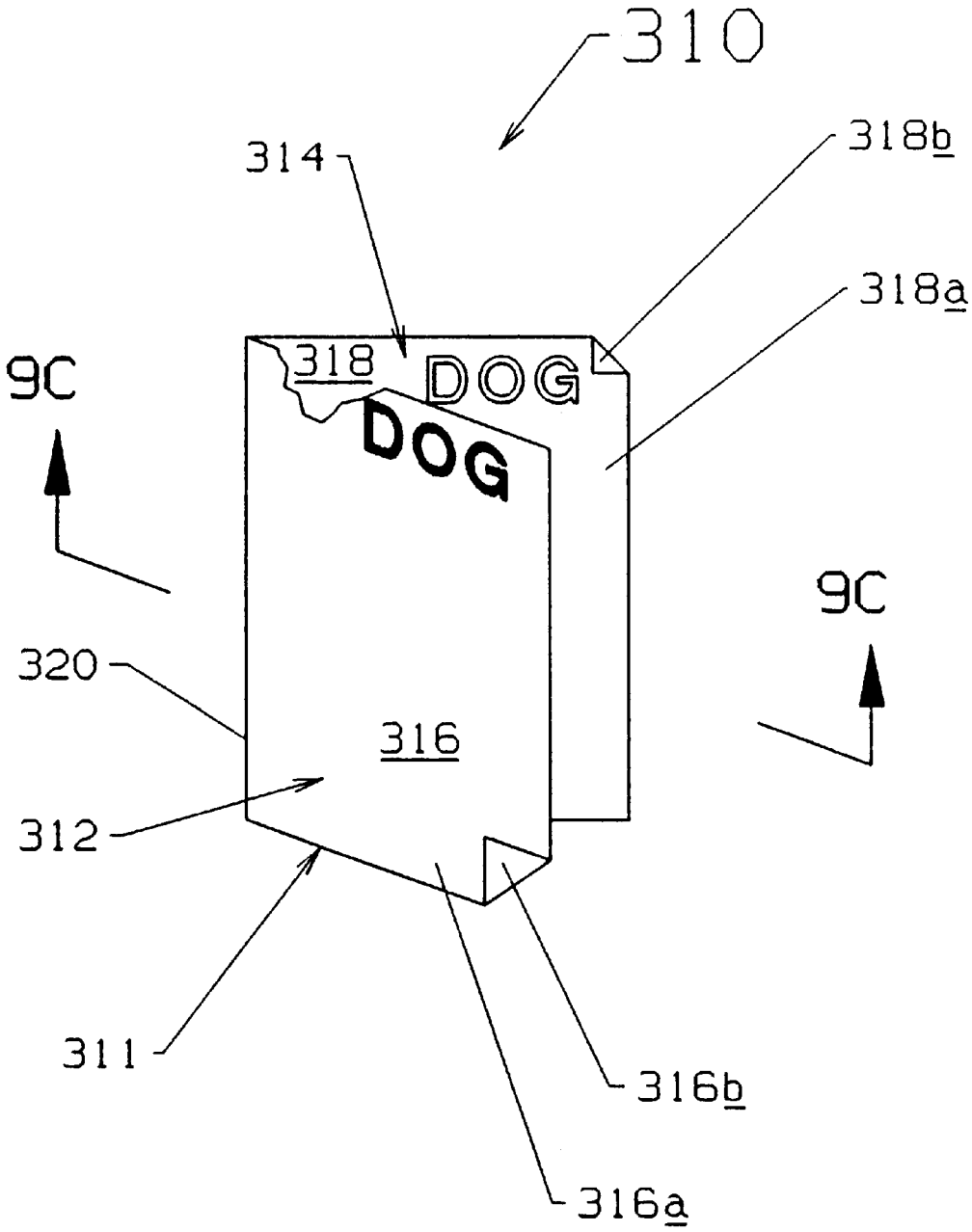
FIG. 9A is a perspective view of a "two-way-rite" type, two-sided, self-replicating form, folded one way, for entering information on one surface of the original panel.
Figure 9B:
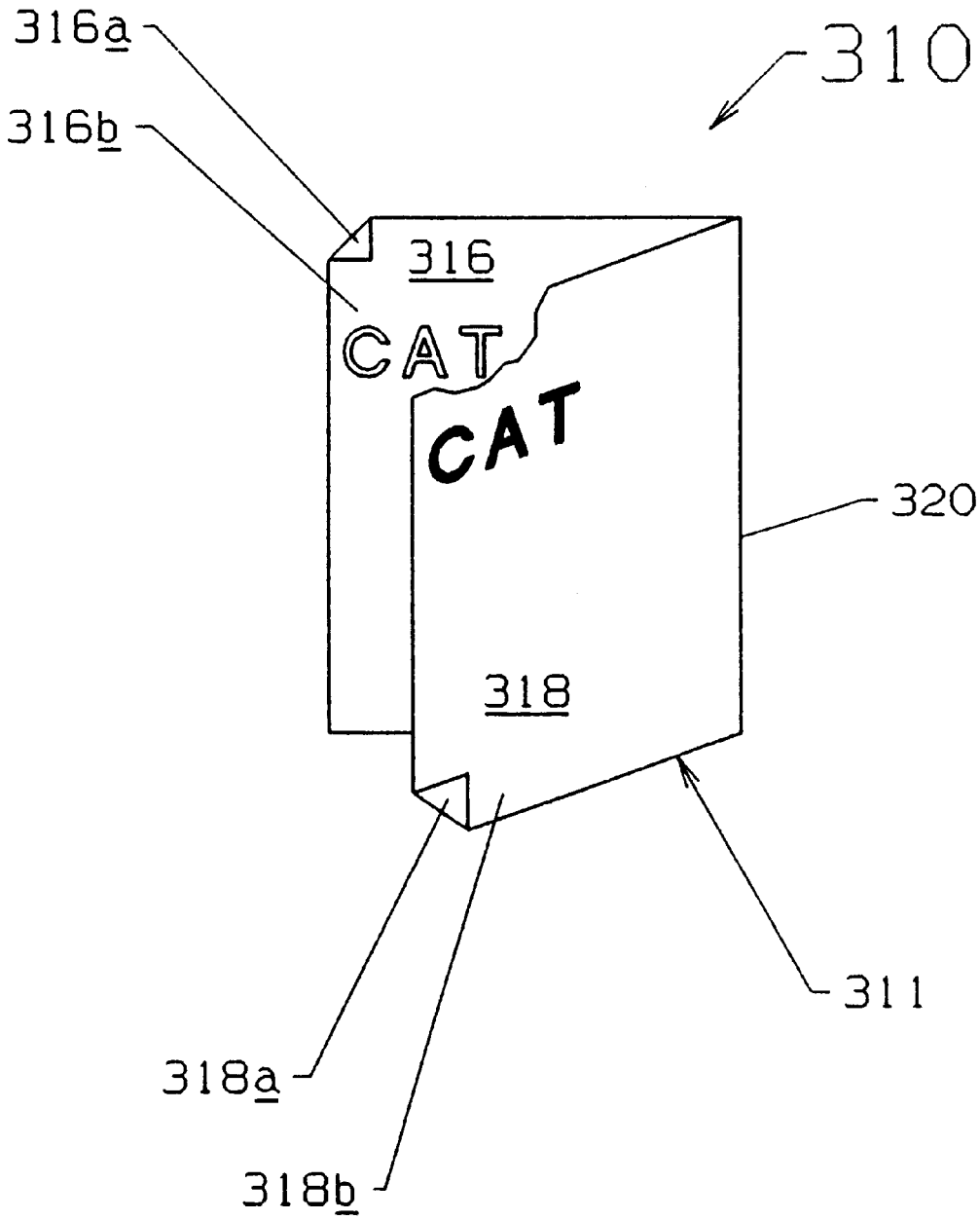
FIG. 9B is a perspective view of the form of FIG. 9A, folded another way, for entering information on the opposite surface of the copy panel.
Figure 9C:
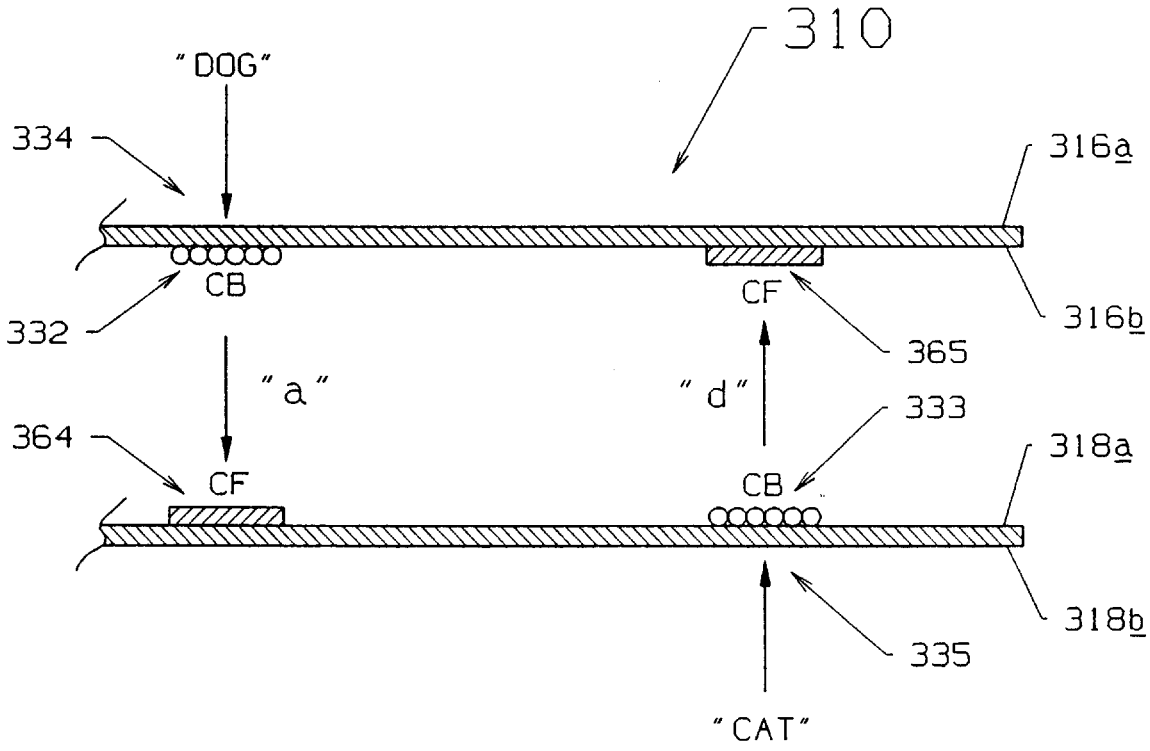
FIG. 9C is a cross-sectional view of the form set of FIGS. 9A and 9B, showing the carbonless coatings.

FIGS. 9A–9C, similar to FIGS. 3A–3C of the aforementioned U.S. patent application Ser. No. 08/126,538, illustrate a simpler two-way rite type form having only one single sheet of paper, folded to form two panels. In essence, the sheet 211 of the previously-described embodiment is employed for this purpose.

A sheet of paper 311 has a front surface 312 and a back surface 314. The sheet 311 is delineated into a "first" panel 316 and a "second" panel 318, preferably by a fold 320, and the fold 320 is preferably provided with a series of perforations (not shown) for aiding in folding and facilitating separating (after use) the two panels 316, 318.

The panels 316 and 318 are nominally the same size, e.g. measuring 8½×11 inches. However, as disclosed in parent U.S. application Ser. No. 591,781, the fold 320 may be formed slightly off center so that the second panel 318 is slightly larger than the first panel 316.

In FIG. 9A, the sheet 311 is folded and is positioned in one orientation, so that information ("DOG") entered on the one surface 316*a* of the first panel 316 will be imaged onto the corresponding one surface 318*a* of the second panel 318.

In FIG. 9B, the sheet 311 remains folded as in FIG. 9A, and is re-positioned, so that information ("CAT") entered on the opposite surface 318*b* of the second panel 318 will be imaged (reproduced) onto the corresponding opposite surface 316*b* of the first panel.

Again, since neither of the panels 316 or 318 contain original information on both sides, the form 300 must be considered to be of the "two-way rite" genre.

FIG. 9C shows how the various panels are carbonless coated to achieve the two-sided, self-replicating functions set forth above. The carbonless coating components are applied to selected areas ("patterning"), rather than to substantially the entire surface of a panel ("fully-coated"), and CB and CF components from a single carbonless system are employed.

A carbonless CB component is applied to a selected coating area 332 on the opposite surface 316*b* of the first panel 316 which is directly behind a selected writing area 334 on the one surface 316*a* of the first panel 316. A carbonless CF component is applied to a selected area 364 on the one surface 318*a* of the second panel 318, for revealing an image of first information ("DOG") entered upon the selected writing area 334. See arrow "a". The area 364 is aligned with the areas 334 and 332.

The selected areas 334, 332 and 364 comprise only a portion of the respective panel surfaces, and may be one contiguous area or a plurality of non-contiguous areas. As will be seen, the remaining areas on the surfaces of the panels are "reserved" for imaging in the opposite direction.

As mentioned above (FIGS. 9A and 9B), the sheet is not re-folded for entering second information ("CAT") on the opposite surface 318*b* of the second panel, and reproducing the second information onto the corresponding opposite surfaces of the first panel. Rather, the sheet 311 is simply re-oriented in its entirety, so that the opposite surface 218*b* of the second panel 318 is exposed for writing.

A carbonless CB component is applied to a selected coating area 333 on the one surface 318*a* of the second panel 318 which is directly behind a selected writing area 335 on the opposite surface 318*b* of the second panel 318. A carbonless CF component is applied to a selected coating area 365 on the opposite surface 316*b* of the first panel 316, for revealing an image of writing ("CAT") impressed upon the selected writing area 335. See arrow "d". The area 365 is aligned with the areas 335 and 333.

The first selected areas 334, 332 and 364 are offset from the second selected areas 335, 333 and 365.

Figure 10A:
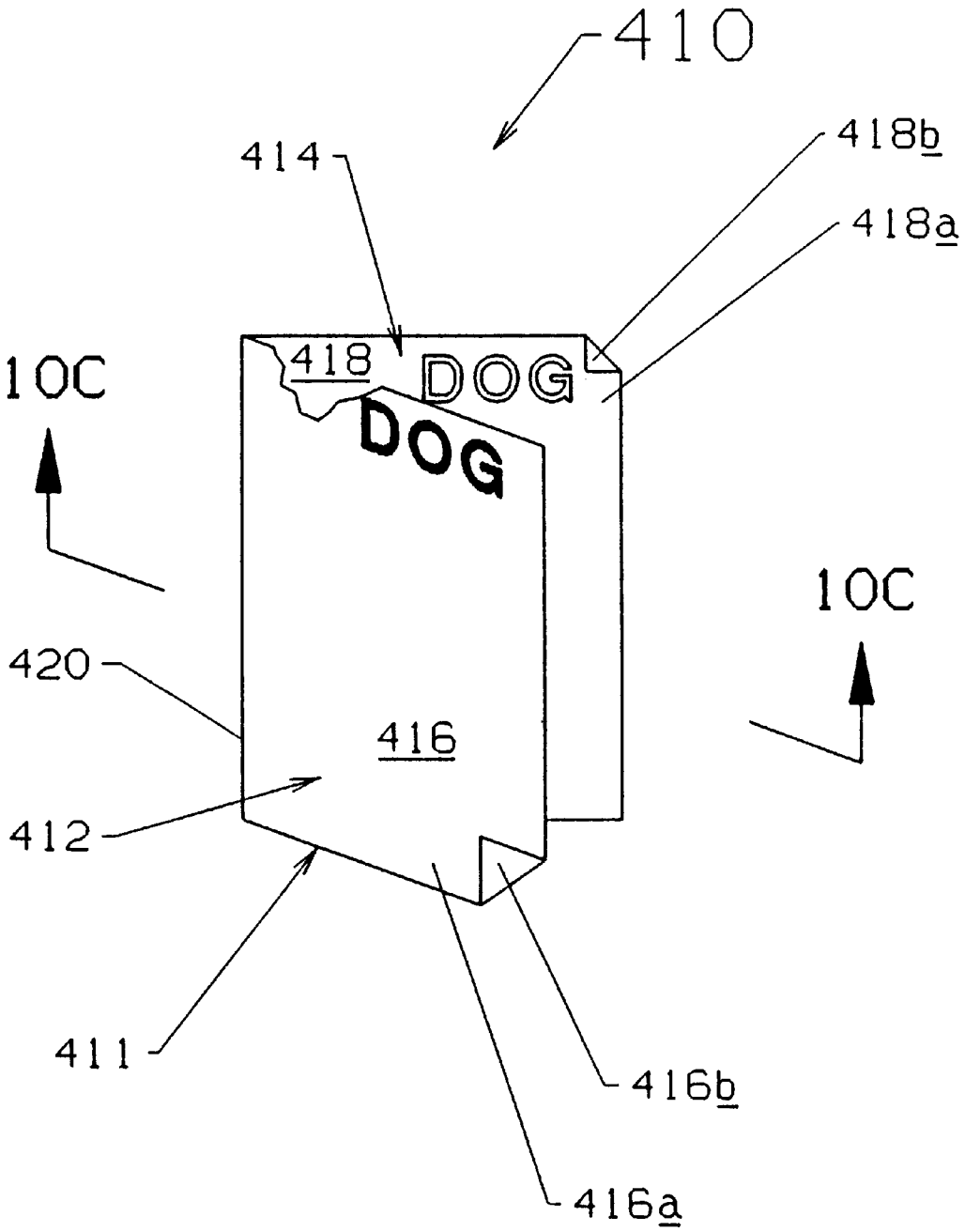
FIG. 10A is perspective view of a "true-original" type, two-sided, self-replicating form, folded one way, for entering information on one surface of the original panel.
Figure 10B:
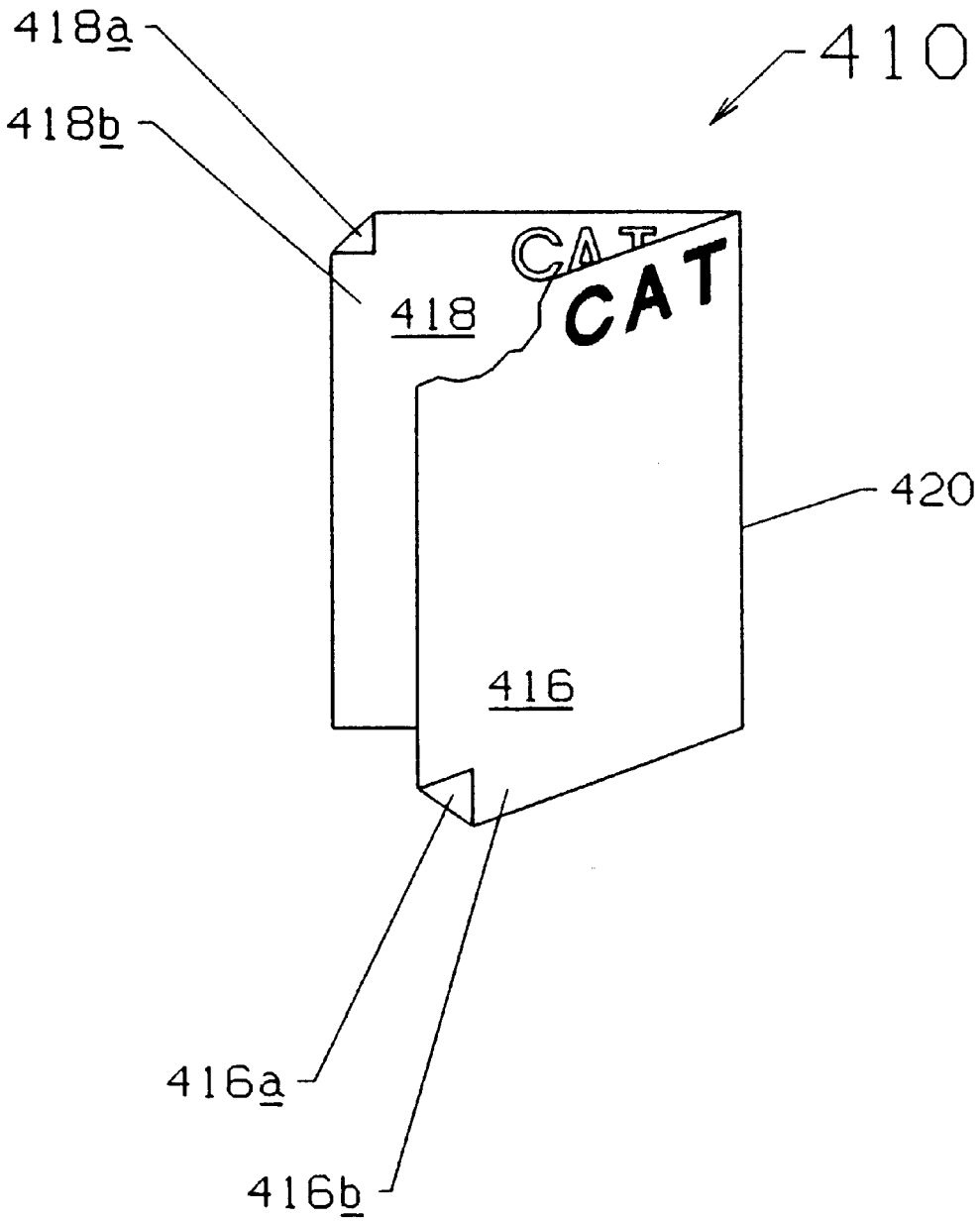
FIG. 10B is a perspective view of the form of FIG. 10A, folded another way, for entering information on the opposite surface of the original panel.
Figure 10C:
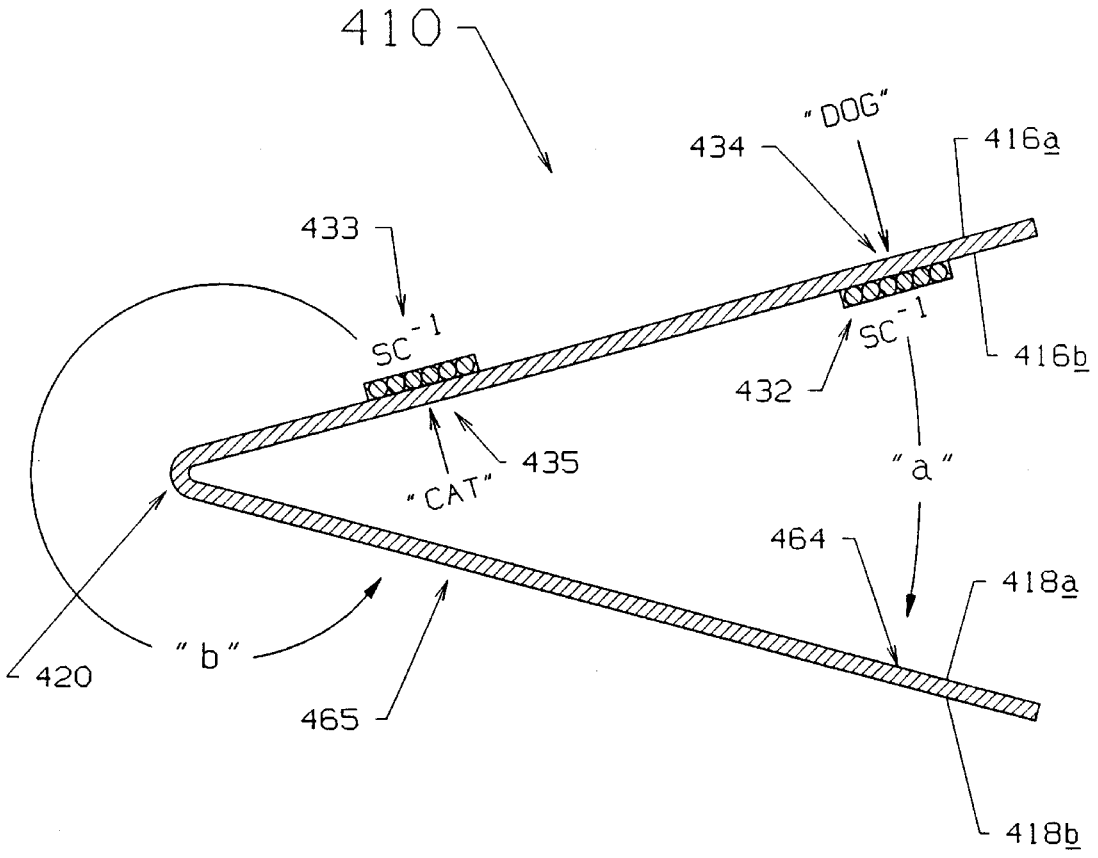
FIG. 10C is a cross-sectional view of the form set of FIGS. 10A and 10B, showing the carbonless coatings.

FIGS. 10A–10C, similar to FIGS. 4A–4C of the aforementioned U.S. patent application Ser. No. 08/126,538, illustrate a true-original type form 400, having only one single sheet of paper, folded to form two panels.

A single sheet of paper 411 has a front surface 412 and a back surface 414. The sheet 411 is delineated into an "original" panel 416 and a "copy" panel 418, preferably by a fold 420, and the fold 420 is preferably provided with a series of perforations (not shown) for aiding in folding and facilitating separating (after use) the two panels 416 and 418.

The panels 416 and 418 are nominally the same size, e.g. measuring 8½×11 inches. However, as disclosed in the aforementioned U.S. patent application Ser. No. 07/591,781, the fold 420 may be formed slightly off center so that the copy panel 418 is slightly larger than the original panel 416. This is advantageous when it comes to re-folding the sheet for entering second information ("CAT").

In FIG. 10A, the sheet 411 is folded one way, so that first information ("DOG") entered on the one surface 416*a* of the original panel 416 will be imaged onto the corresponding one surface 418*a* of the copy panel 418.

In FIG. 10B, the sheet 411 is folded in an opposite direction from that of FIG. 10A, exposing the opposite surface 416*b* of the original panel 416, so that second information ("CAT") entered on the opposite surface 416*b* of the original panel 416 will be imaged (reproduced) onto the corresponding opposite surface 418*b* of the copy panel.

Since the original panel 416 has original first and second information on its one and opposite surfaces, the form 400 must be considered to be of the "true-original" genre.

FIG. 10C shows how the various panels are carbonless coated to achieve the functions set forth above.

Reference is made to the aforementioned U.S. patent application Ser. No. 07/436,189, wherein FIGS. 1L–1M illustrate using patterned self-contained (SC) carbonless coating on the copy panel (68'), and leaving the original panel (66') entirely uncoated.

Reference is also made to the aforementioned U.S. patent application Ser. No. 07/334,183, wherein the sentence bridging pages 8–9 discloses "coating only the back surface of the original [panel]"—thereby postulating a "transfer-onto-plain-paper" type carbonless coating. U.S. Pat. No. 4,352,855 discloses such a "transfer-onto-plain-paper" type coating, hereinafter referred to as "anti-SC".

A carbonless anti-SC (or "$SC^{-1}$") coating is applied to a selected coating area 432 on the opposite surface 416*b* of the original panel 416 which is directly behind a selected writing area 434 on the one surface 416*a* of the original panel 416. A selected area 464 on the one surface 418*a* of the copy panel 418 is un-coated, and is aligned with the areas 434 and 432 (when the sheet 411 is folded one way), for revealing an image of writing ("DOG") impressed upon the selected writing area 434. See arrow "a". The selected areas 434, 432 and 464 may each comprise multiple discontinuous aligned areas on the respective surfaces of the panels.

The sheet 411 is then re-folded for entering second information ("CAT") on the opposite surface 416*b* of the original panel 416, and creating a carbonless copy of that information on the opposite surface 418*b* of the copy panel.

A carbonless anti-SC (or "$SC^{-1}$") coating is applied to a selected coating area 433 on the one surface 416*a* of the original panel 416 which is directly behind a selected writing area 435 on the opposite surface 416*b* of the original panel 416. A selected area 465 on the opposite surface 418*b* of the copy panel 418 is un-coated, and is aligned with the areas 435 and 433 (when the sheet 411 is folded the opposite way), for revealing an image of writing ("CAT") impressed upon the selected writing area 435. See arrow "b". The selected areas 435, 433 and 465 may each comprise multiple discontinuous aligned areas on the respective surfaces of the panels.

The first selected areas 434, 432 and 464 are offset from the second selected areas 435, 433 and 465.

Figure 11A:
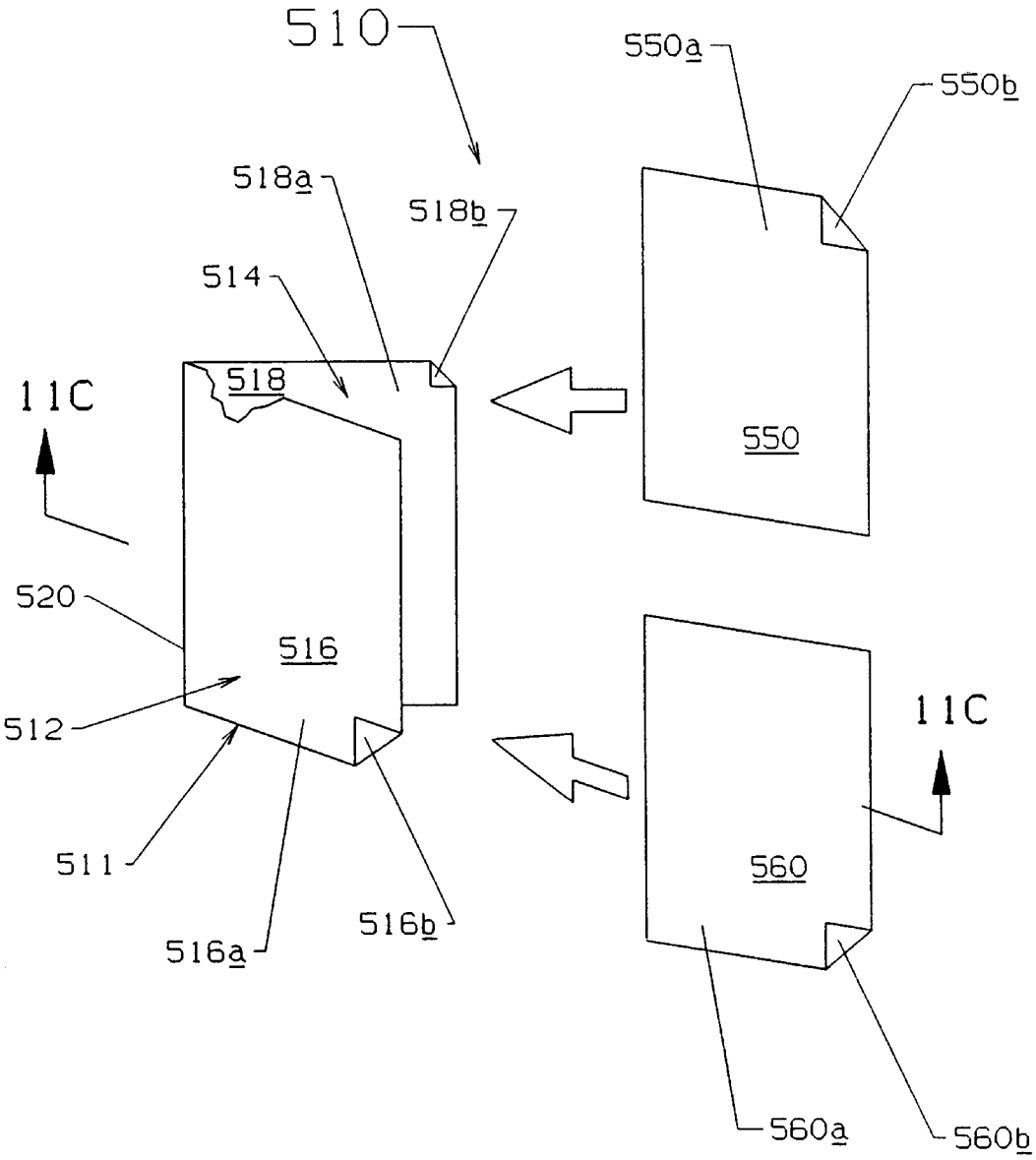
FIG. 11A is a perspective view of a "true-original" type two-sided, self-replicating form, with a single sheet having an original panel and a copy panel folded one way, for entering information on one surface of the original panel. Separate image-transferring sheets are also shown.
Figure 11B:
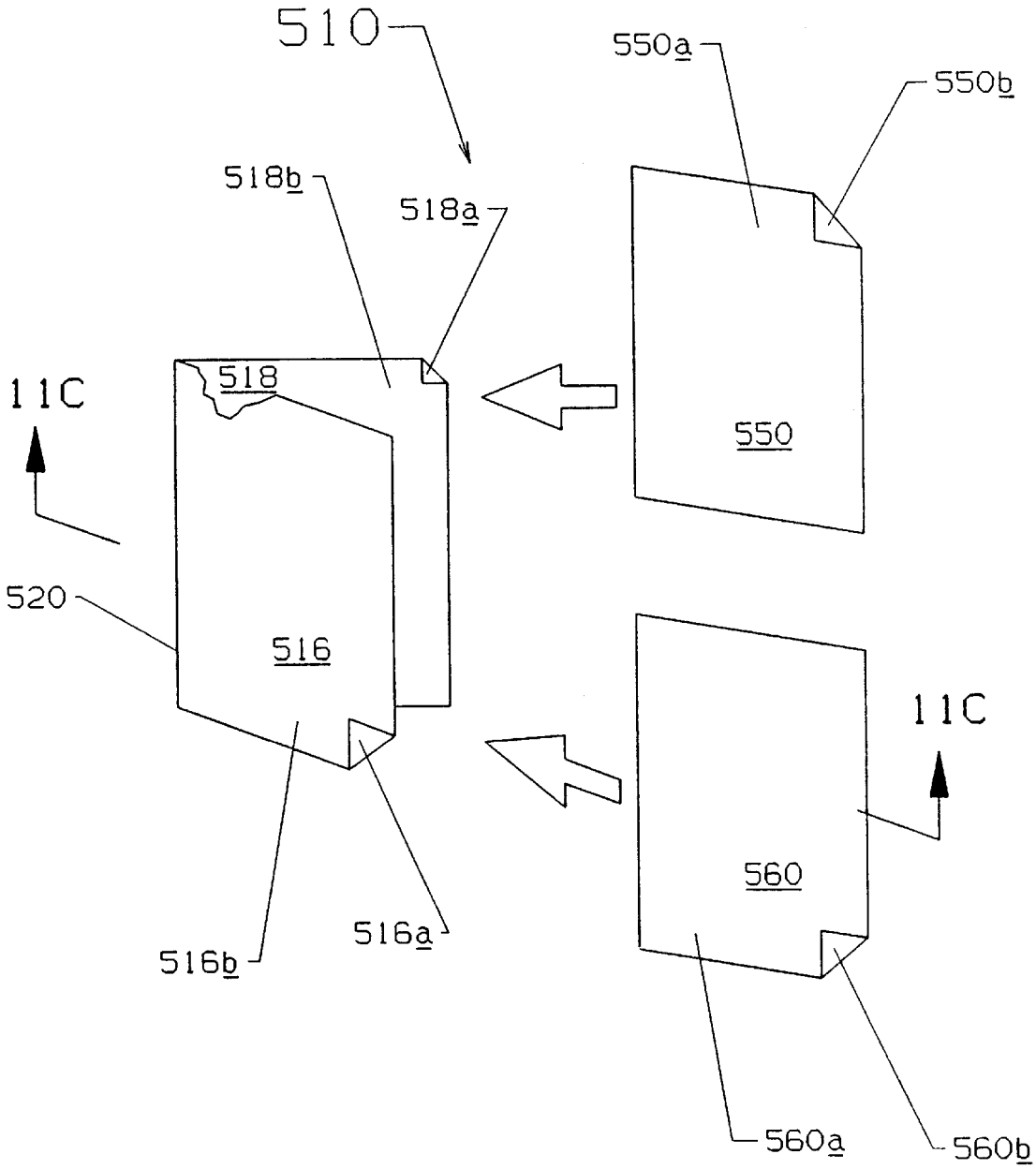
FIG. 11B is a perspective view of the form of FIG. 11A, folded another way, for entering information on the opposite surface of the original panel.
Figure 11C:
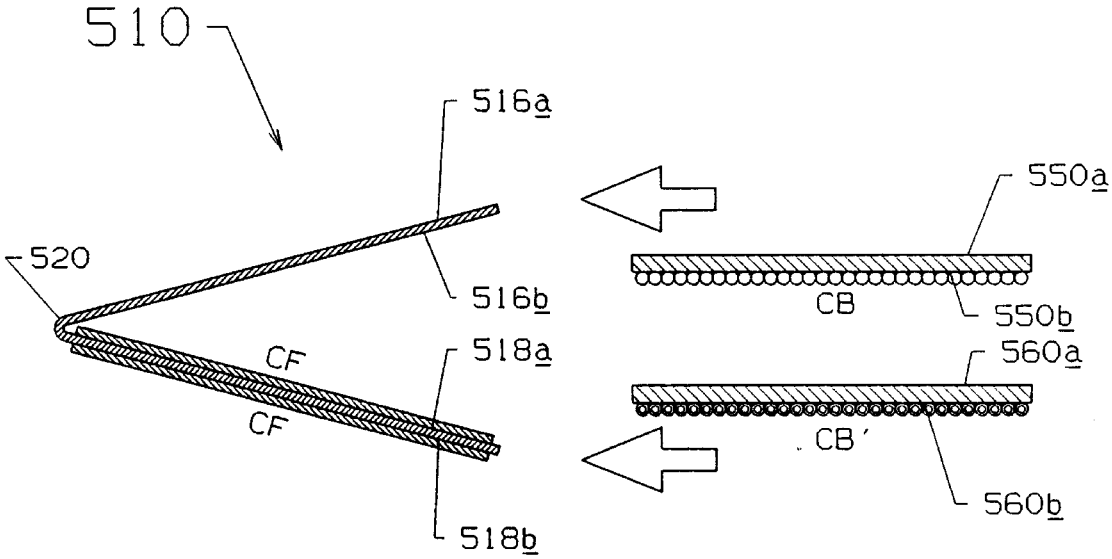
FIG. 11C is a cross-sectional view of the form of FIGS. 11A and 11B, showing the carbonless coatings.
Figure 11D:
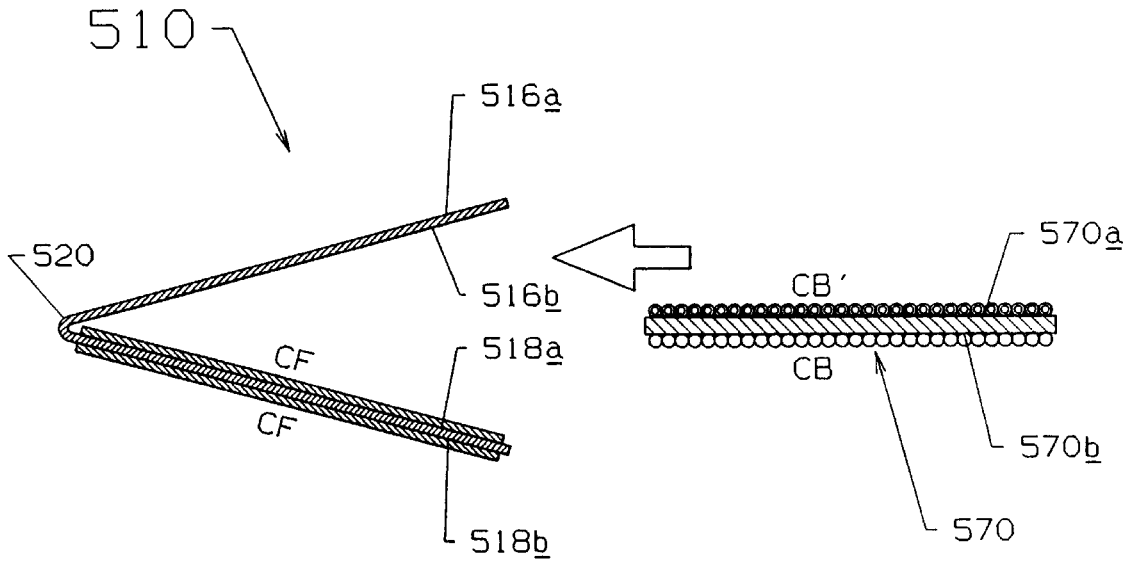
FIG. 11D is a cross-sectional view of an alternate embodiment of the form of FIGS. 11A–11C, wherein only a single image-transferring sheet capable of image-transferring in one of two colors is employed.

FIGS. 11A–11C, similar to FIGS. 5A–5C of the aforementioned U.S. patent application Ser. No. 08/126,538, illustrate a true-original type form 500, having mainly only a single sheet of paper, folded to form two panels, an "original" panel 516 and a "copy" panel 518.

Attention is directed to the aforementioned U.S. patent application Ser. No. 07/484,686, continued as the aforementioned U.S. patent application Ser. No. 07/723,690, which discloses in FIGS. 2A–2C thereof that the original panel (216) is not coated, the copy panel (218) is coated on both sides with CF, and a separate image-transferring sheet (250) coated on at least one side with CB is interposed between the panels to effect image-transfer between the original panel and the copy panel.

An advantage of the form disclosed in the parent application is that there are no coatings, hence no potential pen-skipping problems associated with writing on the original panel. While patterning the coatings also avoids this problem, patterning imposes its own constraints on the manufacture and limitations on the use of carbonless forms.

The present invention is very similar to the forms previously disclosed, with the exception that the user can select from at least two different image-transferring sheets to cause different color imaging on the copy panel. For example, it may be desirable in some circumstances to have the copy images reveal themselves in a blue color on one or both sides (surfaces) of the copy panel, and in other circumstances to reveal themselves in a black color on one or both sides (surfaces) of the copy panel. Blue and black are well known carbonless image-revealing colors.

With reference to FIGS. 11A–11C, a single sheet of paper 511 has a front surface 512 and a back surface 514. The sheet 511 is delineated into an "original" panel 516 and a "copy" panel 518, preferably by a fold 520, and the fold 520 is preferably provided with a series of perforations (not shown) for aiding in folding and facilitating separating (after use) the two panels 516 and 518.

The panels 516 and 518 are nominally the same size, e.g. measuring 8½×11 inches. However, as disclosed in the aforementioned U.S. patent application Ser. No. 07/591,781, the fold 520 may be formed slightly off center so that the copy panel 518 is slightly larger (e.g., wider) than the original panel 516. This is advantageous when it comes to re-folding the sheet for entering second information ("CAT") on the previously non-exposed surface (i.e., 516*b*) of the original panel.

In FIG. 11A, the sheet 511 is folded one way, so that first information ("DOG") entered on the one surface 516*a* of the original panel 516 will be imaged onto the corresponding one surface 518*a* of the copy panel 518.

In FIG. 11B, the sheet 511 is folded in an opposite direction from that of FIG. 11A, exposing the opposite surface 516*b* of the original panel 516, so that second information ("CAT") entered on the opposite surface 516*b* of the original panel 516 will be imaged (reproduced) onto the corresponding opposite surface 518*b* of the copy panel 518.

One of two separate image-transferring sheets 550 or 560 is interposed between the original and copy panels, when folded either way, to effect image-transferring, and may be discarded after use.

Since the original panel 516 has original first and second information on its one and opposite surfaces, the form 500 must be considered to be of the "true-original" genre.

FIG. 11C shows how the sheet 511 and sheets 550/560 are carbonless coated to achieve the functions set forth above.

The inventors have recognized that various CB coatings will cause various color images on a specific CF coating. For example, waxy OPAS (from MEAD) CB images blue on black "PRT" (mill stock) CF coated stock, and aqueous OPAS ("LCB", from MEAD) images black on the same PRT stock. Other combinations of coatings from various manufacturers have been found to exhibit this characteristic.

According to the invention, a single "standard" sheet 511 is employed, and the user is free to select from at least two different image-transferring sheets 550 or 560 to exercise control over the color of the images on the copy panel 518. The inventors envision that a blue or a black imaging CB image-transferring sheet would be used for imaging onto both sides of the copy panel, but a user may also use a blue-imaging CB image-transferring sheet 550 the one way ("DOG") and a black-imaging CB image-transferring sheet 550' the other way ("CAT"), or vice-versa. In this case, the user would want both color image-transferring sheets 550 and 560 on hand. They could easily be distinguished by color-coding, or other appropriate distinguishing marks. To this end, it is proposed that a blue-imaging image-transferring sheet be colored blue, and that a black-imaging image transferring sheet be colored grey (i.e., a light shade of black). In either case, the image-transferring sheet preferably would be dissimilarly colored from the usual white original and pink or canary copy.

As shown in FIG. 11C, the original panel 516 is un-coated (i.e., does not have either component of a carbonless system). The copy panel 518 is coated on both sides 518*a* and 518*b* with a CF component capable of revealing an image in at least two visibly different colors, depending upon the particular CB employed.

The image-transferring sheet 550 is coated on at least one side 550*b* with a carbonless CB component revealing itself on the CF-coated copy panel 518 in one color (e.g., blue). It can be also coated on both sides with the same CB component.

The image-transferring sheet 560 is coated on at least one side 560*b* with a carbonless CB' component revealing itself on the CF-coated copy panel 518 in another, dissimilar color (e.g., black). It can be also coated on both sides with the same CB' component.

As set forth above, the user would select from one of the sheets 550, 560 for imaging in one direction ("DOG"), and would select the same or the other sheet for imaging in the opposite direction ("CAT"). Since, whichever way the sheet 511 is folded, only the down-facing surface of the image-transferring sheet 550 or 560 is operative, as mentioned above, the up-facing surface can be coated with the same component as the down-facing surface.

With reference to FIG. 1D, similar to FIG. 5D of the aforementioned U.S. patent application Ser. No. 08/126,538, a single intermediate transfer sheet 570 can advantageously be coated with a CB component revealing itself in one color on one side 570*b*, and with a CB' component revealing itself in another dissimilar color on another side 570*a*. With such a single image-transferring sheet (rather than two different sheets 550, 560), the user would simply select which surface of the intermediate transfer sheet 570 is facing down when it is inserted between the folded ("DOG") and re-folded ("CAT") sheet 511 to exercise control over the color in which writing is reproduced.

Although the invention has been illustrated and described in detail in the drawings and in the description thereof, the same is to be considered as illustrative and not restrictive in character—it being understood that only preferred embodiments have been shown and described, and that all changes and modifications that come within the spirit of the invention are desired to be protected.

What is claimed is:

1. A single sheet of paper having two surfaces and capable of reproducing information entered on both of its two surfaces, comprising:

a single sheet of paper having two surfaces, one of which is a front surface, an other of which is a back surface, a first portion of the single sheet of paper being an original panel having a front surface which is the front surface of the single sheet of paper and having a back surface which is the back surface of the single sheet of paper, a second portion of the single sheet of paper being a copy panel having a front surface which is the front surface of the single sheet of paper and having a back surface which is the back surface of the single sheet of paper;

a first carbonless coating applied only to the original panel, on the front and back surfaces thereof;

a second carbonless coating applied only to the copy panel, on the front and back surfaces thereof; and the first and second carbonless coatings being selected from a common carbonless system wherein the second carbonless coating is capable of revealing an image when the first carbonless coating is pressed against the second carbonless coating;

wherein:

when the single sheet of paper is folded in a first direction, so that the original panel is disposed over the copy panel and the front surface of the original panel is exposed for entering first information thereon, the first information entered on the front surface of the original panel causes the first carbonless coating on the back surface of the original panel to press against the second carbonless coating on the back surface of the copy panel, thereby resulting in the second coating on the back surface of the copy panel revealing an image of the first information entered on the front surface of the original panel; and when the single sheet of paper is folded in a second direction, so that the original panel is disposed over the copy panel and the back surface of the original panel is exposed for entering second information thereon, the second information entered on the back surface of the original panel causes the first carbonless coating on the front surface of the original panel to press against the second carbonless coating on the front surface of the copy panel, thereby resulting in the second coating on the front surface of the copy panel revealing an image of the second information entered on the back surface of the original panel.

2. A single sheet of paper, according to claim 1, further comprising:

a fold between the original panel and the copy panel.

3. A single sheet of paper, according to claim 1, further comprising:

a line of perforations between the original panel and the copy panel.

4. A single sheet of paper, according to claim 1, wherein:

the first carbonless coating is a CF coating; and the second carbonless coating is a CB coating.

5. A single sheet of paper, according to claim 1, wherein:

the copy panel is larger than the original panel.

6. A single sheet of paper, according to claim 1, wherein:

the single sheet of paper has a first size and is formed of an oversize sheet of paper having a second size which is four times the first size; and the oversize sheet is folded and laminated upon itself to form the single sheet of paper.

7. A single sheet of paper, according to claim 6, wherein:

the oversize sheet of paper has two surfaces, one of which is a front surface, an other of which is a back surface, and the oversize sheet of paper has four portions, one of which is a first end portion, one of which is a second end portion, one of which is a first middle portion adjacent the first end portion, one of which is a second middle portion adjacent the second end portion;

the first end portion is folded and laminated to the first middle portion to form the original panel of the single sheet of paper; and the second end portion is folded and laminated to the second middle portion to for the copy panel of the single sheet of paper.

8. A single sheet of paper, according to claim 6, wherein:

the oversize sheet of paper has two surfaces, one of which is a front surface, an other of which is a back surface;

the first carbonless coating is applied only to the front surface of the oversize sheet of paper; and the second carbonless coating is applied only to the back surface of the oversize sheet of paper.

9. Carbonless form for reproducing information entered on both sides of an original panel onto both sides of a copy panel, comprising:

an original panel having a front surface and a back surface, and coated with carbonless CB coating on its front and back surfaces;

a separate copy panel having a front surface and a back surface, and coated with carbonless CF coating on its front and back surfaces; and means for joining the original and copy panels along an edge of each to form a virtual single sheet of paper.

10. Carbonless form for reproducing information entered on both sides of an original panel onto both sides of a copy panel, comprising:

an original panel having a front surface and a back surface, and coated with carbonless CF coating on its front and back surfaces;

a copy panel having a front surface and a back surface, and coated with carbonless CF coating on its front and back surfaces; and an intermediate transfer panel coated on at least one of its front and back surfaces with carbonless CB coating.

11. Carbonless form according to claim 10, wherein:

the intermediate transfer sheet is coated on only one surface with carbonless CB coating.

12. Carbonless form according to claim 10, wherein:

the intermediate transfer sheet is coated on one side with carbonless CB coating and on the other side with carbonless CF coating.

13. Apparatus according to claim 10, further comprising:

a portfolio containing the sheet having the original and copy panels, and containing the intermediate transfer panel.

14. Apparatus according to claim 13, further comprising:

envelopes contained in the portfolio.

* * * * *